US011524836B1

(12) United States Patent
Hochberg et al.

(10) Patent No.: US 11,524,836 B1
(45) Date of Patent: Dec. 13, 2022

(54) CONTAINER

(71) Applicant: The Procter & Gamble Company, Cincinnati, OH (US)

(72) Inventors: Scott David Hochberg, Cincinnati, OH (US); Brian David Andres, Harrison, OH (US); Kyle William Harris, Maineville, OH (US); Nicole Alisa Renee Lockett Turner, Fairfield, OH (US); Matthew John Boehm, Ross, OH (US); Christian Alexander Zipperer, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 17/470,666

(22) Filed: Sep. 9, 2021

(51) Int. Cl.
*B65D 85/62* (2006.01)
*B65D 83/00* (2006.01)

(52) U.S. Cl.
CPC ..... *B65D 85/62* (2013.01); *B65D 83/00* (2013.01)

(58) Field of Classification Search
CPC ..... B65D 80/0418; B65D 2583/0472; B65D 85/62; B65D 83/00
USPC ... 221/229, 198, 271, 232, 269, 268, 270, 1, 221/281, 4, 277; 206/42
See application file for complete search history.

(56) References Cited

U.S. PATENT DOCUMENTS 1,485,716 A * 3/1924 Reginald ..... B65D 83/0038 221/185
2,620,061 A * 12/1952 Uxa ..... B65D 83/0418 221/229
3,112,046 A * 11/1963 Szekely ..... B65D 83/0409 221/312 R
3,410,455 A * 11/1968 Haas ..... B65D 83/0418 221/229

(Continued)

FOREIGN PATENT DOCUMENTS

AU 688237 B * 3/1998 ..... G07F 11/14
WO WO-2008074177 A1 * 6/2008 ..... B65D 83/0418

(Continued)

OTHER PUBLICATIONS

All Office Actions; U.S. Appl. No. 29/807,169, filed Sep. 9, 2021.

(Continued)

*Primary Examiner* — Rakesh Kumar
(74) *Attorney, Agent, or Firm* — Alexandra S. Anoff

(57) ABSTRACT

A container for a plurality of articles comprising a main body, a hollow member fixedly coupled to an end of the main body, a cup member rotatably coupled to the hollow member, and a cam arm received within the hollow member and the cup member. The hollow member and the cup member define a dispensing opening. The cup member comprises a base portion defining a grooved track facing the end of the main body. The cam arm is configured to engage a bottom article from the plurality of articles and comprises a protrusion movably engaged with the grooved track. The cam arm moves relative to the hollow member, due to a (Continued)

relative rotation between the hollow member and the cup member, to a dispensing position in which the bottom article at least partially extends through the dispensing opening and is removable from the container.

19 Claims, 41 Drawing Sheets

(56) References Cited

U.S. PATENT DOCUMENTS 3,511,409 A * 5/1970 Huck ..... B65D 83/0418 221/231
3,515,111 A * 6/1970 Auge ..... A23G 3/563 124/16
3,565,284 A * 2/1971 Ignaz ..... B65D 83/0418 221/229
3,854,625 A * 12/1974 Kuebler ..... B65D 83/0409 221/307
3,942,683 A * 3/1976 Haas ..... B65D 83/0418 221/229
4,171,753 A * 10/1979 Vreede ..... B65D 83/0418 221/229
4,311,251 A * 1/1982 Sternberg ..... B65D 83/0418 221/229
4,413,750 A * 11/1983 Morrone ..... G07D 1/08 273/148 R
4,589,575 A * 5/1986 Rigberg ..... B65D 83/0418 221/269
4,984,709 A * 1/1991 Weinstein ..... B65D 83/0409 206/536
4,986,442 A * 1/1991 Hinterreiter ..... B65D 83/0418 221/229
5,048,720 A * 9/1991 Hoke ..... B65D 83/0418 221/229
5,071,033 A * 12/1991 Siwek ..... B65D 83/0409 221/229
5,081,778 A * 1/1992 Switzer ..... F41A 9/66 42/50
5,118,007 A * 6/1992 Lewis ..... B65D 83/049 206/536
5,178,298 A * 1/1993 Allina ..... B65D 83/0418 221/229
5,230,440 A * 7/1993 Kurokawa ..... B65D 83/0418 221/232
5,617,973 A * 4/1997 Seto ..... G01N 35/00029 221/56
5,785,206 A * 7/1998 Chan ..... G07F 11/14 221/269
6,189,742 B1 * 2/2001 Thomson ..... A47G 19/34 222/362
6,220,479 B1 * 4/2001 Fishman ..... B65D 83/0409 221/24
6,840,402 B2 * 1/2005 Lin ..... G01J 5/02 374/E1.013
7,207,464 B2 * 4/2007 Brenner ..... B65D 83/049 221/303
7,533,483 B1 * 5/2009 Alzamora ..... F41A 9/65 89/197
7,749,191 B2 * 7/2010 Truax ..... A61M 15/0003 604/90
9,545,364 B2 1/2017 Glenn, Jr. et al.
9,738,433 B2 * 8/2017 Hogg ..... B65D 83/02
9,932,166 B2 * 4/2018 Marqua ..... G07F 11/44
11,142,848 B2 10/2021 Glenn, Jr. et al.
2004/0007585 A1 * 1/2004 Griffith ..... G01N 33/48757 221/232
2007/0125794 A1 * 6/2007 Jones ..... G07F 11/20 221/231
2010/0084419 A1 * 4/2010 Haas ..... B65D 83/0418 221/1
2012/0021026 A1 1/2012 Glenn, Jr.
2012/0058166 A1 3/2012 Glenn, Jr.
2013/0116818 A1 * 5/2013 Hamilton ..... A61J 7/04 221/277
2014/0329428 A1 11/2014 Glenn, Jr. et al.
2018/0163325 A1 6/2018 Glenn, Jr. et al.
2020/0071851 A1 3/2020 Glenn, Jr. et al.
2021/0189602 A1 6/2021 Glenn, Jr. et al.
2021/0403225 A1 * 12/2021 Koh ..... B65D 83/0418

FOREIGN PATENT DOCUMENTS

WO WO-2014090317 A1 * 6/2014 ..... B65D 83/0418
WO WO-2016018954 A1 * 2/2016 ..... B65D 83/0418
WO 2022112172 A1 6/2022

OTHER PUBLICATIONS

All Office Actions; U.S. Appl. No. 17/940,303, filed Sep. 8, 2022.
Unpublished U.S. Appl. No. 17/940,303, filed Sep. 8, 2022, to Scott David Hochberg et al.
U.S. Appl. No. 29/807,169, filed Sep. 9, 2021, Kyle William Harris et al.

* cited by examiner

CONTAINER

FIELD OF THE INVENTION

The present invention is generally directed to a container, and more particularly to a container for a plurality of dissolvable articles.

BACKGROUND OF THE INVENTION

Some personal care products, including shampoos, conditioners, body washes, facial cleansers, and hand soaps, are available in a solid unit dose form. Such products may include dissolvable films, compressed powders in a solid, fibrous structures, porous foams, soluble deformable solids, powders, bars, or prills. Ideally, these products can be formulated to dissolve almost instantly when exposed to liquid water. However, this creates problems with storing the products, as it is generally most convenient to store personal care products where they will be used (e.g., in the shower, bathtub, or adjacent to a sink), and protecting the products through the supply chain and expected shelf life. However, these convenient storage locations are generally very humid and/or the products/articles can accidentally be splashed with water prior to use, causing the products to dissolve into a liquid personal care product and/or a gummy mess.

Currently, dissolvable unit dose products can be packaged individually. However, this is inconvenient because consumers must unwrap each article prior to use and dispose of the packaging, and the consumers generally do not have trash or recycling receptacles in the shower. Alternatively, the consumers can store the products away from the shower, bathtub, or sink and then they have to remember to take an article with them to a usage location every time they want to wash.

Therefore, there is a need for a container that can hold multiple doses of dissolvable unit dose consumer products, can allow for convenient, intuitive dispensing of the consumer products, and enables consumers to store the container in a humid environment where they will use the product, such as a shower, bathtub, or sink.

SUMMARY OF THE INVENTION

A container for a plurality of arranged articles, the container comprising: a main body having a hollow tubular shape and extending along a longitudinal axis, the main body comprising a first end and a second end opposing the first end, wherein at least the second end has an opening; a hollow member fixedly coupled to the main body at the second end and defining a first opening therethrough extending angularly about the longitudinal axis; a cup member rotatably coupled to the hollow member, such that the cup member is rotatable relative to the hollow member about the longitudinal axis, the cup member defining a second opening therethrough extending angularly about the longitudinal axis, wherein the cup member comprises a base portion defining a closed bottom end of the container and defining a grooved track facing the second end of the main body; and a cam arm received within the hollow member and the cup member, wherein the cam arm is movably coupled to the hollow member and comprises a protrusion movably engaged with the grooved track, such that the cam arm moves relative to the hollow member due to a relative rotation between the hollow member and the cup member; wherein the main body, the hollow member, and the cup member together receive the plurality of articles therein; wherein the hollow member and the cup member are rotatable relative to each other between an open configuration and a closed configuration, wherein, in the open configuration, the first and second openings are at least partially aligned with each other to form a dispensing opening, and wherein, in the closed configuration, the first and second openings are misaligned from each other to close the dispensing opening; and wherein the cam arm moves between an engaged position corresponding to the closed configuration and a dispensing position corresponding to the open configuration due to the relative rotation between the hollow member and the cup member, wherein, in the engaged position, the cam arm is configured to engage a bottom article from the plurality of articles, and wherein the cam arm is further configured to move the bottom article due to the relative rotation between the hollow member and the cup member, such that, in the dispensing position of the cam arm, the bottom article at least partially extends through the dispensing opening and is removable from the container.

A container for a plurality of arranged articles, the container comprising: a main body having a hollow tubular shape and extending along a longitudinal axis, the main body comprising a first open end and a second open end opposing the first open end; a top member fixedly coupled to the main body at the first open end, the top member defining a top opening therethrough in communication with the first open end, wherein the top opening is configured to be selectively open or closed; and a pusher slidably received within the main body and movable along the longitudinal axis, the pusher defining a movable closed bottom end of the container; wherein the plurality of articles is received within the main body and placed adjacent to a pusher, and wherein the pusher is movable along the longitudinal axis towards the top opening, such that a top article from the plurality of articles is removable from the top opening.

A container for a plurality of arranged articles on top of each other, the container comprising: a main body having a hollow tubular shape and extending along a longitudinal axis, the main body comprising a first closed end and a second open end opposing the first closed end; a bottom member fixedly coupled to the main body at the second open end; and a movable member movably coupled to the bottom member, such that the movable member is movable relative to the bottom member between a closed position and an open position, wherein the movable member defines a movable opening therethrough in communication with the second open end, the movable opening extending angularly relative to the longitudinal axis; wherein, in the closed position, the movable opening is closed, wherein, in the open position, the movable opening is at least partially exposed to allow removal of a bottom article from the plurality of articles from the container, and wherein the movable member defines a closed bottom end of the container.

BRIEF DESCRIPTION OF THE DRAWINGS

While the specification concludes with claims particularly pointing out and distinctly claiming the subject matter of the present invention, it is believed that the invention can be more readily understood from the following description taken in connection with the accompanying drawings, in which:

DETAILED DESCRIPTION OF THE INVENTION

Figure 1A:
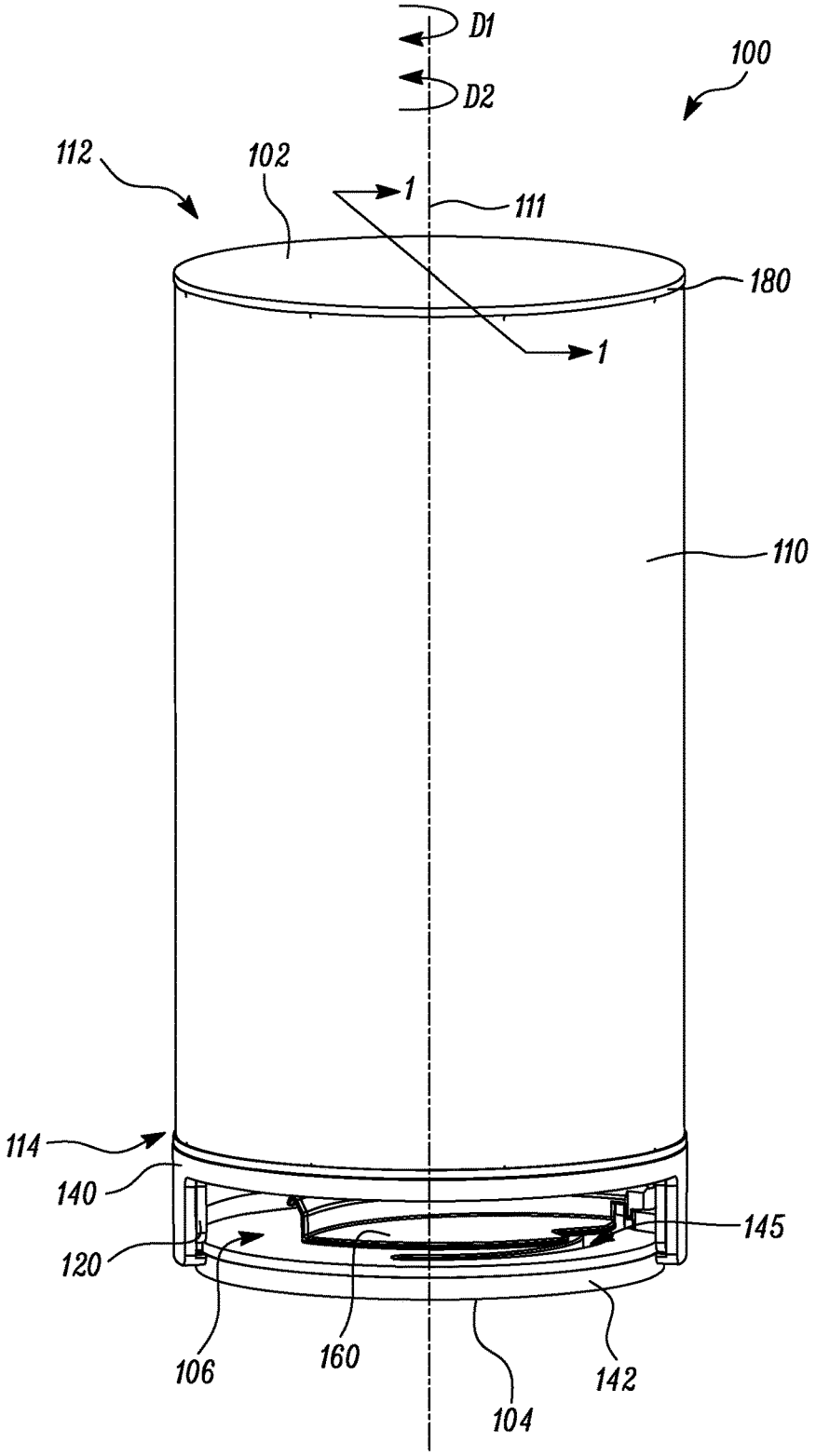
FIG. 1A is a front perspective view of a container for a plurality of articles according to a first aspect of the invention.

While the specification concludes with claims particularly pointing out and distinctly claiming the invention, it is believed that the present disclosure will be better understood from the following description.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The invention relates to a container for a plurality of arranged articles. The articles can be arranged in an orderly, semi-orderly/seemingly random, or random arrangement. In some examples, the articles can be stacked on top of each other. In other examples, the articles can be arranged side-by-side. The plurality of articles may be, for example, personal care and other consumer products in a solid form, including shampoos, conditioners, body washes, hand soaps, and facial cleansers. The plurality of articles can also be consumer products including laundry detergent, fabric softeners, fabric conditioners, household cleaners, dish soap, dishwasher detergent, toothpaste, mouthwash, etc. The container may store and dispense the plurality of articles, in some examples the articles can be directly stacked on top of one another and/or arranged side-by-side without material intervening.

The container comprises a main body having a hollow tubular shape and extending along a longitudinal axis. In some examples, the main body can be any hollow shape. For example, it can have a cross section that can be any shape including polygons, polygons with rounded corners, circular which includes oval, irregular shapes, etc. The main body comprises a first end and a second end opposing the first end. At least the second end may be open. The container further comprises a hollow member fixedly coupled to the main body at the second end and defining a first opening therethrough extending angularly about the longitudinal axis. The container further comprises a cup member rotatably coupled to the hollow member, such that the cup member may be rotatable relative to the hollow member about the longitudinal axis. The cup member defines a second opening therethrough extending angularly about the longitudinal axis. The cup member comprises a base portion defining a closed bottom end of the container and defining a grooved track facing the second end of the main body. The container further comprises a cam arm received within the hollow member and the cup member. The cam arm may be movably coupled to the hollow member and comprises a protrusion movably engaged with the grooved track, such that the cam arm moves relative to the hollow member due to a relative rotation between the hollow member and the cup member. The main body, the hollow member, and the cup member together receive the plurality of articles therein. The hollow member and the cup member are rotatable relative to each other between an open configuration and a closed configuration. In the open configuration, the first and second openings are at least partially aligned with each other to form a dispensing opening. In the closed configuration, the first and second openings are misaligned from each other to close the dispensing opening. The cam arm moves between an engaged position corresponding to the closed configuration and a dispensing position corresponding to the open configuration due to the relative rotation between the hollow member and the cup member. In the engaged position, the cam arm may be configured to engage a bottom article from the plurality of articles. The cam arm may be further configured to move the bottom article due to the relative rotation between the hollow member and the cup member, such that, in the dispensing position of the cam arm, the bottom article at least partially extends through the dispensing opening and may be removable from the container.

The container may reduce or prevent contact between the plurality of articles stored within the container and moisture present in an external environment (e.g., a shower, near a sink, or a humid bathroom) where the container may be disposed. Therefore, the container may reduce or prevent external moisture from being absorbed by the plurality of articles stored within the container. Further, the container may enable consumers to store or situate the container storing the plurality of articles in a humid environment where they will use the plurality of articles, such as a shower, bathtub, or sink.

In some cases, the main body may be substantially free of plastics, and can be made of paper, carton board, and/or a metal foil (e.g., aluminum or steel). Further, the hollow member, the cup member, and the cam arm may be made of plastic. Relative dimensions and weights of the main body, the hollow member, the cup member, and the cam arm may be selected such that the main body forms the bulk of the container, and an overall plastic content of the container may be low as compared to conventional containers that are fully made of plastic. The main body may be at least partially covered by a wrap-label and/or a coating to protect the main body from moisture during use (e.g., from splashes, wet hands, etc.).

In some cases, a support member may be disposed below the base portion of the cup member to separate the base portion from moisture (e.g., standing water) in an event of the container being placed on a moist surface.

The container may further provide an easy to use, intuitive dispensing mechanism to dispense the bottom article from the container. Specifically, a relative rotation between the hollow member and the cup member from the closed configuration to the open configuration in a first direction about the longitudinal axis may cause the cam arm to move from the engaged position to the dispensing position. After removal of the bottom article from the container, a relative rotation between the hollow member and the cup member from the open configuration to the closed configuration in a second direction opposite to the first direction may cause the cam arm to move from the dispensing position to the engaged position and engage a successive bottom article from the plurality of articles. Therefore, the plurality of articles may be easily and conveniently dispensed from the container. In some examples, the container can be stored horizontally. In other examples, the top article can be dispensed.

Thus, the opening of the container and the dispensing of the bottom article may be achieved in a single action by a consumer. Specifically, the relative rotation between the hollow member and the cup member from the closed configuration to the open configuration may simultaneously expose the dispensing opening and dispense the bottom article at least partially through the dispensing opening. Further, closing of the container and priming the container for future dispensing of the successive bottom article may also be achieved in another single action by the consumer. Specifically, the relative rotation between the hollow member and the cup member from the open configuration to the closed configuration may close the dispensing opening and cause the cam arm to engage the successive bottom article for future dispensing.

The container may further comprise a cap coupled to the main body at the first end. The cap may be configured to close the first end of the main body to define a closed top end of the container. The cap may inhibit pooling of water on the closed top end of the container. In some cases, the cap may be made of paper and/or aluminum. In such cases, a rigid or flexible plastic covering may be at least partially disposed on the cap to protect the cap from moisture (e.g., from splashes and water from a shower head that may be located near the container).

The container may further comprise a follower slidably received within the main body and configured to engage the plurality of articles, such that the plurality of articles may be received at least partially between the follower and the cam arm relative to the longitudinal axis. The follower may reduce or prevent misalignment of the plurality of articles in case the container is tipped over. The follower may also provide a moisture sink inside the container. The moisture sink can include an absorbent material (e.g. absorbent gelling material), desiccant, etc.

The hollow member may further comprise a first coupling portion fixedly coupled to the main body and a second coupling portion rotatably coupled to the cup member. The second coupling portion may define the first opening as an angular cut-out. The hollow member may further comprise a projection disposed between the first and second coupling portions. The projection may engage with each of the main body and the cup member, such that the projection is disposed between the main body and the cup member along the longitudinal axis. Specifically, the projection may engage with corresponding axial ends of the main body and the cup member, such that the cup member does not directly contact or engage the main body. This may enable the cup member to freely rotate relative to the main body. The cup member may include ridges or other textures that may be made from the primary material of the cup member or may be an added material such as a low-durometer material that facilitate gripping and turning it.

The hollow member may further comprise a plurality of shaped portions disposed on an outer surface of the first coupling portion. The shaped portions may engage the main body to rotationally and/or axially fix the main body and the hollow member relative to each other. In some examples, the member may be permanently joined to the body such as through adhesive, crimping, and/or riveting. In other examples, the member may be temporarily joined to the body.

The hollow member may further comprise an angular projection disposed at an end of the hollow member. The cup member may further define an angular slot movably engaging with the angular projection of the hollow member to allow the relative rotation between the hollow member and the cup member.

The cup member may further comprise a portion, which can be an annular portion, defining the second opening as an angular cut-out, and a connecting portion connecting a circumferential edge of the base portion with the portion. The angular slot may be defined between the circumferential edge of the base portion, the annular portion, and the connecting portion.

The cup member may further comprise a lip disposed at an end distal to the base portion. The hollow member may further comprise a groove at least partially receiving the lip of the cup member therein, such that the lip is rotatable relative to the groove.

The hollow member may further comprise a coupling feature extending from an inner surface of the hollow member. The cam arm may further comprise a coupling element received at least partially through the coupling feature to pivotally couple the cam arm to the coupling feature.

The coupling feature may comprise a narrow aperture, a shoulder disposed adjacent to the narrow aperture, and a wide aperture disposed adjacent to the shoulder and opposite to the narrow aperture. The coupling element of the cam arm may comprise a narrow portion pivotally received at least partially within the narrow aperture and a wide portion pivotally received at least partially within the wide aperture and engaging with the shoulder. The engagement between the wide portion of the coupling element and the shoulder of the coupling feature may secure the coupling element to the coupling feature.

The cam arm may further comprise a receiving portion configured to receive the bottom article thereon and an engaging portion extending from and inclined to the receiving portion. The engaging portion may be configured to engage with and move the bottom article towards the dispensing opening. The protrusion may extend from the receiving portion. Specifically, the protrusion and the engaging portion may extend from opposing major surfaces of the receiving portion. Further, the engaging portion may enable the bottom article to be reliably moved towards the dispensing opening when the cam arm moves from the engaged position to the dispensing position. Specifically, the engaging portion may prevent substantial slippage between the bottom article and the cam arm. The engaging portion may therefore prevent the bottom article from remaining stationary within the container while the cam arm moves to the dispensing position.

The cam arm may further comprise a curved portion extending from the engaging portion and distal to the receiving portion. In the engaged position, the curved portion may engage an inner surface of the hollow member.

The receiving portion of the cam arm may further define a V-shaped notch spaced apart from the engaging portion. In some cases, the V-shaped notch may act as a rotational stop for the cam arm by selectively engaging with the coupling element. The V-shaped notch may allow the cam arm to freely rotate about the coupling feature without interference. Moreover, the V-shaped notch may further reduce plastic content of the container (in cases where the cam arm is made of plastic).

The grooved track may extend from a first groove end to a second groove end. In the engaged position, the protrusion of the cam arm may engage with the first groove end of the grooved track. In the dispensing position, the protrusion of the cam arm may engage with the second groove end of the grooved track. The engagement between the protrusion and the first groove end may act as a first stop corresponding to the engaged position. Similarly, the engagement between the protrusion and the second groove end may act as a second stop corresponding to the dispensing position.

The base portion may comprise a first major surface and a second major surface opposite to the first major surface. The grooved track may extend from the first major surface. The cam arm may be at least partially disposed on the first major surface and move along the first major surface between the engaged position and the dispensing position. In some cases, the cam arm may substantially move along a plane of the first major surface of the base portion.

The base portion may further comprise a continuous side wall extending from the first major surface beyond the second major surface and a bottom wall connected to the continuous side wall and distal to the first major surface. The continuous side wall and the bottom wall may define the grooved track therebetween. The continuous side wall may have a suitable height to facilitate reliable engagement between the protrusion and the grooved track.

The base portion may further comprise a plurality of interconnected ribs extending from the second major surface and a rib extending from the second major surface and surrounding the plurality of interconnected ribs. The rib may be connected to at least some of the plurality of interconnected ribs. At least some of the plurality of interconnected ribs may define a plurality of hexagonal shapes. At least some of the plurality of interconnected ribs may be connected to the continuous side wall. The rib and the interconnected ribs may provide additional rigidity to the cup member. Further, the rib and the interconnected ribs may minimize contact between the base portion and moisture (e.g., standing water) that may be present on an external surface on which the container is placed. In some cases, an additional support member may be disposed on the rib to further minimize contact between the base portion and moisture present on the external surface.

Figure 1B:
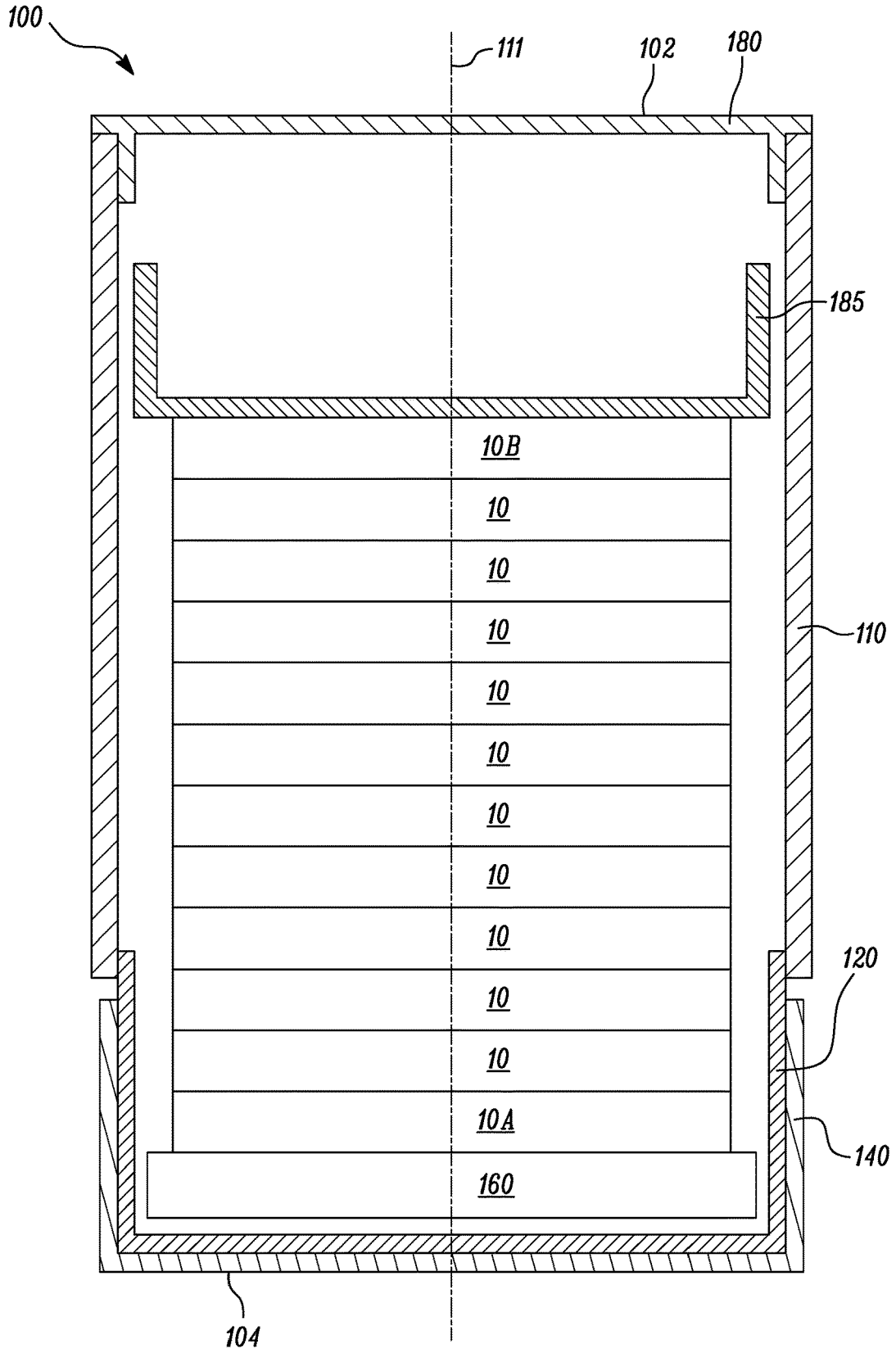
FIG. 1B is a schematic sectional view of the container of FIG. 1.

FIGS. 1A and 1B respectively show a front perspective view and a schematic sectional view of a container 100 for a plurality of arranged articles 10 stacked on top of each other according to a first aspect of the invention. Further, FIG. 2 shows an exploded perspective view of the container 100.

The plurality of articles 10 may be consumer products in a solid form. Specifically, the plurality of articles 10 may be personal care articles in the solid form, including, but not limited to, shampoos, conditioners, body washes, facial cleanser, and hand soap. For example, the plurality of articles 10 may be fibrous structures or porous foam structures that become liquid shampoo, liquid conditioner, liquid body wash, liquid face wash, and/or a liquid hand wash upon hydration, as described in US Pub. Nos. 2018/0333339, 2019/0282461, and 2020/0405587, incorporated by reference herein. In some cases, the plurality of articles 10 may be unit dose solid products. The plurality of articles 10 may have any suitable shape, such as circular, triangular, rectangular, polygonal, hexagonal, and the like, as per application requirements. The plurality of articles can be shaped similarly to the cross-section of the dispenser. The plurality of articles 10 stacked on top of each other comprise a bottom article 10A. The bottom article 10A may be a lowermost article of the plurality of articles 10.

Figure 2:
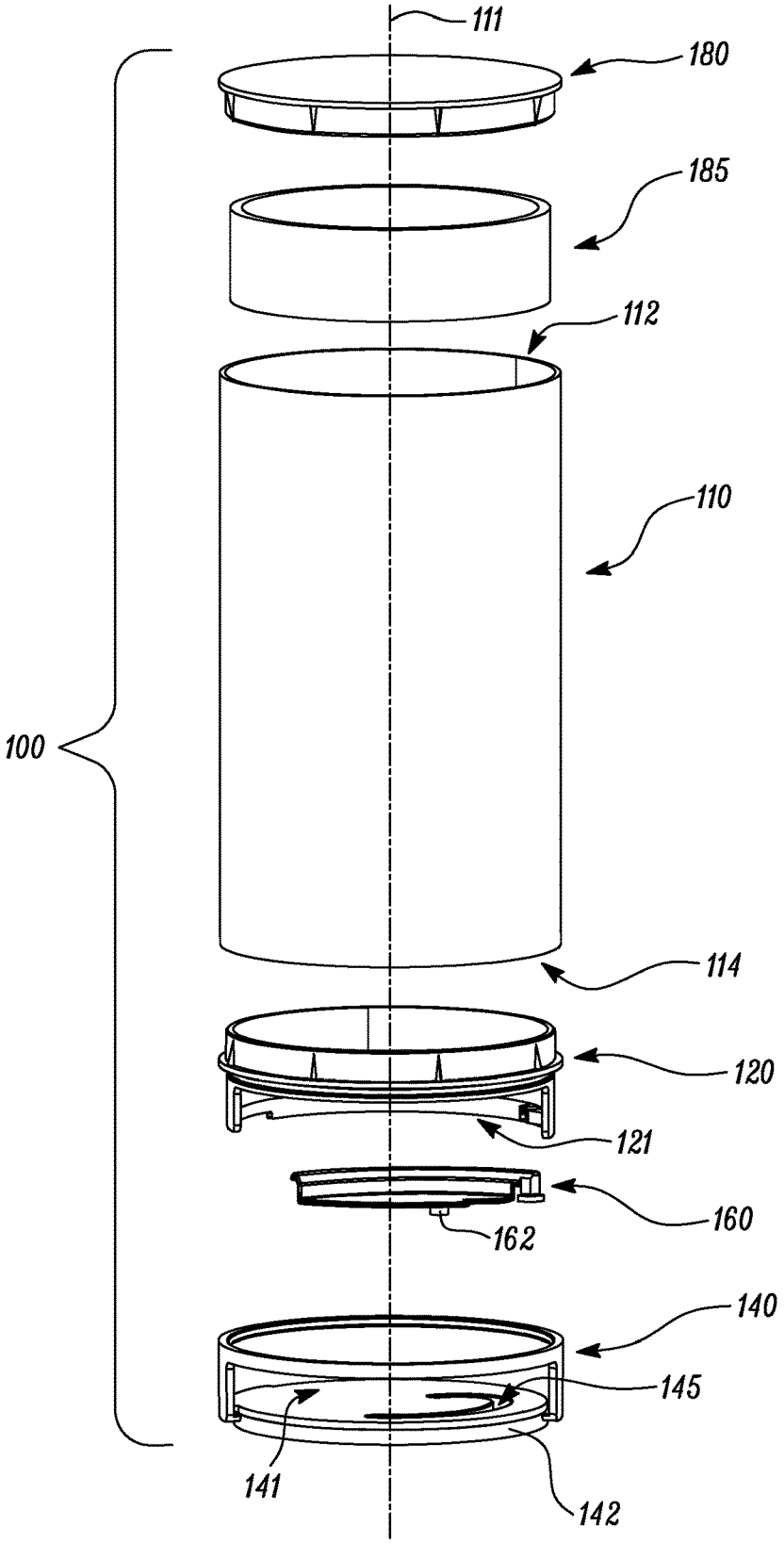
FIG. 2 is an exploded perspective view of the container of FIG. 1.

Referring to FIGS. 1A, 1B, and 2, the container 100 comprises a main body 110. The main body 110 has a hollow shape. In some examples, the hollow shape can be tubular and/or can have an annular cross-section. In other examples the hollow shape can have a cross-section that is circular which includes oval, rectangular which includes square, hexagonal, another polygon, a convex shape, a concave shape, a teardrop shape, a flower shape, a star shape, or any other suitable shape. The hollow tubular shape may allow the main body 110 to accommodate some of the plurality of articles 10 therein. As shown in FIGS. 1A, 1B, and 2, the main body 110 may have a hollow circular cylindrical shape.

The main body 110 comprises a first end 112 and a second end 114 opposing the first end 112. In other words, the second end 114 is opposite to the first end 112. The main body 110 extends along a longitudinal axis 111. Specifically, the main body 110 may extend along the longitudinal axis 111 between the first end 112 and the second end 114. At least the second end 114 is open. In other words, the main body 110 is open at the second end 114 thereof.

The first end 112 may be closed. For example, as shown in FIG. 1, the container 100 may further comprise a cap 180 coupled to the main body 110 at the first end 112. The cap 180 may be configured to close the first end 112 of the main body 110 to define a closed top end 102 of the container 100. The cap 180 may prevent accumulation of water on the closed top end 102 of the container 100, for example, by having a curved concave shape. In other words, the cap 180 may inhibit pooling of water on the closed top end 102 of the container 100. Alternatively, in some examples, the main body 110 may comprise a top portion integral with the main body 110 to close the first end 112, and to define the closed top end 102 of the container 100. In other words, the main body 110 may be pre-closed. For example, the main body 110 may be similar to a cup or a can (e.g., an aluminum can) with the top portion closing the first end 112 and defining the closed top end 102 of the container 100. The top portion may be configured to prevent accumulation of water on the closed top end 102 of the container 100, similar to the cap 180 described above.

The container 100 further comprises a hollow member 120 (shown more clearly in FIG. 2). The hollow member 120 can be at least partially received in the main body 110. In other words, at least a portion of the hollow member 120 may be received within the main body 110. The hollow member 120 may be fixedly coupled to the main body 110 at the second end 114. The hollow member 120 may not be movable relative to the main body 110. Specifically, the hollow member 120 may not move linearly and/or rotationally relative to the main body 110. Therefore, the hollow member 120 may rotate with the main body 110. The hollow member 120 defines a first opening 121 (shown in FIG. 2) therethrough extending angularly about the longitudinal axis 111.

The container 100 further comprises a cup member 140 rotatably coupled to the hollow member 120, such that the cup member 140 may be rotatable relative to the hollow member 120 about the longitudinal axis 111. The cup member 140 defines a second opening 141 (shown in FIG. 2) therethrough extending angularly about the longitudinal axis 111.

The second opening 141 of the cup member 140 may be substantially similar to the first opening 121 of the hollow member 120 in shape and dimensions, such that the second opening 141 and the first opening 121 may define a dispensing opening 106 upon at least partial alignment thereof. In other words, the cup member 140 and/or the hollow member 120 may be rotated relative to each other about the longitudinal axis 111, such that the first and second openings 121, 141 may at least partially align with each other and define the dispensing opening 106. The dispensing opening 106 defined by the first and second openings 121, 141 may have suitable shape and dimensions to allow at least one article (e.g., the bottom article 10A) from the plurality of the articles 10 to be dispensed therethrough.

The cup member 140 comprises a base portion 142. The base portion 142 defines a closed bottom end 104 of the container 100. The closed bottom end 104 may be opposite to the closed top end 102 of the container 100. The base portion 142 further defines a grooved track 145 facing the second end 114 of the main body 110.

The container 100 further comprises a cam arm 160 received within the hollow member 120 and the cup member 140. The cam arm 160 may be movably coupled to the hollow member 120. For example, the cam arm 160 may be pivotally coupled to the hollow member 120. The cam arm 160 comprises a protrusion 162 (shown in FIG. 2) movably engaged with the grooved track 145, such that the cam arm 160 moves relative to the hollow member 120 due to a relative rotation between the hollow member 120 and the cup member 140. Specifically, the protrusion 162 movably engaged with the grooved track 145 causes the cam arm 160 to move relative to the hollow member 120 due to the relative rotation between the hollow member 120 and the cup member 140. In other words, the protrusion 162 may be configured travel along the grooved track 145 and cause a movement of the cam arm 160 with respect to the hollow member 120 due to the relative rotation between the hollow member 120 and the cup member 140.

The relative rotation between the hollow member 120 and the cup member 140 can be achieved in any suitable manner. For example, the relative rotation between the hollow member 120 and the cup member 140 can be achieved by rotating the main body 110 (since the hollow member 120 may be fixedly coupled to the main body 110) with respect to the cup member 140, by rotating the cup member 140 with respect to the main body 110, or by rotating the main body 110 and the cup member 140 opposite to each other.

As shown in FIG. 1B, the main body 110, the hollow member 120, and the cup member 140 together receive the plurality of articles 10 therein. As discussed above, some of the plurality of articles 10 may be accommodated in the main body 110. Further, at least one of the plurality of articles 10 may be received within the hollow member 120 and the cup member 140. As discussed above, the plurality of articles 10 can include the bottom article 10A. The container 100 may be configured to dispense at least the bottom article 10A through the dispensing opening 106 (shown in FIG. 1). In some cases, the container 100 may be configured to sequentially dispense successive bottom articles from the stack of the plurality of articles 10 through the dispensing opening 106.

The container 100 may further comprise a follower 185. The follower 185 may be slidably received within the main body 110. Specifically, the follower 185 may slidably engage an inner surface of the main body 110. The follower 185 may be configured to engage the plurality of articles 10, such that the plurality of articles 10 may be received at least partially between the follower 185 and cam arm 160 relative to the longitudinal axis 111. The follower 185 may have a section that slidably engages with the main body 110 and a base section disposed at an end of the section. The base section of the follower 185 may engage a top article 10B from the plurality of articles 10. The top article 10B may be an uppermost article of the plurality of articles 10 stacked on top of each other. The follower 185 may be configured to slide along the longitudinal axis 111 to maintain engagement with the plurality of articles 10. Advantageously, the follower 185 may reduce or prevent misalignment of the plurality of articles 10 in case the container 100 is tipped over. In other words, the follower 185 may maintain the plurality of articles 10 in an aligned stack in case the container 100 is tipped over.

The main body 110 may be configured to provide compression resistance and moisture barrier to the container 100. In other words, the main body 110 may protect the plurality of articles 10 from compression (e.g., by external forces incurred by the container 100 during shipping or usage thereof) and may reduce or prevent contact between the plurality of articles 10 stored within the container 100 and moisture present in an external environment (e.g., a shower) where the container 100 is disposed. Therefore, the container 100 may reduce or prevent external moisture from being absorbed by the plurality of articles 10 stored within the container 100.

The main body 110 may be primarily made of a paper material and may be substantially free of plastic. Specifically, the main body 110 may comprise from 0% to 5% by weight of plastic. The main body 110 made of the paper material may comprise barrier materials to protect the main body 110, for example, against moisture, grease/oils, oxygen, etc. The barrier materials may be coatings (applied before or after paper forming) or additional construction layers, such as films or aluminum foil. One example of the barrier materials is VaporCoat® 2200R, commercially available from Michelman® Incorporated, Cincinnati, Ohio. However, the barrier materials may comprise any other printed, sprayed, or laminated barrier materials.

In some examples, the paper material of the main body 110 may be spiral wound. That is, the paper material may comprise an interior layer, an outer layer, and one or more inner layers disposed between the interior and outer layers. Further, each of the interior layer, the one or more inner layers, and the outer layer may be wrapped around a mandrel. Each of the inner layer, the outer layer, and the one or more internal layers may be coated with the barrier materials. In one example, the inner layer may be coated with a layer of aluminum foil. Further, in one example, the outer layer may be coated with VaporCoat® 2200R. Alternatively, the main body 110 may be constructed from a carton board that may be formed into a generally cylindrical shape and comprise the barrier materials for protection thereof.

The cap 180 may be made of a plastic, for example, by injection molding. Alternatively, the cap 180 may be made of a formed pulp with the barrier materials applied to the formed pulp. Alternatively, the cap 180 can be made of metal (e.g., aluminum).

The follower 185 may be primarily made of a paper material. Additionally, the follower 185 may provide a moisture sink inside the container 100. In other words, the follower 185 may absorb moisture that may enter into the container 100 from the external environment.

Each of the hollow member 120, the cup member 140, and the cam arm 160 may be made of a plastic. Alternatively, each of the hollow member 120, the cup member 140, and the cam arm 160 may be made of injection molded pulp, or a combination of injection molded paper and plastic. In some examples, each of the hollow member 120, the cup member 140, and the cam arm 160 may be made of aluminum.

Further, the container 100 may be substantially made of paper and/or aluminum. In some examples, the container 100 may comprise less plastic per dose than current liquid shampoo bottles. In some examples, the container 100 can contain less than 60% plastic, less than 55% plastic, or less than 50% plastic.

Figure 3A:
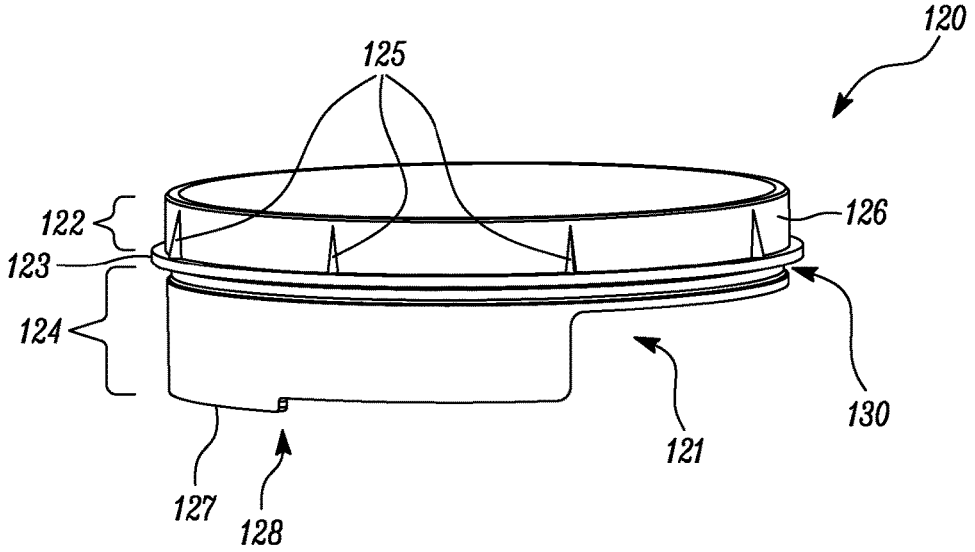
FIG. 3A is a side perspective view of a hollow member of the container of FIG. 1.
Figure 3B:
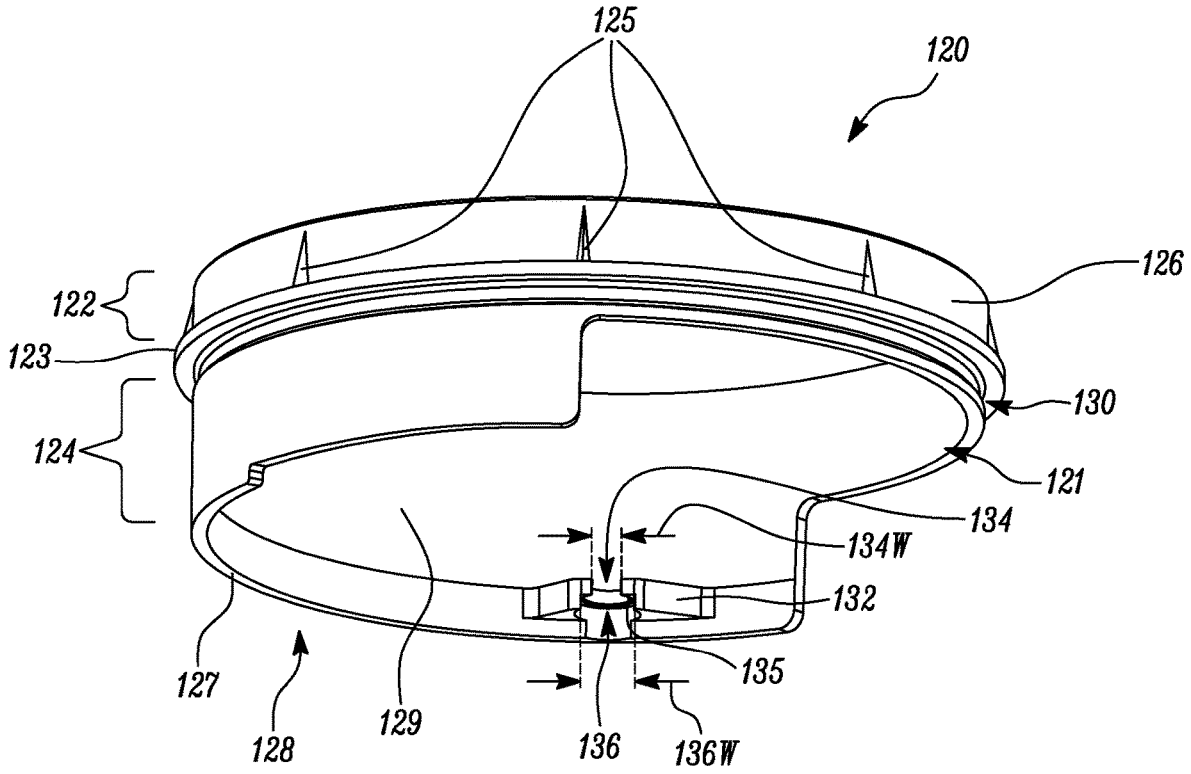
FIG. 3B is a bottom perspective view of the hollow member of FIG. 3A.

FIGS. 3A and 3B respectively show a side perspective view and a bottom perspective view of the hollow member 120. The hollow member 120 may comprise a first coupling portion 122 and a second coupling portion 124. The hollow member 120 may further comprise a projection 123 disposed between the first and second coupling portions 122, 124.

Referring to FIGS. 2, 3A, and 3B, the first coupling portion 122 may be fixedly coupled to the main body 110. Specifically, the first coupling portion 122 may be fixedly coupled to the main body 110 at the second end 114 thereof. The first coupling portion 122 may be at least partially received in the main body 110 at the second end 114 to fixedly couple the hollow member 120 to the main body 110. In some cases, the first coupling portion 122 may be configured to form an interference fit with the main body 110 at the second end 114.

As shown in FIGS. 3A and 3B, the hollow member 120 may further comprise a plurality of shaped portions 125 disposed on an outer surface 126 of the first coupling portion 122. In other words, the first coupling portion 122 may comprise the plurality of shaped portions 125. In some examples, the plurality of shaped portions 125 may be tapered. Further, the shaped portions 125 may taper from the projection 123. The plurality of shaped portions 125 may facilitate in formation of the interference fit between the first coupling portion 122 and the main body 110 to fixedly couple the hollow member 120 to the main body 110. Specifically, the shaped portions 125 may engage the main body 110 to rotationally and/or axially fix the main body 110 and the hollow member 120 relative to each other.

The second coupling portion 124 may define the first opening 121 (also shown in FIG. 2) as an angular cut-out. Further, the second coupling portion 124 may be rotatably coupled to the cup member 140. In other words, the cup member 140 may be rotatable about the second coupling portion 124. Specifically, the hollow member 120 may further comprise a groove 130. The groove 130 may be disposed on the second coupling portion 124 and adjacent to the projection 123. The groove 130 may be configured to at least partially receive a portion of the cup member 140 therein, such that the cup member 140 may be rotatable relative to the hollow member 120.

The hollow member 120 may further comprise an angular projection 127 disposed at an end 128 of the hollow member 120. The end 128 may be distal to the first coupling portion 122. The angular projection 127 may movably engage with a portion of the cup member 140 to allow the relative rotation between the hollow member 120 and the cup member 140.

As shown in FIG. 3B, the hollow member 120 may further comprise a coupling feature 132. The coupling feature 132 may extend from an inner surface 129 of the hollow member 120. Specifically, as shown in FIG. 3B, the coupling feature 132 may extend from the inner surface 129 and may be proximal to the end 128 of the hollow member 120. The cam arm 160 may be pivotally coupled to the hollow member 120 via the coupling feature 132.

The coupling feature 132 may comprise a narrow aperture 134, a shoulder 135 disposed adjacent to the narrow aperture 134, and a wide aperture 136 disposed adjacent to the shoulder 135 and opposite to the narrow aperture 134. The narrow aperture 134 may have a narrow width 134W, and the wide aperture 136 may have a wide width 136W. In some examples, the wide width 136W may be from about 1.1 times to about 3 times greater than the narrow width 134W. In some examples, the wide width 136W may be about 2 times greater than the narrow width 134W. The narrow aperture 134, the shoulder 135, and the wide aperture 136 may be configured to receive a portion of the cam arm 160 to pivotally couple the cam arm 160 to the coupling feature 132.

Figure 4A:
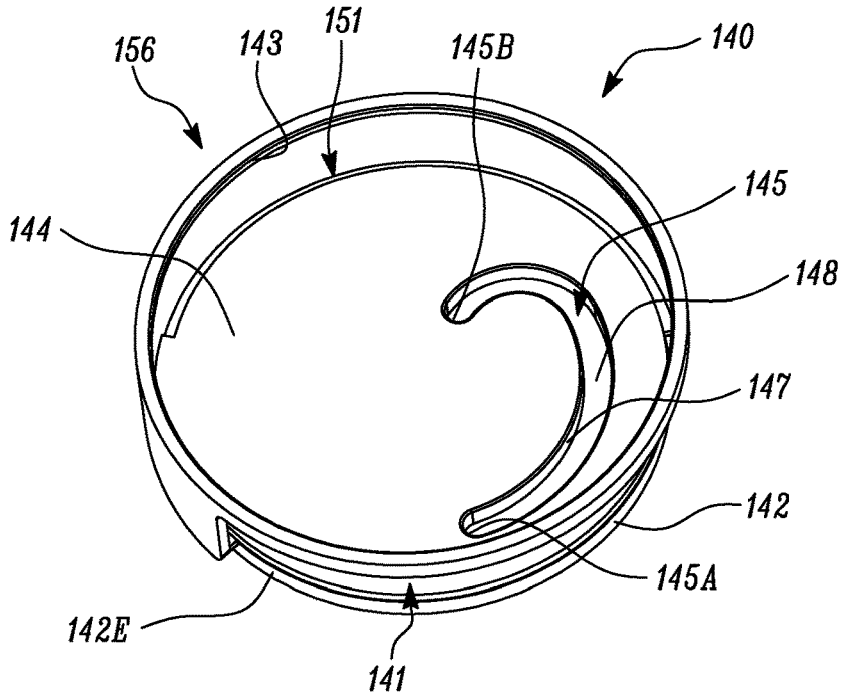
FIG. 4A is a top perspective view of a cup member of the container of FIG. 1.
Figure 4B:
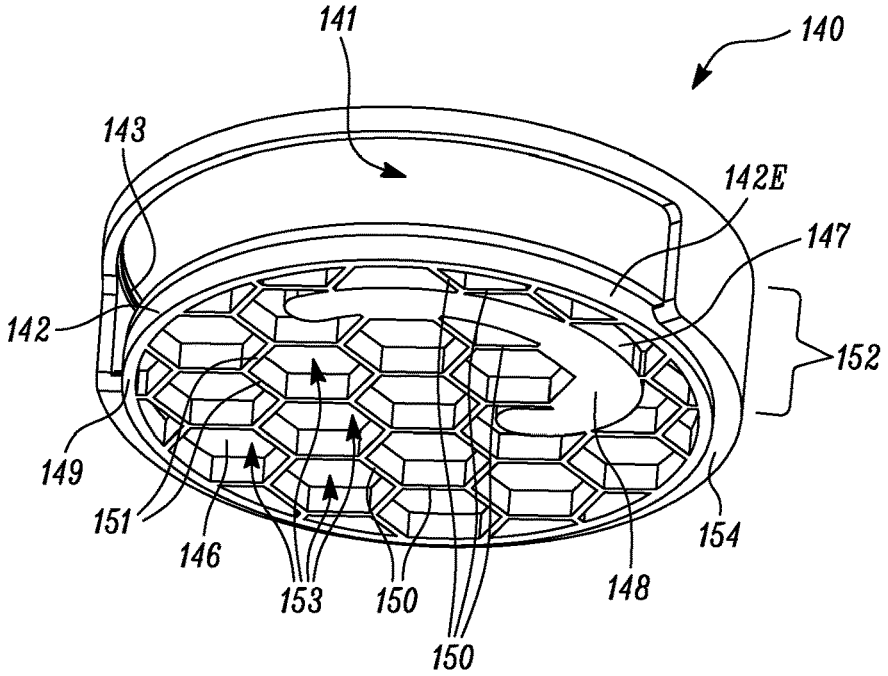
FIG. 4B is a bottom perspective view of the cup member of FIG. 4A.

FIGS. 4A and 4B respectively show a top perspective view and a bottom perspective view of the cup member 140. As discussed above, the cup member 140 comprises the base portion 142. Further, the base portion 142 defines the grooved track 145. The base portion 142 may further comprise a circumferential edge 142E.

The base portion 142 may further comprise a first major surface 144 and a second major surface 146 opposite to the first major surface 144. The grooved track 145 may extend from the first major surface 144. Further, the grooved track 145 may extend from a first groove end 145A to a second groove end 145B.

Referring to FIGS. 3A to 4B, the cup member 140 may comprise a lip 143 disposed at an end 156 distal to the base portion 142. The groove 130 (shown in FIGS. 3A and 3B) may at least partially receive the lip 143 of the cup member 140 therein, such that the lip 143 may be rotatable relative to the groove 130. As a result, the cup member 140 may be rotatable about the hollow member 120.

The base portion 142 may further comprise a continuous side wall 147 and a bottom wall 148. The continuous side wall 147 may extend from the first major surface 144 beyond the second major surface 146. The bottom wall 148 may be connected to the continuous side wall 147 and may be distal to the first major surface 144. The continuous side wall 147 and the bottom wall 148 may define the grooved track 145 therebetween. The continuous side wall 147 may have a continuous curved shape and may define the first and second groove ends 145A, 145B of the grooved track 145.

As shown in FIG. 4B, the base portion 142 may further comprise a rib 149 extending from the second major surface 146. The base portion 142 may further comprise a plurality of interconnected ribs 150 extending from the second major surface 146. The rib 149 may surround the plurality of interconnected ribs 150. The rib 149 may be connected to at least some of the plurality of interconnected ribs 150. At least some of the plurality of interconnected ribs 150 may be connected to the continuous side wall 147. Further, at least some of the plurality of interconnected ribs 150 may define a plurality of hexagonal shapes 153. Alternatively, at least some of the plurality of interconnected ribs 150 may define a plurality of other shapes, including, but not limited to, circular shapes, triangular shapes, rectangular shapes, and any suitable polygonal shapes.

Moreover, as shown in FIG. 4B, the cup member 140 may further comprise a portion 152, which can be an annular portion, and a connecting portion 154. The portion 152 may define the second opening 141 as an angular cut-out. Further, the connecting portion 154 may connect the circumferential edge 142E of the base portion 142 with the portion 152.

The cup member 140 may further define an angular slot 151 movably engaging with the angular projection 127 (shown in FIGS. 3A and 3B) of the hollow member 120 to allow the relative rotation between the hollow member 120 and the cup member 140. In some examples, the angular slot 151 may be defined between the circumferential edge 142E of the base portion 142, the portion 152, and the connecting portion 154.

Figure 5A:
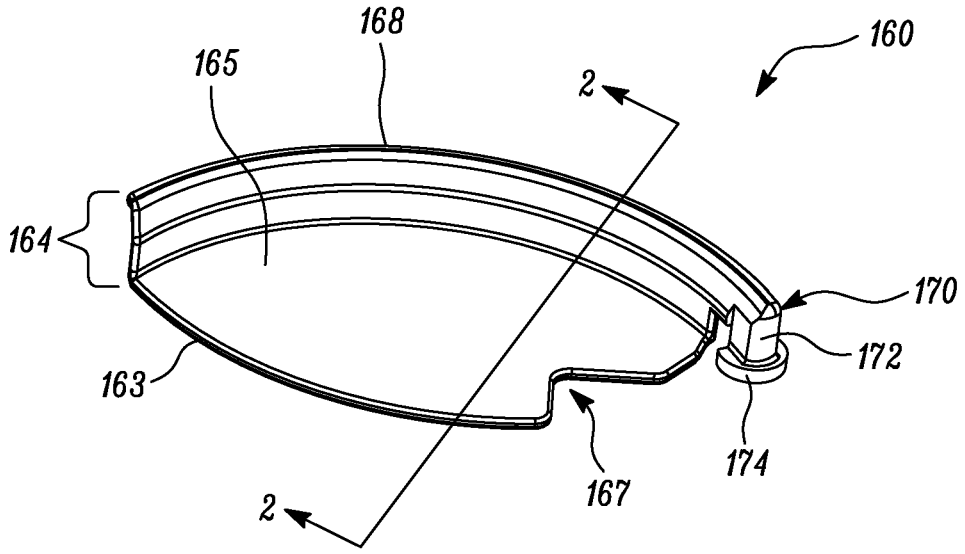
FIG. 5A is a top perspective view of a cam arm of the container of FIG. 1.
Figure 5B:
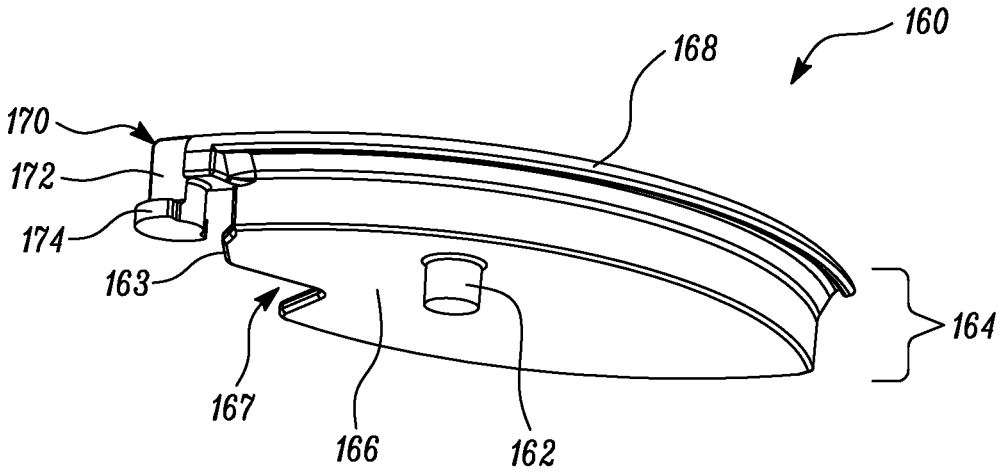
FIG. 5B is a bottom perspective view of the cam arm of FIG. 5A.
Figure 5C:
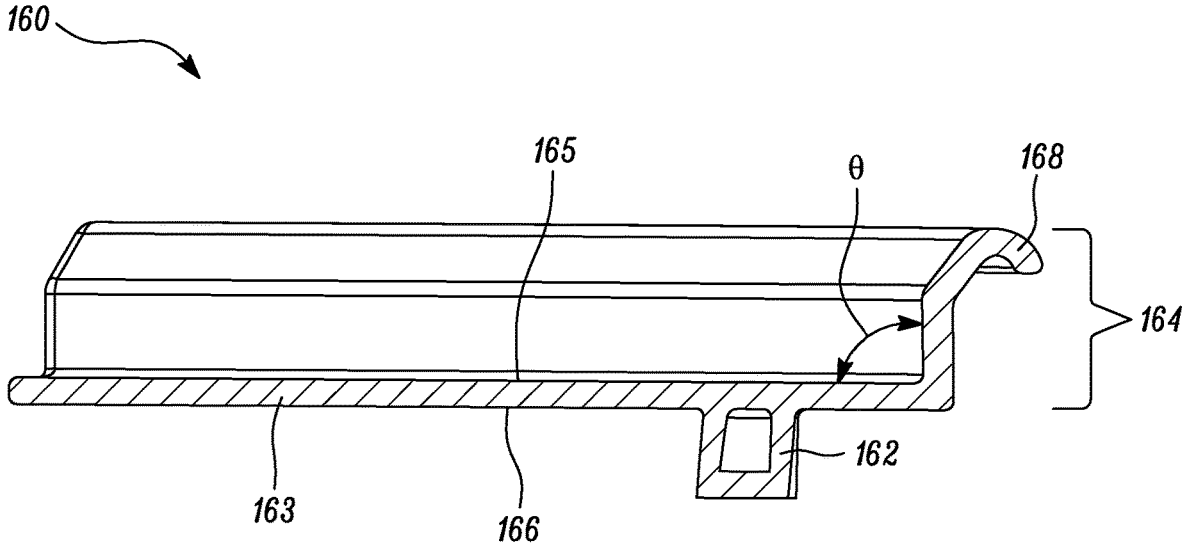
FIG. 5C is a cross-sectional view of the cam arm taken along a line 2-2 of FIG. 5A.

FIGS. 5A and 5B respectively show a top perspective view and a bottom perspective view of the cam arm 160. FIG. 5C shows a cross-sectional view of the cam arm 160 taken along a line 2-2 of FIG. 5A.

Referring to FIGS. 1A, 1B, and 3A to 5C, the cam arm 160 may comprise a receiving portion 163 and an engaging portion 164. The receiving portion 163 may comprise a first major surface 165 and a second major surface 166 opposite to the first major surface 165. The receiving portion 163 may be configured to receive the bottom article 10A (shown in FIG. 1B) thereon. Specifically, as shown in FIG. 5A, the receiving portion 163 may be configured to receive the bottom article 10A on the first major surface 165 thereof. The receiving portion 163 of the cam arm 160 may further define a V-shaped notch 167 spaced apart from the engaging portion 164. In some cases, the V-shaped notch 167 may act as a rotational stop for the cam arm 160. The V-shaped notch 167 may allow the cam arm 160 to freely rotate about the coupling feature 132 (shown in FIG. 3B) without interference. Moreover, the V-shaped notch 167 may further reduce plastic content of the container 100 (in cases where the cam arm 160 is made of plastic).

As discussed above, the cam arm 160 comprises the protrusion 162. The protrusion 162 may extend from the receiving portion 163. Specifically, the protrusion 162 may extend from the second major surface 166 of the receiving portion 163. The protrusion 162 may be designed (e.g., the protrusion 162 may have a suitable width), such that the protrusion 162 may engage the continuous side wall 147 (shown in FIG. 4A) of the grooved track 145 to force it to travel along the grooved track 145 upon the relative rotation between the hollow member 120 and the cup member 140. As shown in FIG. 5B, the protrusion 162 may have a substantially circular cylindrical shape. However, the protrusion 162 may have any suitable shape and dimensions based on cross-sectional shape and dimensions of the grooved track 145.

The engaging portion 164 may extend from the receiving portion 163. Specifically, the engaging portion 164 may extend from the first major surface 165 of the receiving portion 163. Further, the engaging portion 164 may be inclined to the receiving portion 163. As shown in FIG. 5C, the engaging portion 164 may define an angle θ with respect to the first major surface 165 of the receiving portion 163.

In some examples, the angle θ may be from about 60 degrees to about 120 degrees. In some examples, the engaging portion 164 may be substantially perpendicular to the receiving portion 163, i.e., the angle θ may be about 90 degrees.

The engaging portion 164 may be configured to engage with and move the bottom article 10A (shown in FIG. 1B) towards the dispensing opening 106 (shown in FIG. 1A). For example, the engaging portion 164 may be configured to only move the bottom article 10A towards the dispensing opening 106. While the engaging portion 164 moves the bottom article 10A, a subsequent article 10 from the plurality of articles 10 disposed above the bottom article 10A may contact a top of the engaging portion 164. In some use cases, the engaging portion 164 may be configured to move two, three, four, or five of the plurality of articles 10 towards the dispensing opening 106.

Referring to FIGS. 3A to 5C, the cam arm 160 may further comprise a curved portion 168 extending from the engaging portion 164 and distal to the receiving portion 163. The curved portion 168 may engage the inner surface 129 (shown in FIG. 3B) of the hollow member 120.

The cam arm 160 may further comprise a coupling element 170. The coupling element 170 may be received at least partially through the coupling feature 132 (shown in FIG. 3B) to pivotally couple the cam arm 160 to the coupling feature 132. In other words, the cam arm 160 can pivot about the coupling feature 132 when the coupling element 170 is received at least partially through the coupling feature 132. As shown in FIGS. 5A and 5B, the coupling element 170 of the cam arm 160 may comprise a narrow portion 172 and a wide portion 174. The coupling element 170 will be further described below with reference to FIG. 6.

Figure 6:
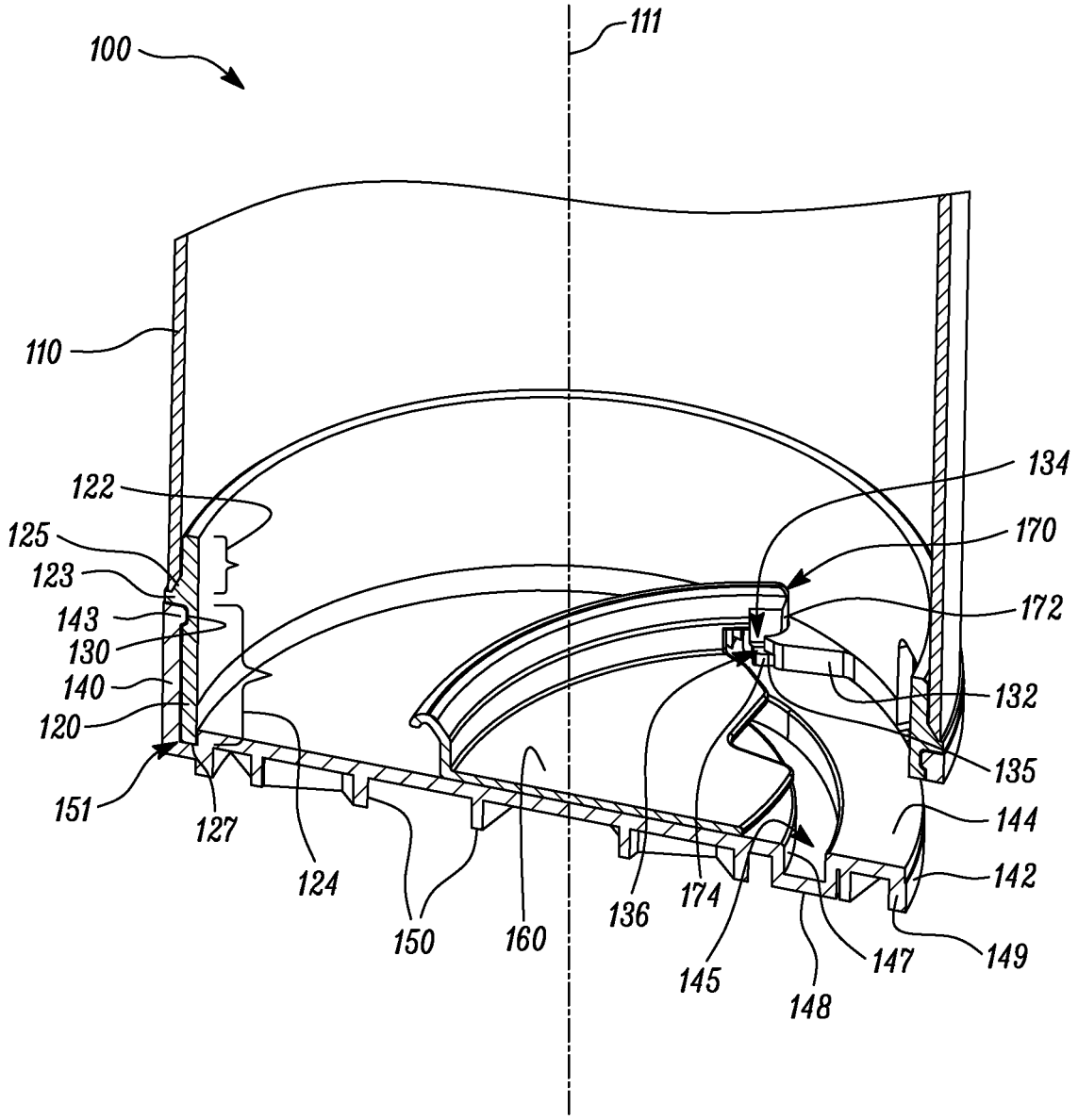
FIG. 6 is a cross-sectional perspective view of a portion of the container taken along a line 1-1 of FIG. 1.

FIG. 6 shows a cross-sectional perspective view of a portion of the container 100 taken along a line 1-1 of FIG. 1.

As discussed above, the coupling element 170 may be received at least partially through the coupling feature 132 of the hollow member 120 to pivotally couple the cam arm 160 to the coupling feature 132. Specifically, as shown in FIG. 6, the narrow portion 172 may be pivotally received at least partially within the narrow aperture 134. The wide portion 174 may be pivotally received at least partially within the wide aperture 136. Further, the wide portion 174 may engage with the shoulder 135. In other words, the cam arm 160 may be pivotally coupled to the coupling feature 132 via pivotal coupling of the narrow portion 172 to the narrow aperture 134, and the wide portion 174 to the wide aperture 136. Further, the cam arm 160 may be at least partially disposed on the first major surface 144 and may move along the first major surface 144. The engagement of the wide portion 174 of the coupling element 170 with the shoulder 135 of the coupling feature 132 may ensure that the cam arm 160 is disposed on and moves along the first major surface 144 of the base portion 142.

Further, the projection 123 may engage with each of the main body 110 and the cup member 140, such that the projection 123 may be disposed between the main body 110 and the cup member 140 along the longitudinal axis 111.

The first coupling portion 122 may be fixedly coupled to the main body 110. Specifically, the shaped portions 125 may engage the main body 110 to rotationally and/or axially fix the main body 110 and the hollow member 120 relative to each other.

The second coupling portion 124 may be rotatably coupled to the cup member 140. Specifically, the groove 130 may at least partially receive the lip 143 of the cup member 140 therein, such that the lip 143 may be rotatable relative to the groove 130. The lip 143 of the cup member 140 may engage the groove 130 of the hollow member 120, such that the cup member 140 may be rotatable relative to the hollow member 120. Furthermore, the angular slot 151 may movably engage with the angular projection 127 of the hollow member 120 to allow the relative rotation between the hollow member 120 and the cup member 140.

FIGS. 7A-9B show the container 100 in different configurations of the hollow member 120 and the cup member 140. Some elements of the container 100 including the main body 110 are not shown in FIGS. 7A-9B for illustrative purposes. Further, some of the plurality of articles 10 are shown by dashed lines in FIGS. 7A, 7B, and 8A-9B. The plurality of articles 10 are not shown in FIG. 7C.

Figure 7A:
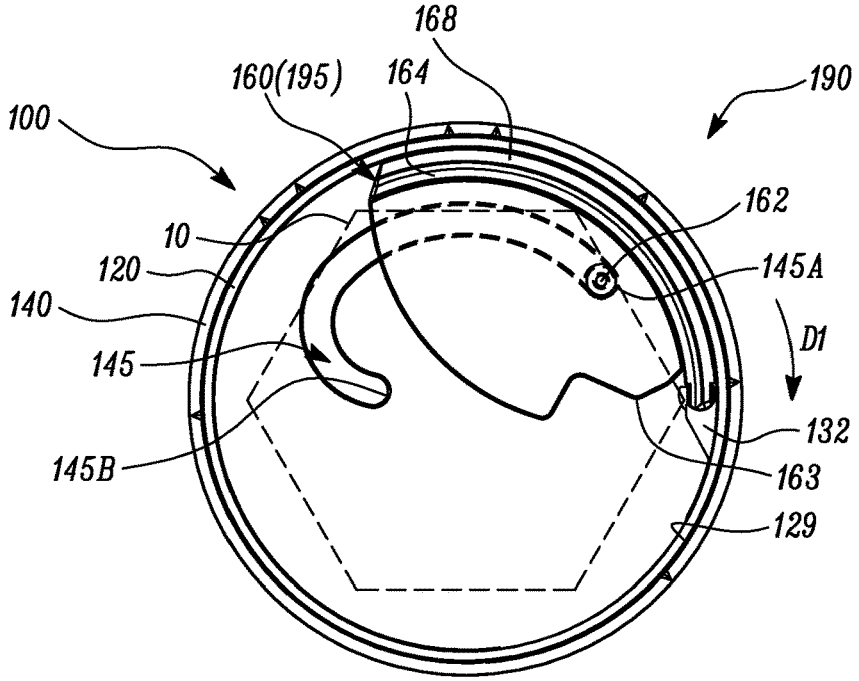
FIG. 7A is a top view of the container of FIG. 1 in a closed configuration with some elements of the container not shown.
Figure 7B:
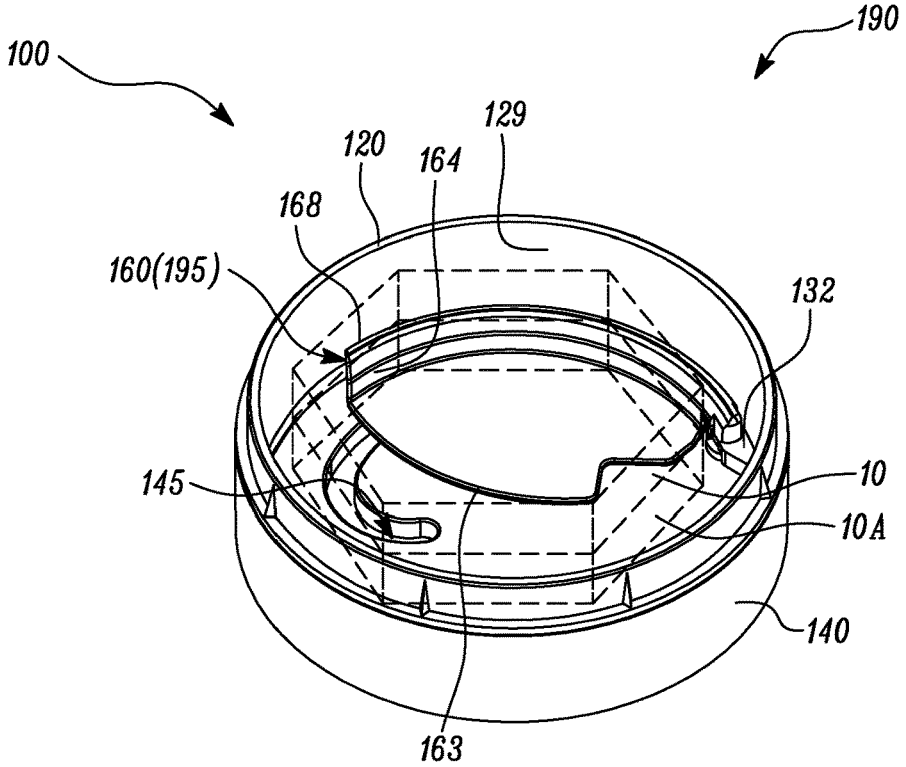
FIG. 7B is a top perspective view of the container of FIG. 7A.
Figure 7C:
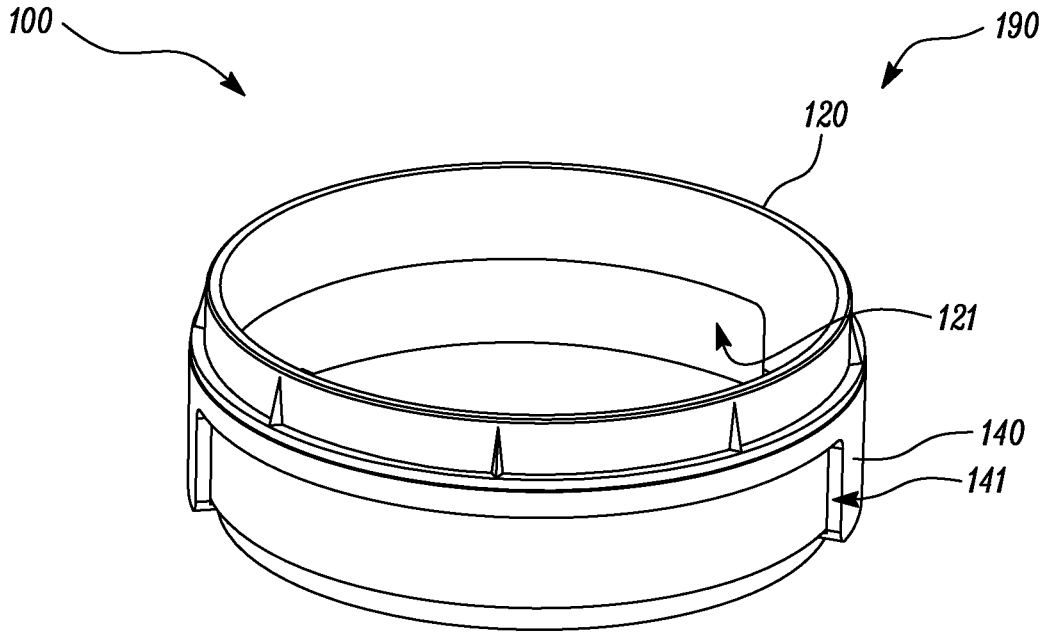
FIG. 7C is a front perspective view of the container of FIG. 7A.

Specifically, FIGS. 7A, 7B, and 7C respectively show a top view, a top perspective view, and a front perspective view of the container 100 in a closed configuration 190 of the hollow member 120 and the cup member 140. Further, FIGS. 8A and 8B respectively show a top view and a top perspective view of the container 100 in an intermediate configuration 191 of the hollow member 120 and the cup member 140. Moreover, FIGS. 9A and 9B respectively show a top view and a top perspective view of the container 100 in an open configuration 192 of the hollow member 120 and the cup member 140. The grooved track 145 of the cup member 140 and the protrusion 162 of the cam arm 160 are shown by dashed lines in FIGS. 7A, 8A, and 9A for illustrative purposes.

For descriptive purposes, the cup member 140 may be rotated relative to the hollow member 120 in FIGS. 7A-9B. Accordingly, rotational directions described hereinafter correspond to rotation of the cup member 140 relative to the hollow member 120. Alternatively, the hollow member 120 may be rotated relative to the cup member 140. The hollow member 120 may be rotated relative to the cup member 140 by rotating the main body 110 (shown in FIG. 1) relative to the cup member 140. The cup member 140 and the hollow member 120 may also be rotated opposite to each other. It may be noted that the relative rotation between the hollow member 120 and the cup member 140 that achieves the open configuration 192 is opposite to the relative rotation between the hollow member 120 and the cup member 140 that achieves the closed configuration 190.

The hollow member 120 and the cup member 140 are rotatable relative to each other between the open configuration 192 (shown in FIGS. 9A and 9B) and the closed configuration 190 (shown in FIGS. 7A to 7C). Accordingly, the cam arm 160 moves between an engaged position 195 (shown in FIG. 7A) corresponding to the closed configuration 190 and a dispensing position 197 (shown in FIGS. 9A and 9B) corresponding to the open configuration 192 due to the relative rotation between the hollow member 120 and the cup member 140.

Referring to FIGS. 7A to 7C, in the closed configuration 190, the first and second openings 121, 141 are misaligned from each other (shown in FIG. 7C) to close the dispensing opening 106 (shown in FIG. 1). Further, in the closed configuration 190, the cam arm 160 may be in the engaged position 195.

Specifically, in the closed configuration 190, the first and second openings 121, 141 may be completely misaligned from each other with zero degree of overlap. For example, in the closed configuration 190, the first and second openings 121, 141 may be angularly offset from each other by about 180 degrees relative to the longitudinal axis 111 (shown in FIG. 1).

As shown in FIG. 7B, in the engaged position 195, the cam arm 160 may be configured to engage the bottom article 10A from the plurality of articles 10. Further, in the engaged position 195, the curved portion 168 may engage the inner surface 129 of the hollow member 120. Moreover, in the engaged position 195, the protrusion 162 of the cam arm 160 may engage with the first groove end 145A (shown in FIG. 7A) of the grooved track 145. The bottom article 10A is received on the receiving portion 163 of the cam arm 160.

The cup member 140 may be rotated relative to the hollow member 120 in a first direction D1 (also shown in FIG. 1) about the longitudinal axis 111. Upon rotation of the cup member 140 relative to the hollow member 120 in the first direction D1, the hollow member 120 and the cup member 140 may achieve the intermediate configuration 191 (shown in FIGS. 8A and 8B).

Figure 8A:
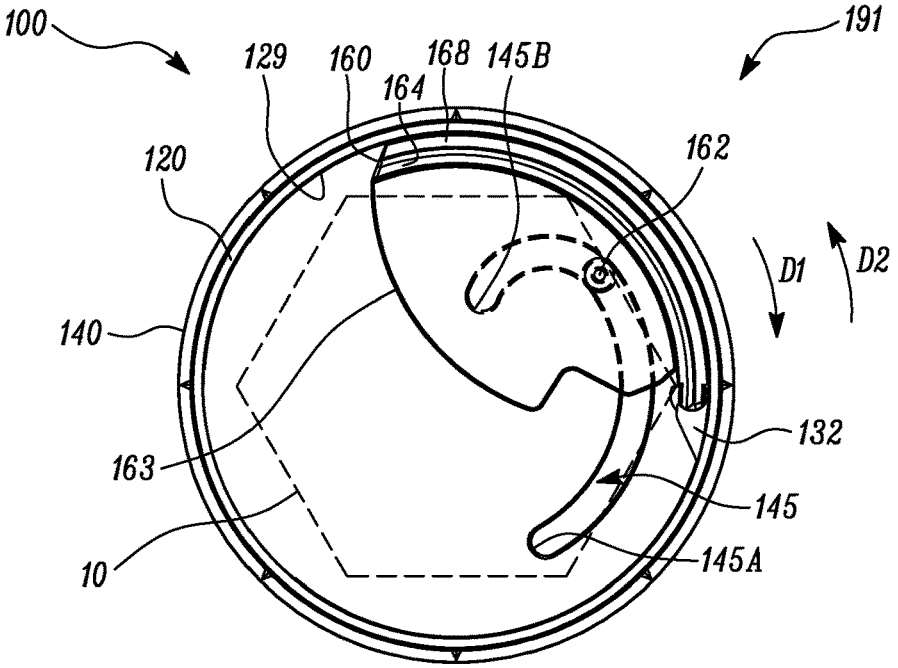
FIG. 8A is a top view of the container of FIG. 1 in an intermediate configuration with some elements of the container not shown.
Figure 8B:
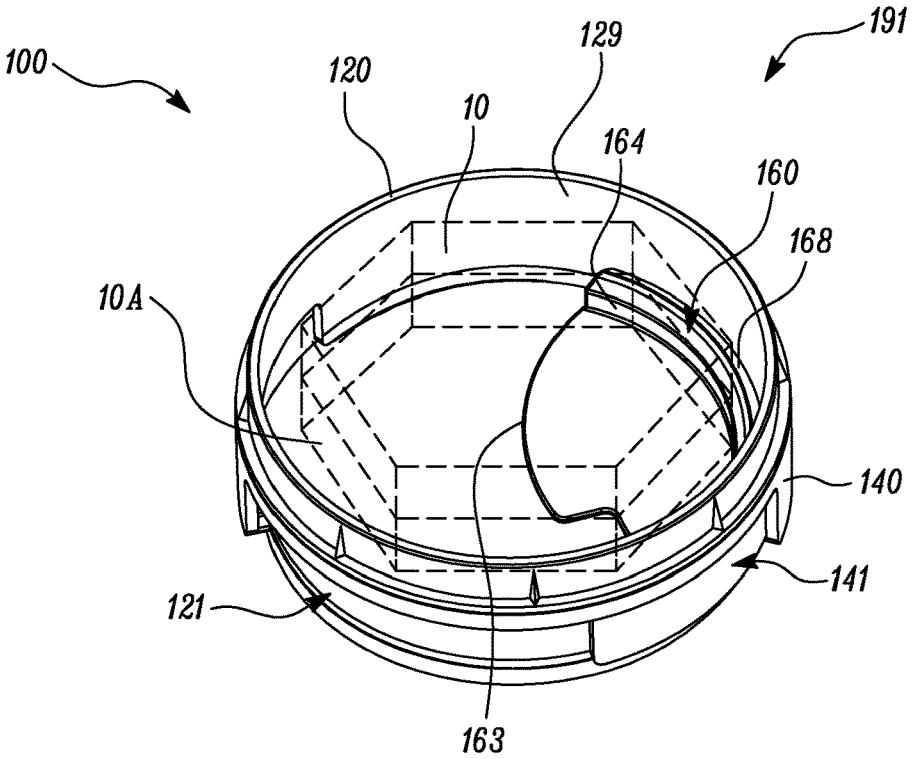
FIG. 8B is a top perspective view of the container of FIG. 8A.

Referring to FIGS. 8A and 8B, in the intermediate configuration 191, the first and second openings 121, 141 are at least partially aligned. As shown in FIGS. 8A and 8B, in some cases, the curved portion 168 of the cam arm 160 may engage the inner surface 129 of the hollow member 120 in the intermediate configuration 191. In some other cases, the curved portion 168 of the cam arm 160 may not engage the inner surface 129 of the hollow member 120 in the intermediate configuration 191. In the intermediate configuration 191, the protrusion 162 of the cam arm 160 may engage the grooved track 145 between the first groove end 145A and the second groove end 145B of the grooved track 145.

The cup member 140 may be rotated relative to the hollow member 120 in a second direction D2 (also shown in FIG. 1) opposite to the first direction D1 from the intermediate configuration 191, such that the hollow member 120 and the cup member 140 achieve the closed configuration 190 as shown in FIGS. 7A-7C and described above.

The cup member 140 may be further rotated relative to the hollow member 120 in the first direction D1 from the intermediate configuration 191. Upon further rotation of the cup member 140 relative to the hollow member 120 in the first direction D1, the hollow member 120 and the cup member 140 may achieve the open configuration 192 (shown in FIGS. 9A and 9B).

Though the bottom article 10A and the article 10 on top of the bottom article 10A are shown substantially aligned in FIGS. 8A and 8B, the bottom article 10A may extend outwardly relative to the article 10 on top based on the intermediate configuration 191.

Figure 9A:
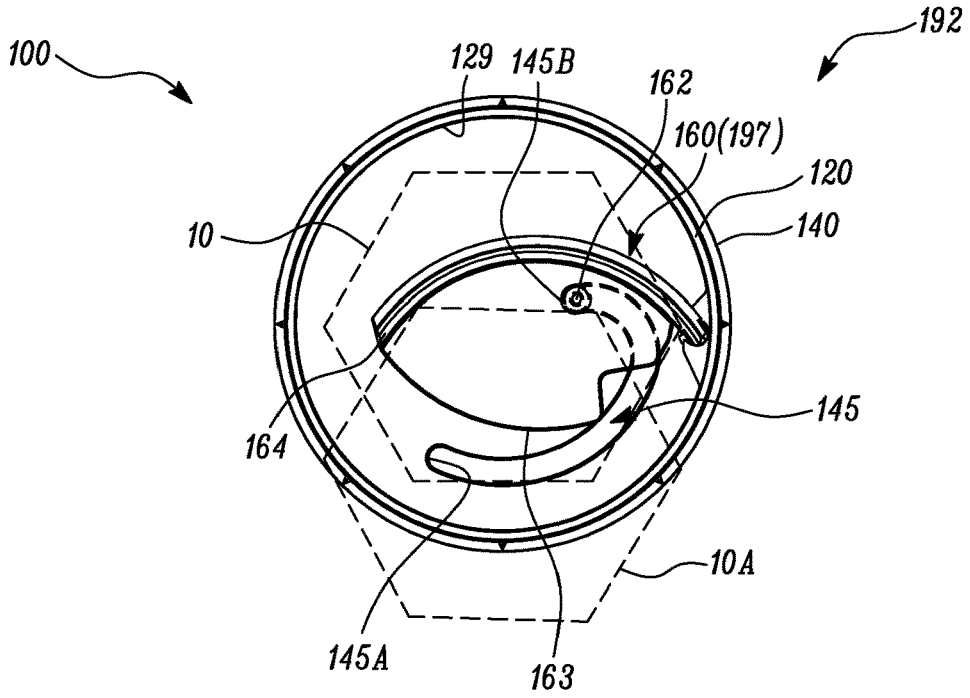
FIG. 9A is a top view of the container of FIG. 1 in an open configuration with some elements of the container not shown.
Figure 9B:
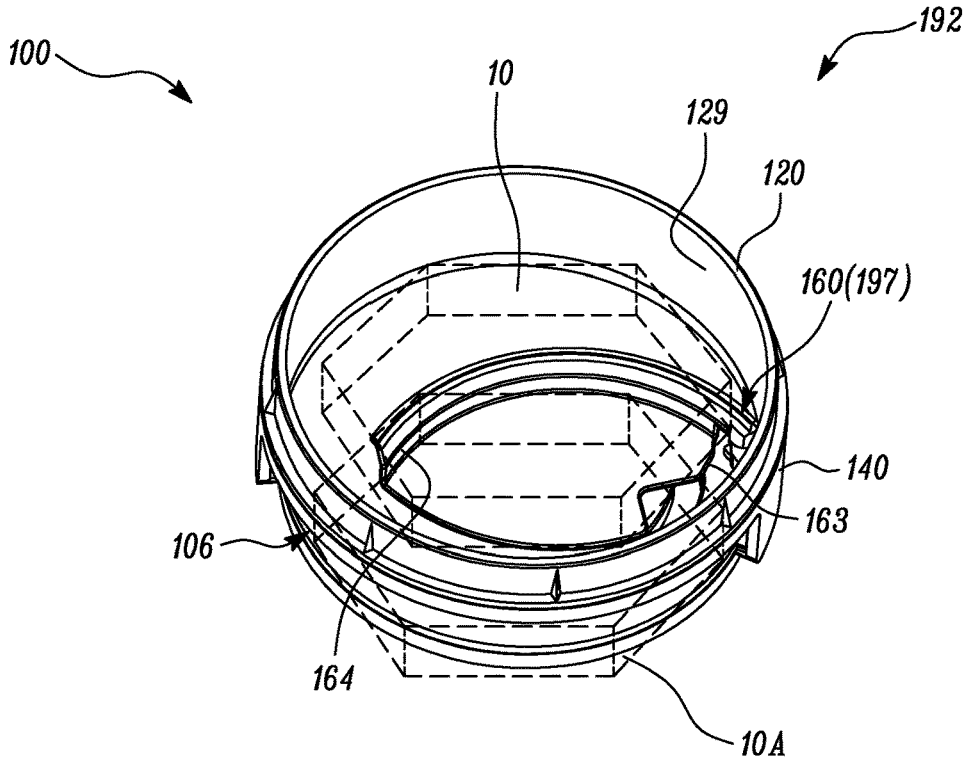
FIG. 9B is a top perspective view of the container of FIG. 9A.

Referring to FIGS. 9A and 9B, in the open configuration 192, the first and second openings 121, 141 are at least partially aligned with each other to define the dispensing opening 106. In the open configuration 192, a degree of alignment between the first and second openings 121, 141 may be at least 70%, at least 80%, at least 90%, or at least 95%. In some cases, the first and second openings 121, 141 may be fully aligned (i.e., 100% alignment) with each other in the open configuration 192. Further, in the open configuration 192, the cam arm 160 may be in the dispensing position 197.

The cam arm 160 may be further configured to move the bottom article 10A due to the relative rotation between the hollow member 120 and the cup member 140, such that, in the dispensing position 197 of the cam arm 160, the bottom article 10A at least partially extends through the dispensing opening 106 and may be removable from the container 100. That is, the cam arm 160 moves the bottom article 10 at least partially through the dispensing opening 106, such that the bottom article 10 can be removed from the container 100. Specifically, in the dispensing position 197 of the cam arm 160, the bottom article 10A may at least partially extend through the dispensing opening 106 to facilitate manual removal of the bottom article 10A from the container 100.

Therefore, due to the movement of the cam arm 160 from the engaged position 195 to the dispensing position 197, the bottom article 10A may extend outwardly relative to the article 10 on top in the dispensing position 197 of the cam arm 160. The engaging portion 164 of the cam arm 160 may engage the bottom article 10A and push the bottom article 10A towards the dispensing opening 106 during the movement of the cam arm 160 from the engaged position 195 to the dispensing position 197. Further, in the dispensing position 197, the protrusion 162 of the cam arm 160 may engage with the second groove end 145B of the grooved track 145.

A relative rotation between the hollow member 120 and the cup member 140 from the closed configuration 190 to the open configuration 193 in the first direction D1 about the longitudinal axis 111 may cause the cam arm 160 to move from the engaged position 195 to the dispensing position 197. After removal of the bottom article 10A from the container 100, a relative rotation between the hollow member 120 and the cup member 140 from the open configuration 192 to the closed configuration 190 in the second direction D2 opposite to the first direction D1 may cause the cam arm 160 to move from the dispensing position 197 to the engaged position 195 and engage a successive bottom article 10 (i.e., the article 10 that is on top of the bottom article 10A) from the plurality of articles 10. The successive bottom article 10 may therefore become the bottom article 10A after removal of the bottom article 10A from the container 100. The successive bottom article 10 may be received on the receiving portion 163 of the cam arm 160 and may be engaged with the engaging portion 164 of the cam arm 160. In this manner, the container 100 may allow sequential dispensing of successive bottom articles 10A from the stack of the plurality of articles 10. Thus, the container 100 may provide an easy to use dispensing mechanism to dispense the bottom article 10A from the container 100.

Figure 10A:
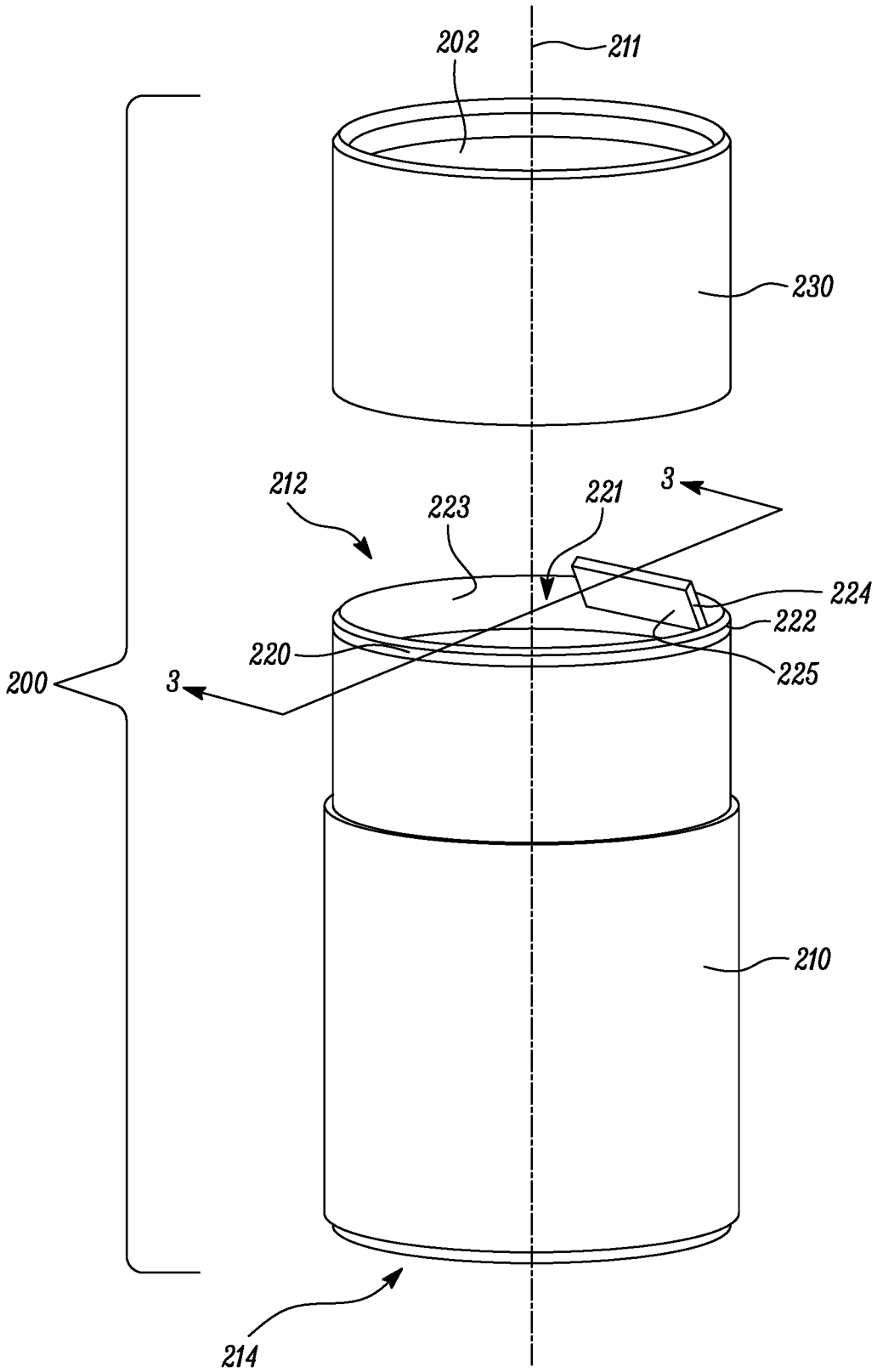
FIG. 10A is a front perspective view of a container for a plurality of articles according to a second aspect of the invention.
Figure 10B:
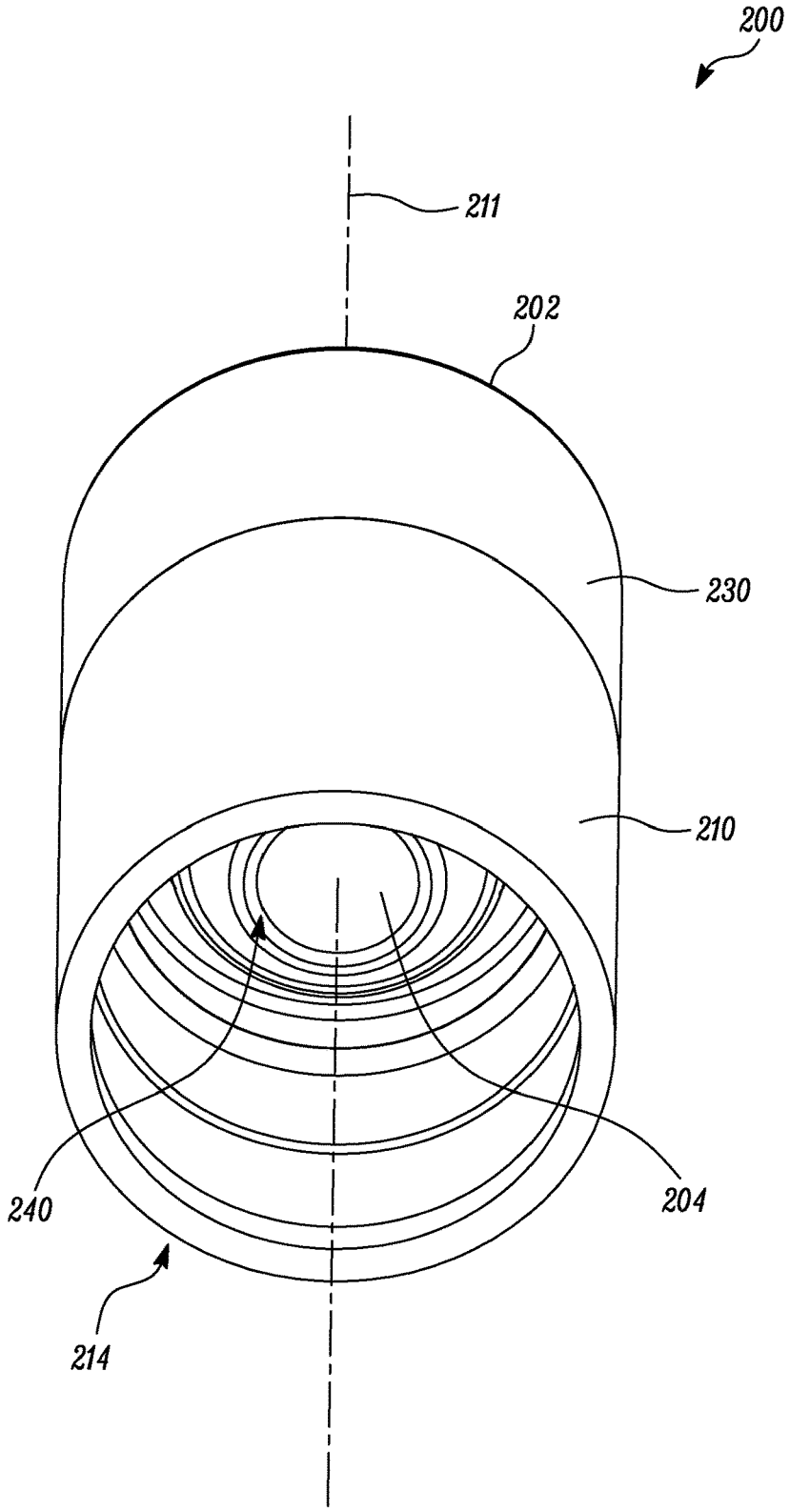
FIG. 10B is a bottom perspective view of the container of FIG. 10A.

FIGS. 10A and 10B respectively show a front perspective view and a bottom perspective view of a container 200 for the plurality of arranged articles 10 (shown in FIGS. 12A and 12B) according to a second aspect the invention. Further, FIG. 11 shows an exploded perspective view of the container 200.

Figure 11:
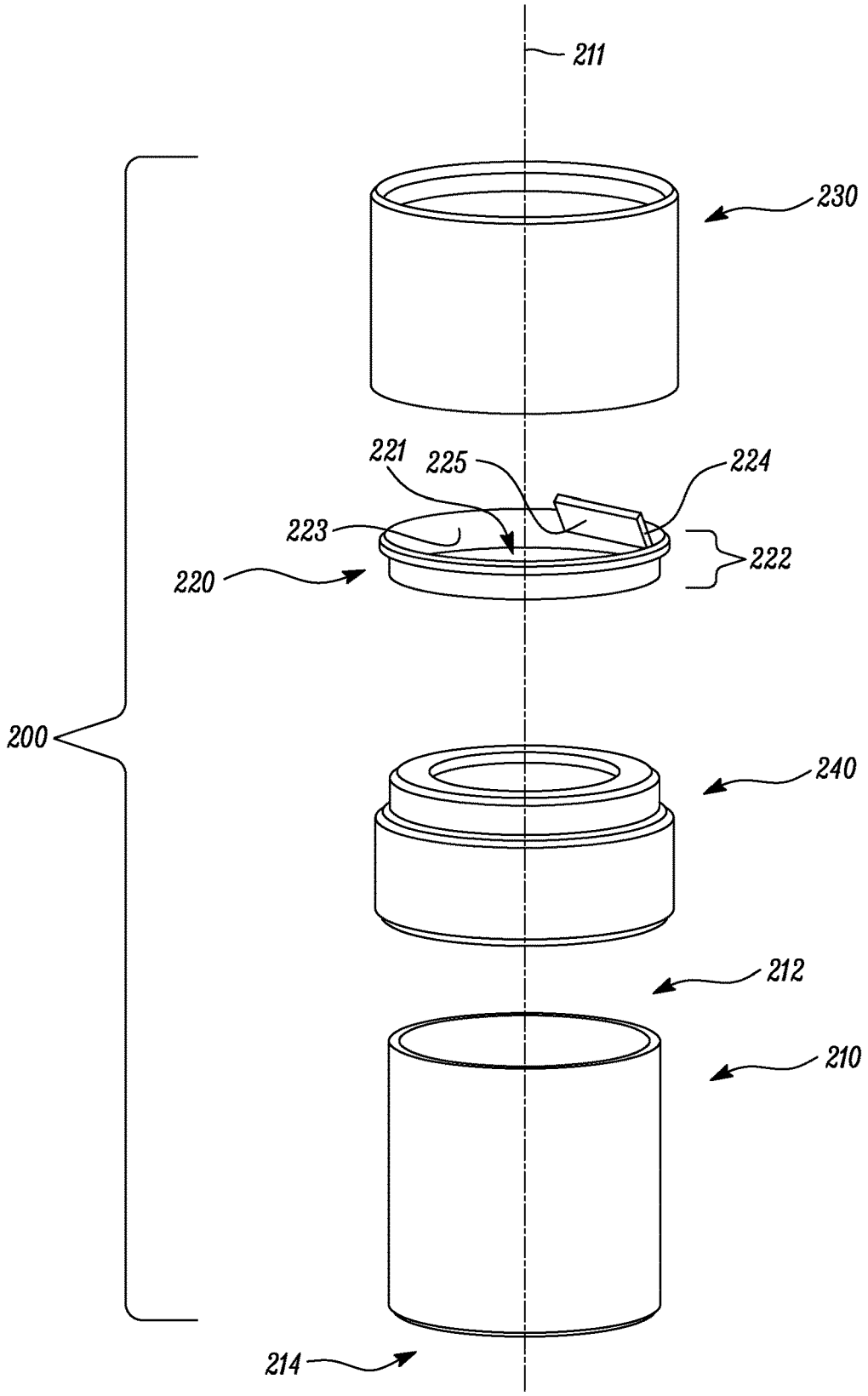
FIG. 11 is an exploded perspective view of the container of FIG. 10A.

Referring to FIGS. 10A, 10B, and 11, the container 200 comprises a main body 210 having a hollow tubular shape. The hollow tubular shape may allow the main body 210 to accommodate at least some of the plurality of articles 10 (shown in FIGS. 12A and 12B) therein.

The main body 210 comprises a first open end 212 and a second open end 214 opposing the first open end 212. In other words, the second open end 214 may be opposite to the first open end 212. The main body 210 extends along a longitudinal axis 211. Specifically, the main body 210 may extend along the longitudinal axis 211 between the first open end 212 and the second open end 214.

The container 200 further comprises a top member 220. The top member 220 may be at least partially received in the main body 210. In other words, at least a portion of the top member 220 may be received within the main body 210. The top member 220 may be fixedly coupled to the main body 210 at the first open end 212. Further, the top member 220 defines a top opening 221 therethrough in communication with the first open end 212.

The top opening 221 is configured to be selectively open or closed. For example, the container 200 may further comprise a cap 230 to selectively open or close the top opening 221. As shown in FIG. 10A, the cap 230 may be detached or removed from the main body 210 to selectively open the first open end 212 and the top opening 221 of the top member 220. Further, as shown in FIG. 10B, the cap 230 may be removably coupled to the main body 210 and configured to selectively close the first open end 212 and the top opening 221 of the top member 220. The cap 230 may define a closed top end 202 of the container 200.

The top member 220 may comprise a portion 222, which can be an annular portion, fixedly coupled to the first open end 212 of the main body 210. The portion 222 may define the top opening 221 aligned with the first open end 212. The top member 220 may further comprise an engaging portion 224 coupled to the portion 222. In some examples, the engaging portion 224 may be integral with the portion 222. The engaging portion 224 may extend at least partially into the top opening 221. Specifically, the engaging portion 224 may extend from an inner surface 223 of the portion 222 and extend at least partially into the top opening 221.

The engaging portion 224 may comprise an inclined planar surface 225 inclined obliquely to the longitudinal axis 211. The inclined planar surface 225 may be configured to engage with the top article 10B (shown in FIGS. 12A and 12B) and separate the top article 10B from a rest of the plurality of articles 10. The inclined planar surface 225 may subtend an angle $\alpha$ (shown in FIGS. 12A and 12B) relative to the longitudinal axis 211. In some examples, the angle $\alpha$ may be from about 10 degrees to about 60 degrees.

The container 200 further comprises a pusher 240 slidably received within the main body 210. The pusher 240 may slidably engage an internal surface of the main body 210. The pusher 240 may be movable along the longitudinal axis 211. The pusher 240 defines a movable closed bottom end 204 (shown in FIG. 10B) of the container 200. The main body 210 may comprise any suitable feature to retain the pusher 240 therein. For example, the main body 210 may comprise one or more stopping features 216 (shown in FIGS. 12A and 12B) extending into the main body 210 and proximal to the second open end 214. The one or more stopping features 216 may comprise a continuous wall, for example an annular wall, extending into the main body 210. The pusher 240 may engage the one or more stopping features 216, such that the pusher 240 may be retained within the main body 210.

The main body 210 may be configured to provide compression resistance and moisture barrier to the container 200. In other words, the main body 210 may protect the plurality of articles 10 (shown in FIGS. 12A and 12B) from compression (e.g., by external forces incurred by the container 200 during shipping or usage thereof), and may reduce or prevent contact between the plurality of articles 10 stored within the container 200 and moisture present in an external environment (e.g., a shower) where the container 200 is disposed. Therefore, the container 200 may reduce or prevent external moisture from being absorbed by the plurality of articles 10 stored within the container 200.

The main body 210 may be primarily made of a paper material and may be substantially free of plastic. Specifically, the main body 210 may comprise from 0% to 5% by weight of plastic. The main body 210 made of the paper material may comprise barrier materials to protect the main body 210, for example, against moisture, grease/oils, oxygen, etc. Further, the cap 230 may be made of a formed pulp with the barrier materials applied to the formed pulp. Moreover, the top member 220 may be made of a plastic. Alternatively, the top member 220 may be made of injection molded pulp, or a combination of injection molded paper and plastic. Similarly, the pusher 240 may be made of a plastic, injection molded pulp, or a combination of injection molded paper and plastic. Further, the container 200 may be substantially made of paper and/or aluminum. In some examples, the container 200 may comprise less plastic per dose than current liquid shampoo bottles. In some examples, the container 200 can contain less than 60% plastic, less than 55% plastic, or less than 50% plastic.

Figure 12A:
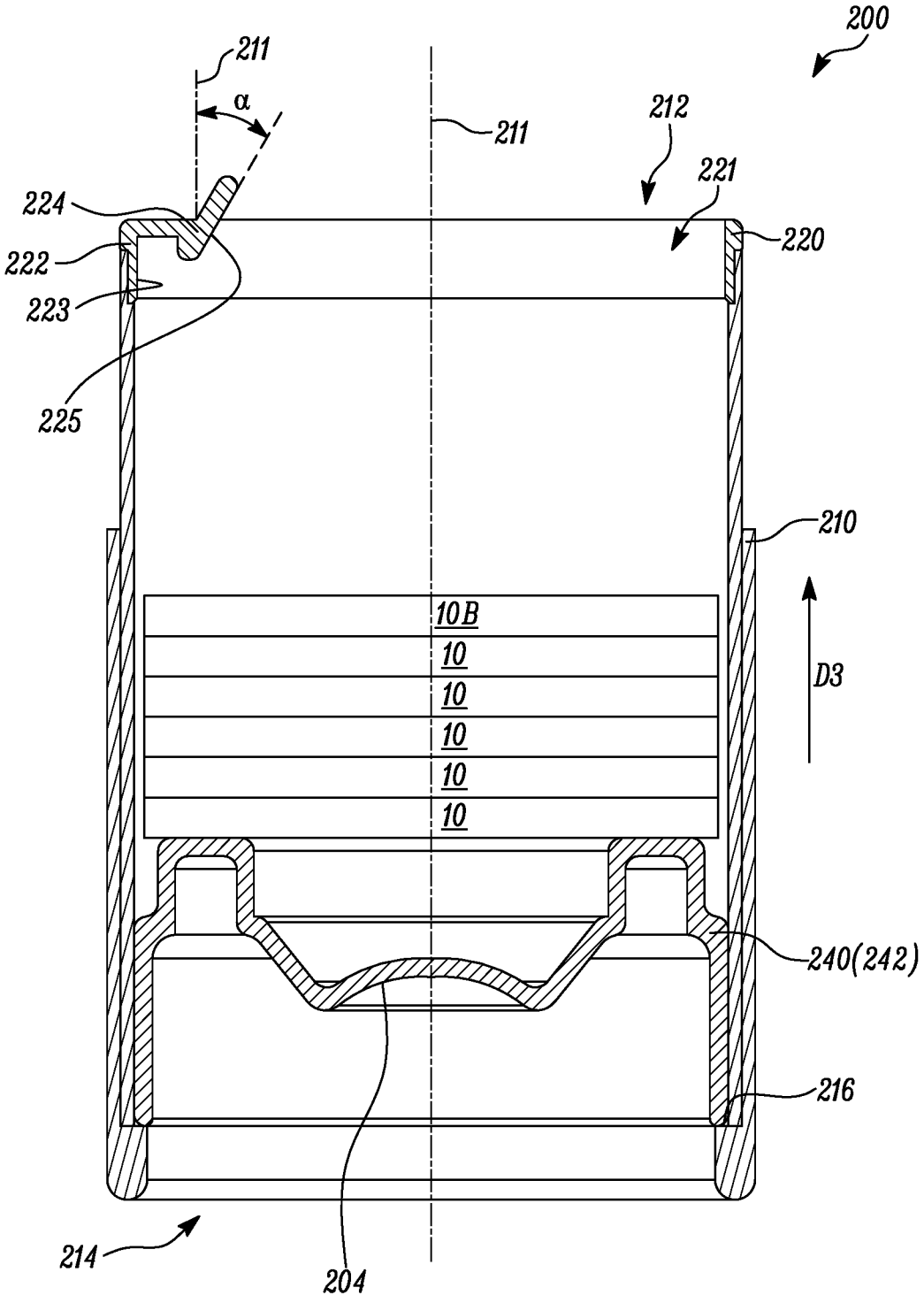
FIGS. 12A and 12B are cross-sectional views of the container in different configurations taken along a line 3-3 of FIG. 10A.
Figure 12B:
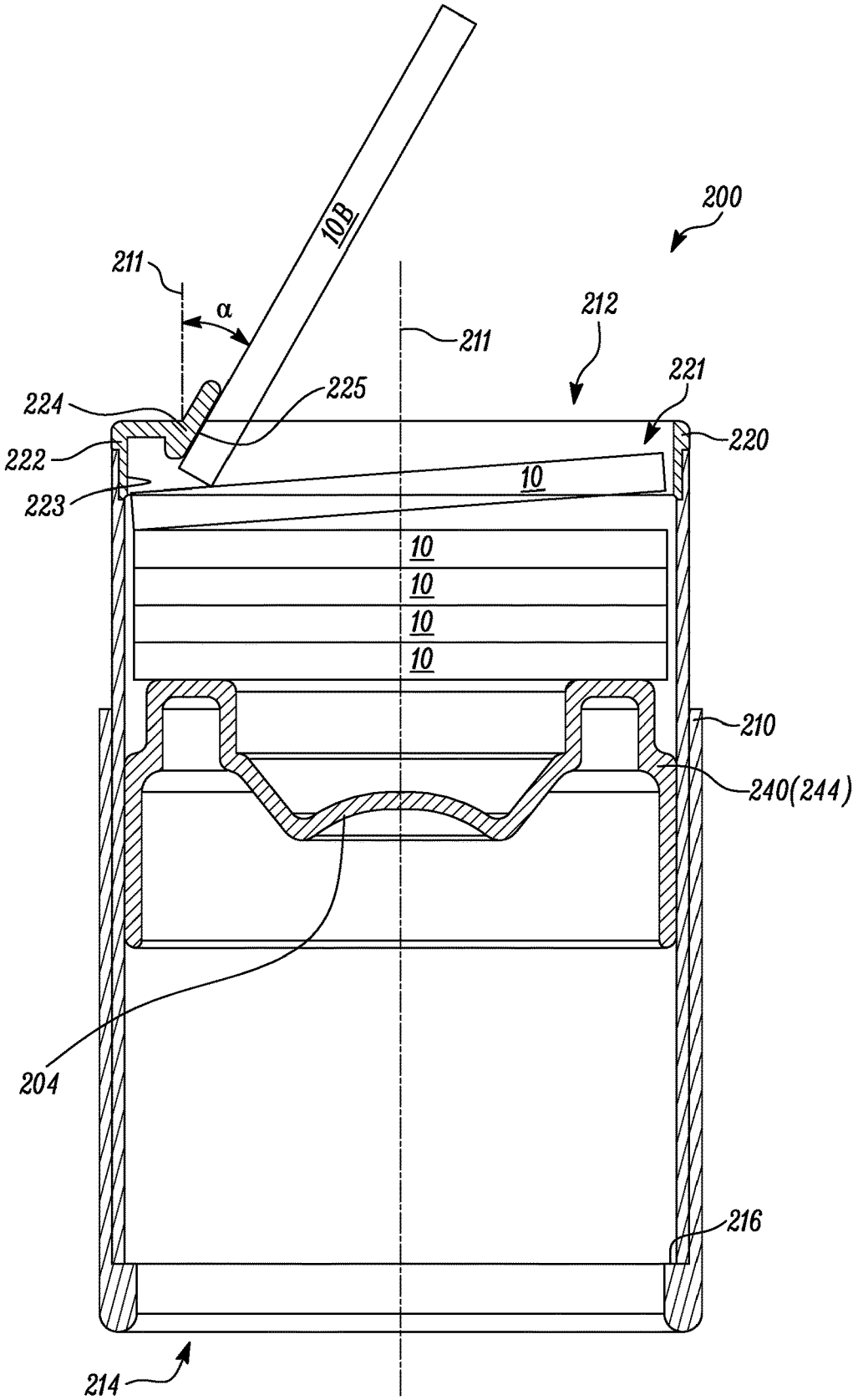

FIGS. 12A and 12B show cross-sectional views of the container 200 taken along a line 3-3 of FIG. 10A. The cap 230 (shown in FIG. 11) may be removed from the main body 210 and is not shown FIGS. 12A and 12B. The pusher 240 is in a first position 242 in FIG. 12A, and the pusher 240 is in a second position 244 in FIG. 12B.

As shown in FIG. 12A, the plurality of articles 10 may be received within the main body 210 and adjacent to the pusher 240. In this example the plurality of articles 10 are stacked on top of the pusher 240. In the first position 242 of the pusher 240, the plurality of articles 10 may be disposed between the top opening 221 of the top member 220 and the pusher 240 along the longitudinal axis 211. Further, the plurality of articles 10 comprises the top article 10B.

As discussed above, the pusher 240 is in the first position 242 in FIG. 12A. The first position 242 may correspond to a storage configuration of the container 200. In the storage configuration of the container 200, the pusher 240 may rest proximal to the second open end 214 of the main body 210. For example, the pusher 240 may engage with and rest on the one or more stopping features 216 of the main body 210 in the first position 242.

The pusher 240 may be moved to the second position 244 (shown in FIG. 12B) upon application of a force on the movable closed bottom end 204 of the container 200 defined by the pusher 240 in a direction D3. The direction D3 may be from the second open end 214 towards the first open end 212 of the main body 210 and the top opening 221 of the top member 220 along the longitudinal axis 211. In some examples, the pusher 240 may be biased towards the first position 242 of the pusher 240. A biasing member, such as a spring, may bias the pusher 240 towards the first position 242.

As shown in FIG. 12B, upon application of the force on the pusher 240 in the direction D3, the pusher 240 may move to the second position 244. The second position 244 may be a position in which at least one of the plurality of articles 10 (e.g., the top article 10B) may be removable from the top opening 221. Specifically, the pusher 240 may be movable along the longitudinal axis 211 towards the top opening 221, such that the top article 10B from the plurality of articles 10 may be removable from the top opening 221. The top article 10B may engage with the inclined planar surface 225 of the engaging portion 224 when the pusher 240 may be in the second position 244. The inclined planar surface 225 may engage with the top article 10B and separate the top article 10B from the rest of the plurality of articles 10. The top article 10B may incline outwardly from the top opening 221 upon engagement with the inclined planar surface 225, and may be removed from the container 200. A successive article 10 from the stack may be similarly removed. In this manner, the container 200 may allow sequential dispensing of successive top articles 10B from the stack of the plurality of articles 10. Thus, the container 200 may provide an easy to use dispensing mechanism to dispense the top article 10B from the container 200.

Figure 13A:
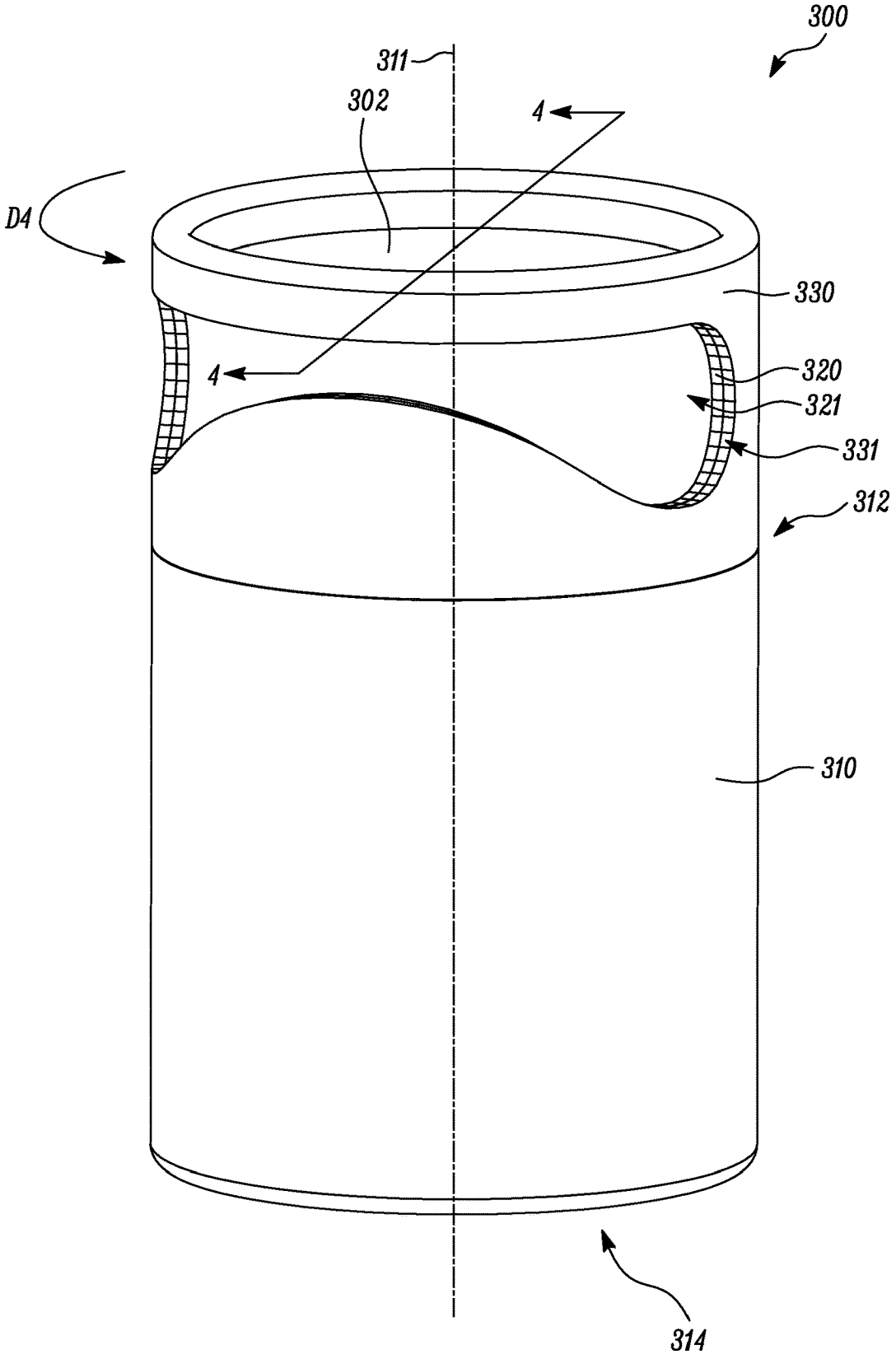
FIG. 13A is a front perspective view of a container for a plurality of articles in an open configuration according to a third aspect of the invention.
Figure 13B:
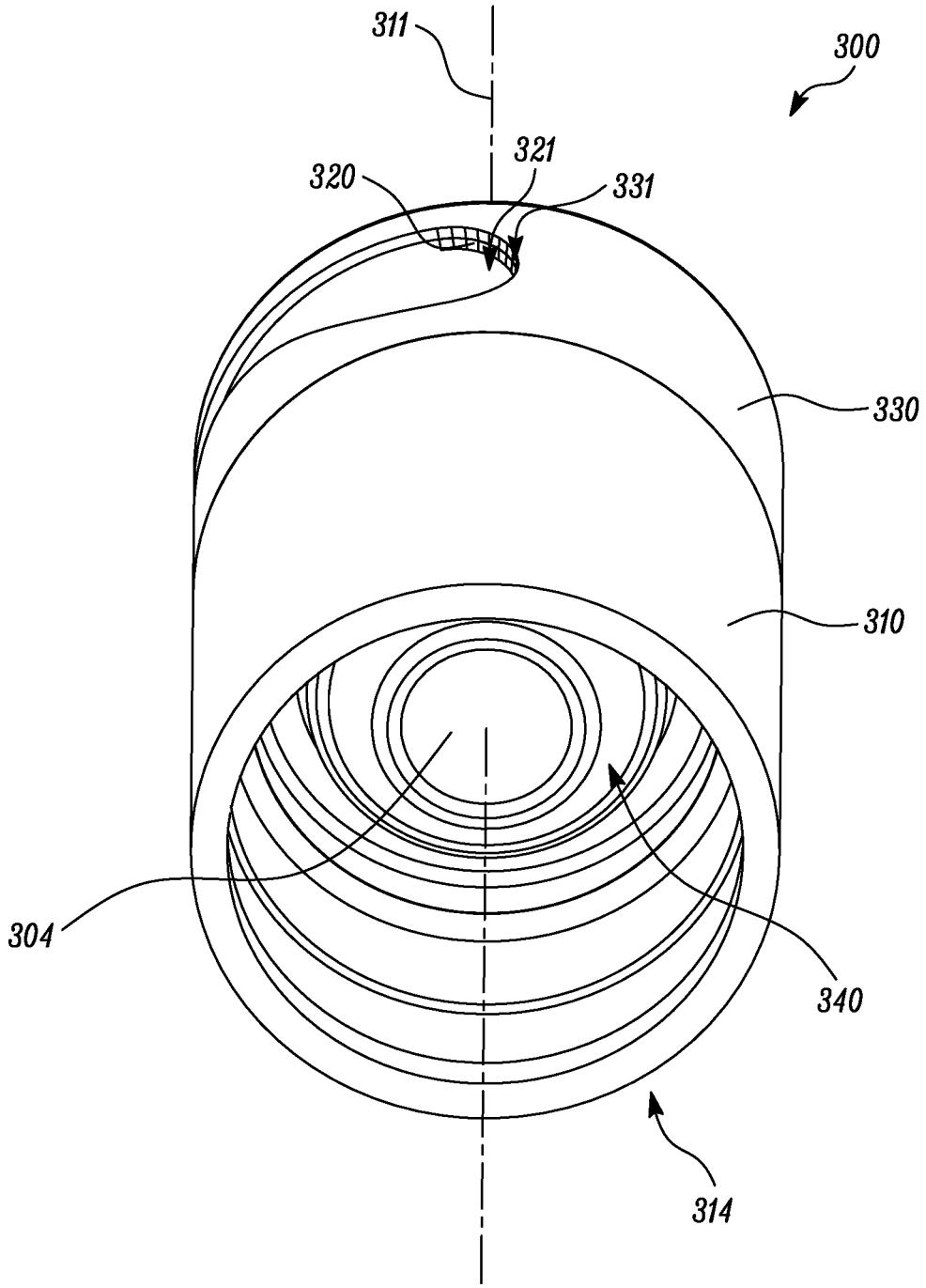
FIG. 13B is a bottom perspective view of the container of FIG. 13A.
Figure 13C:
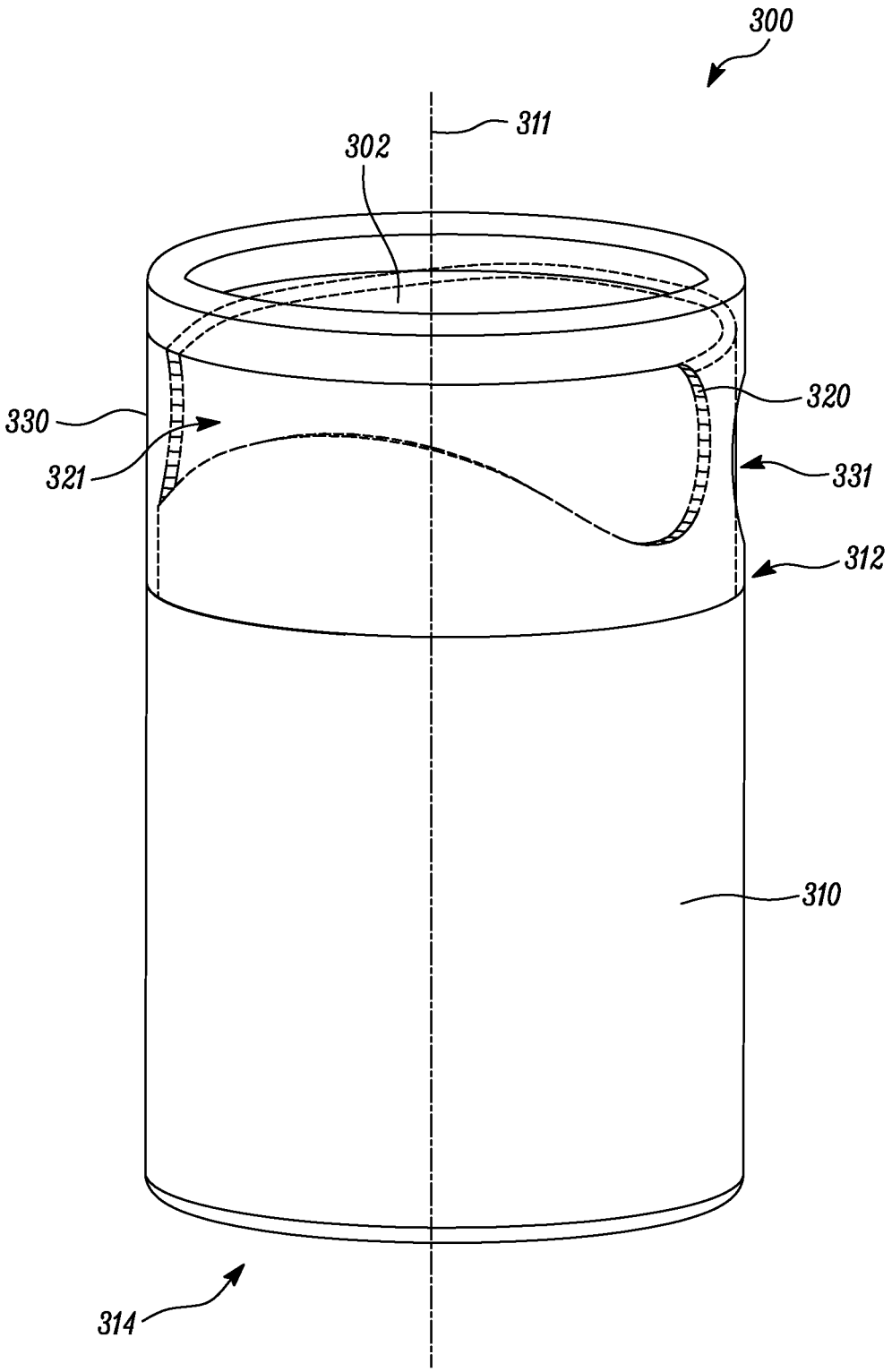
FIG. 13C is a front perspective view of the container of FIG. 13A in a closed configuration.

FIGS. 13A, 13B, and 13C respectively show a front perspective view, a bottom perspective view, and another front perspective view of a container 300 for the plurality of arranged articles 10 (shown in FIGS. 16A and 16B) according to a third aspect of the invention. Further, FIG. 14 shows an exploded perspective view of the container 300.

Referring to FIGS. 13A to 13C and 14, the container 300 comprises a main body 310 having a hollow tubular shape. The hollow tubular shape may allow the main body 310 to accommodate at least some of the plurality of articles 10 (shown in FIGS. 16A and 16B) therein.

The main body 310 comprises a first open end 312 and a second open end 314 opposing the first open end 312. In other words, the second open end 314 may be opposite to the first open end 312. The main body 310 extends along a longitudinal axis 311. Specifically, the main body 310 may extend along the longitudinal axis 311 between the first open end 312 and the second open end 314.

Figure 14:
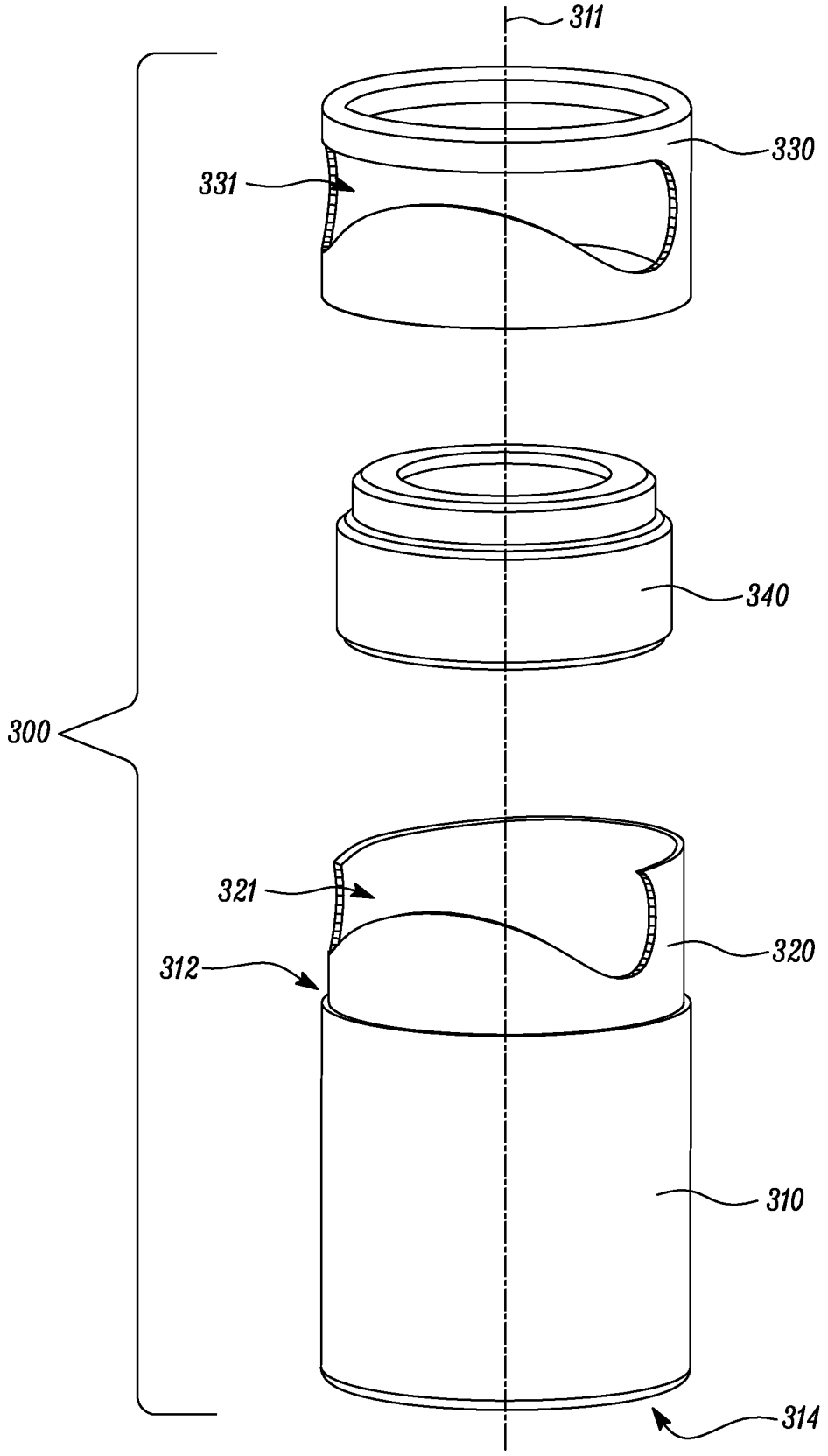
FIG. 14 is an exploded perspective view of the container of FIG. 13A.

The container 300 further comprises a top member 320 (shown more clearly in FIG. 14). The top member 320 may be at least partially received in the main body 310. In other words, at least a portion of the top member 320 may be received within the main body 310. The top member 320 may be fixedly coupled to the main body 310 at the first open end 312. Further, the top member 320 defines a top opening 321 therethrough in communication with the first open end 312.

The container 300 may further comprise a movable member 330 rotatably coupled to the top member 320, such that the movable member 330 may be rotatable relative to the top member 320 about the longitudinal axis 311. The movable member 330 may define a closed top end 302 of the container 300.

The movable member 330 may further define a movable opening 331 therethrough. The movable opening 331 may be selectively aligned or misaligned with the top opening 321. The movable member 330 may be rotated along a direction D4 about the longitudinal axis 311 to align or misalign the movable opening 331 with the top opening 321 (e.g., misalign the movable and top openings 331, 321). The movable member 330 may also be rotated opposite to the direction D4 about the longitudinal axis 311 to align or mis align the movable opening 331 with the top opening 321 (e.g., align the movable and top openings 331, 321).

As shown in FIGS. 13A and 13B, the movable opening 331 of the movable member 330 may be aligned with the top opening 321 of the top member 320. The movable opening 331 may be selectively and at least partially aligned with the top opening 321 of the top member 320 to allow removal of the top article 10B (shown in FIGS. 16A and 16B) from the container 300. Further, as shown in FIG. 13C, the movable member 330 may close the top opening 321 (shown by dashed lines in FIG. 13C) when the movable opening 331 may be misaligned from the top opening 321.

The container 300 further comprises a pusher 340 slidably received within the main body 310 and movable along the longitudinal axis 311. The pusher 340 may slidably engage an internal surface of the main body 310. The pusher 340 defines a movable closed bottom end 304 (shown in FIG. 13B) of the container 300. The main body 310 may comprise any suitable features to retain the pusher 340 therein. For example, the main body 310 may comprise one or more stopping features 316 (shown in FIGS. 16A and 16B) extending into the main body 310 and proximal to the second open end 314. The one or more stopping features 316 may comprise a continuous wall extending into the main body 310. The pusher 340 may engage the one or more stopping features 316, such that the pusher 340 may be retained within the main body 310.

The main body 310 may be configured to provide compression resistance and moisture barrier to the container 300. In other words, the main body 310 may protect the plurality of articles 10 (shown in FIGS. 16A and 16B) from compression (e.g., by external forces incurred by the container 300 during shipping or usage thereof), and may reduce or prevent contact between the plurality of articles 10 stored in the container 300 and moisture present in an external environment (e.g., a shower) where the container 300 is disposed. Therefore, the container 300 may reduce or prevent external moisture from being absorbed by the plurality of articles 10 stored within the container 300.

The main body 310 may be primarily made of a paper material and may be substantially free of plastic. Specifically, the main body 310 may comprise from 0% to 5% by weight of plastic. The main body 310 made of the paper material may comprise barrier materials to protect the main body 310, for example, against moisture, grease/oils, oxygen, etc. Further, the movable member 330 may be made of a formed pulp with the barrier materials applied to the formed pulp. Moreover, the top member 320 may be made of a plastic. Alternatively, the top member 320 may be made of injection molded pulp, or a combination of injection molded paper and plastic. Similarly, the pusher 340 may be made of a plastic, injection molded pulp, or a combination of injection molded paper and plastic. Further, the container 300 may be substantially made of paper and/or aluminum. In some examples, the container 300 may comprise less plastic per dose than current liquid shampoo bottles. In some examples, the container 300 can contain less than 60% plastic, less than 55% plastic, or less than 50% plastic.

Figure 15A:
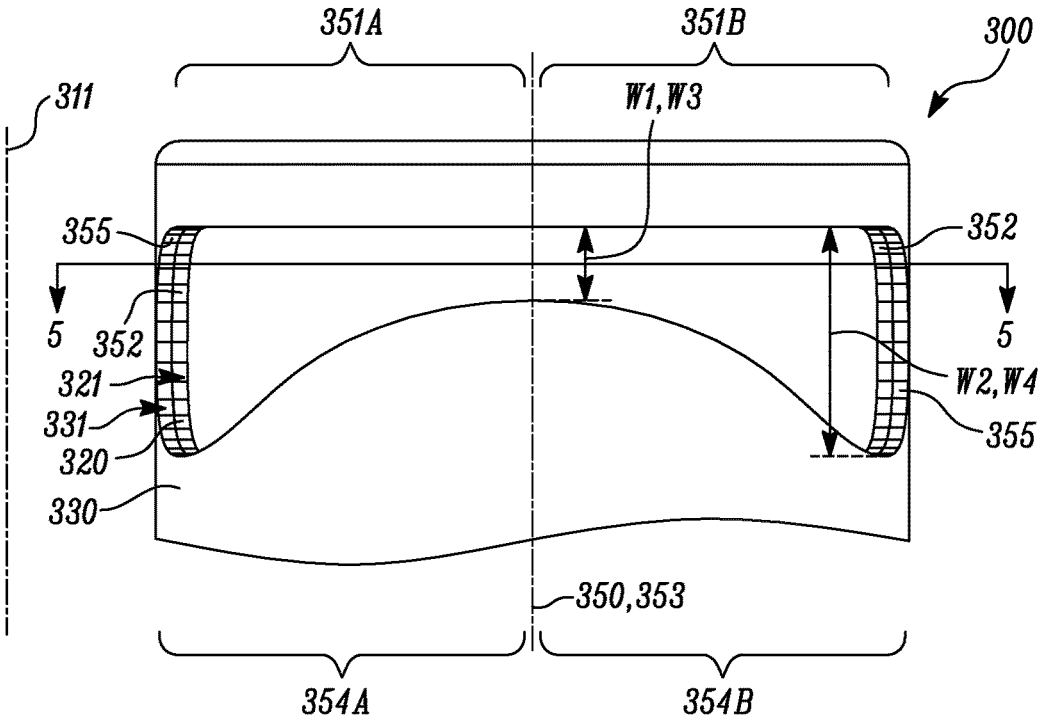
FIG. 15A is a front view of a portion of the container of FIG. 13A with some elements of the container not shown.
Figure 15B:
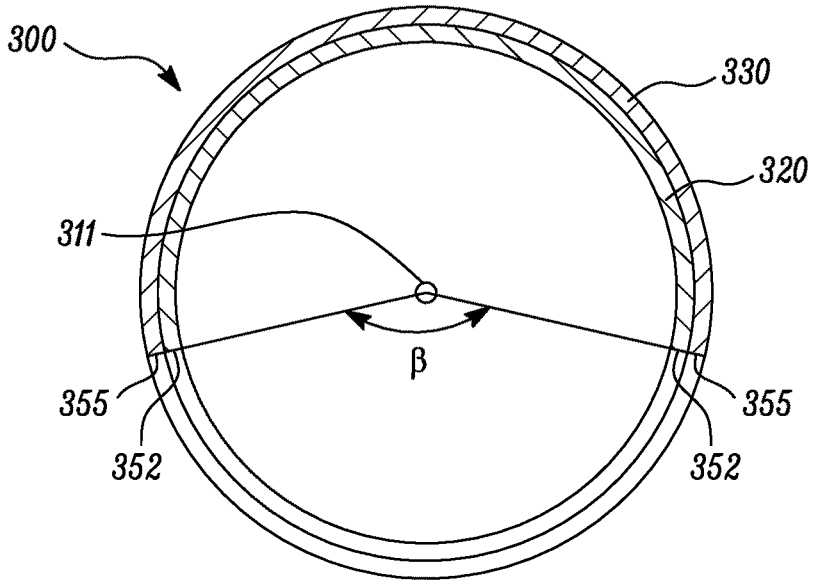
FIG. 15B is a cross-sectional view of the container taken along a line 5-5 of FIG. 15A.

FIG. 15A shows a front view of a portion of the container 300. Some elements of the container 300 are not shown in FIG. 15A for illustrative purposes. FIG. 15B shows a cross-sectional view of the container 300 taken along a line 5-5 of FIG. 15A.

Referring to FIGS. 15A and 15B, the top opening 321 may comprise two symmetric portions 351A, 351B about a central axis 350. Each symmetric portion 351A, 351B may extend from the central axis 350 to a concave end 352. Each symmetric portion 351A, 351B may have a minimum width W1 at the central axis 350, and a maximum width W2 defined by the concave end 352. In some examples, the maximum width W2 may be greater than two times of the minimum width W1.

Similarly, the movable opening 331 may comprise two symmetric portions 354A, 354B about a central axis 353. Each symmetric portion 354A, 354B may extend from the central axis 353 to a concave end 355. Each symmetric portion 354A, 354B may have a minimum width W3 at the central axis 353, and a maximum width W4 defined by the concave end 355. In some examples, the maximum width W4 may be greater than two times of the minimum width W3.

Therefore, each of the top opening 321 and the movable opening 331 may comprise respective two symmetric portions (i.e., the symmetric portions 351A, 351B for the top opening 321 and the symmetric portions 354A, 354B for the movable opening 331) about the respective central axis 350, 353. Further, each of the top opening 321 and the movable opening 331 may extend angularly relative to the longitudinal axis 311. In some examples, each of the top opening 321 and the movable opening 331 may subtend a total angle β of at least 150 degrees about the longitudinal axis 311. In some examples, the total angle β may be from about 150 degrees to about 180 degrees.

The top opening 321 and the movable opening 331 are shown aligned with each other in FIGS. 15A and 15B, and therefore the corresponding central axes 350, 353 are also aligned with each other. Further, the top and movable openings 321, 331 may have substantially similar shapes. In some examples, the minimum width W1 of the top opening 321 may be equal to the minimum width W3 of the movable opening 331. Further, in some examples, the maximum width W2 of the top opening 321 may be equal to the maximum width W4 of the movable opening 331.

Figure 16A:
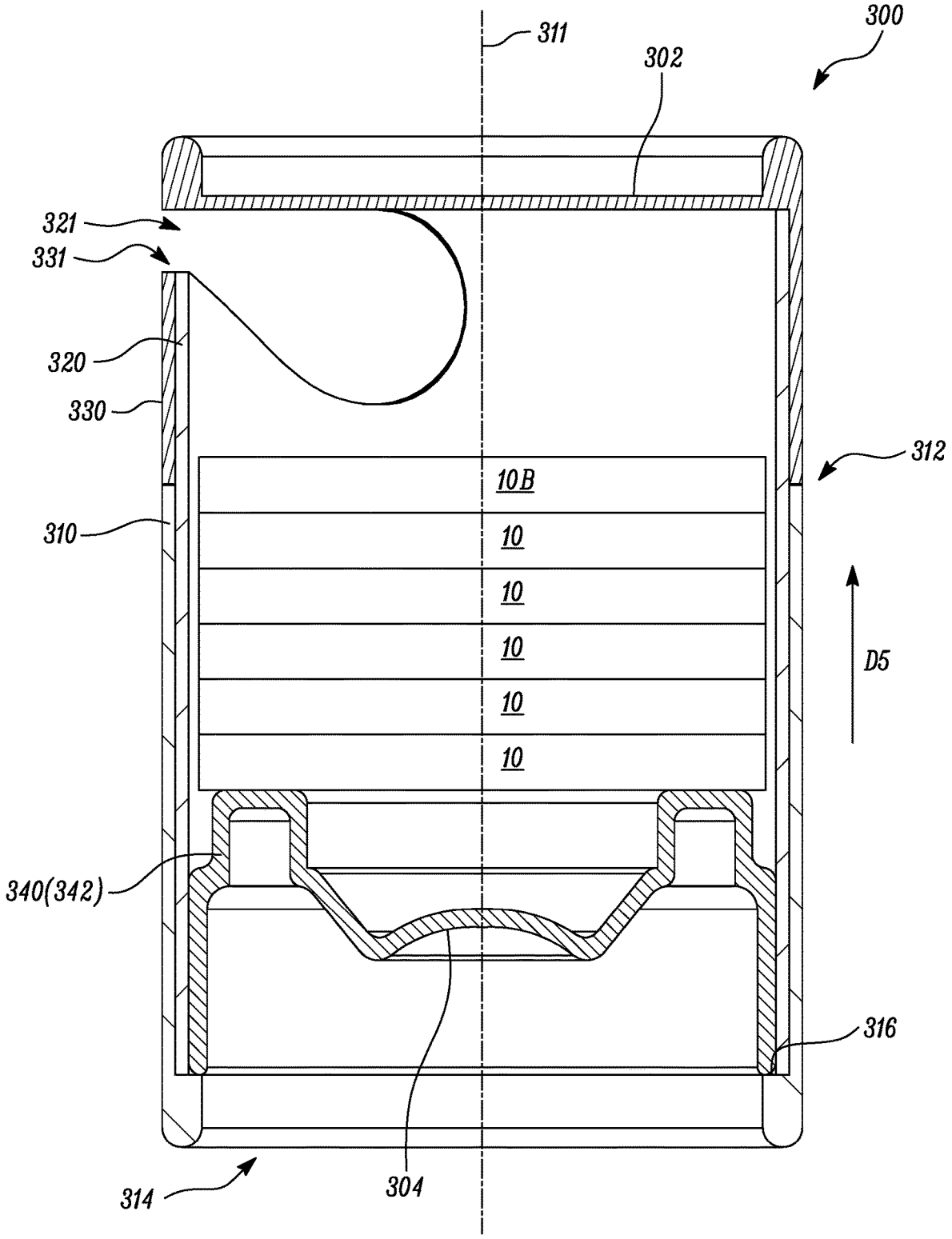
FIGS. 16A and 16B are cross-sectional views of the container in different configurations taken along a line 4-4 of FIG. 13A.
Figure 16B:
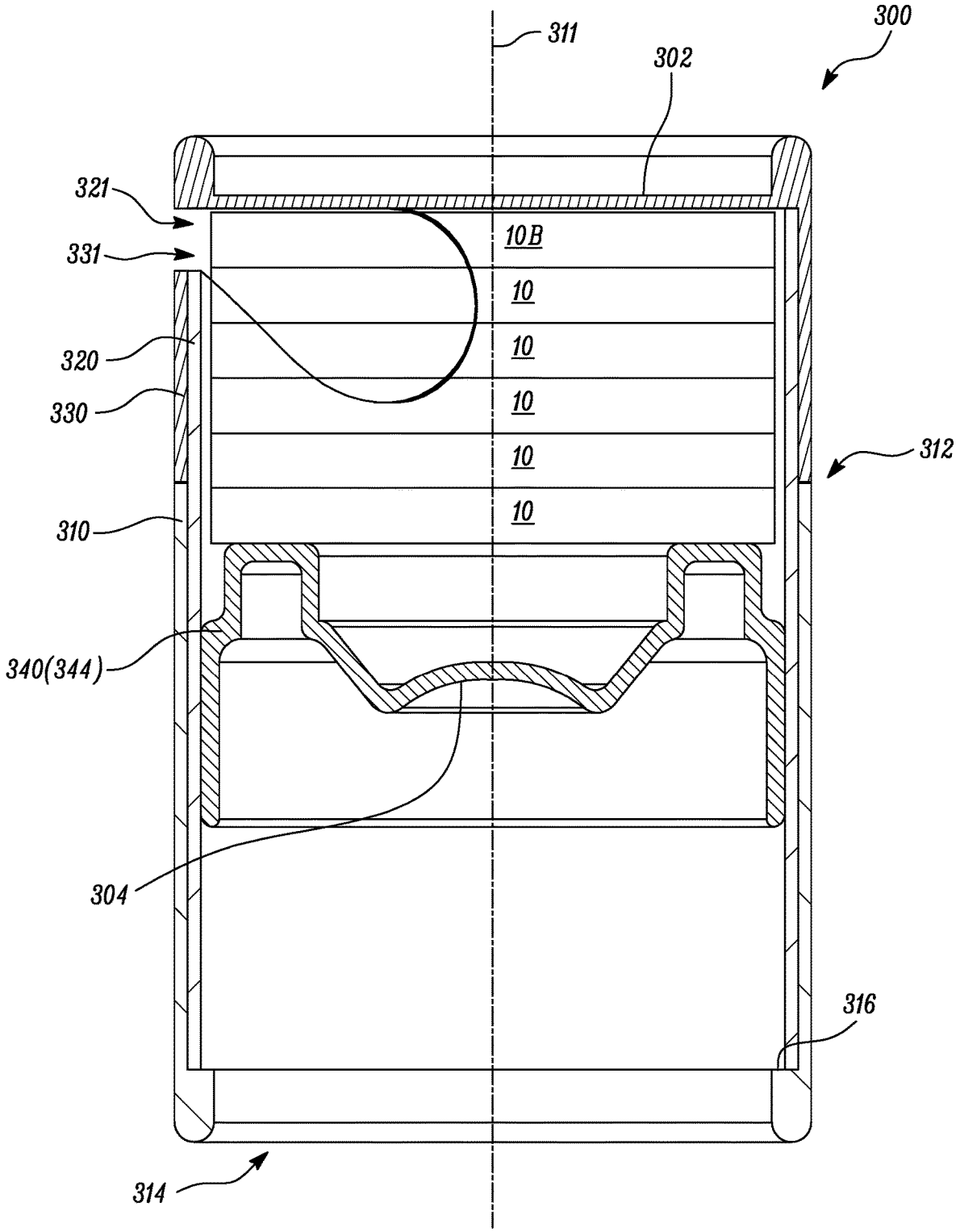

FIGS. 16A and 16B show cross-sectional views of the container 300 taken along line 4-4 of FIG. 13A. The top opening 321 and the movable opening 331 are aligned in FIGS. 16A and 16B. The pusher 340 is in a first position 342 in FIG. 16A, and the pusher 340 is in a second position 344 in FIG. 16B.

As shown in FIG. 16A, the plurality of articles 10 may be received within the main body 310 and stacked on top of the pusher 340. The plurality of articles 10 may be disposed between the movable member 330 and the pusher 340 along the longitudinal axis 311. Further, the plurality of articles 10 comprises the top article 10B.

As discussed above, the pusher 340 is in the first position 342 in FIG. 16A. The first position 342 may correspond to a storage configuration of the container 300. In the storage configuration of the container 300, the pusher 340 may rest proximal to the second open end 314 of the main body 310. For example, the pusher 340 may engage with and rest on the one or more stopping features 316 of the main body 310 in the first position 342.

The pusher 340 may be moved to the second position 344 (shown in FIG. 16B) upon application of a force on the movable closed bottom end 304 of the container 300 defined by the pusher 340 in a direction D5. The direction D5 may be from the second open end 314 towards the first open end 312 of the main body 310 along the longitudinal axis 311. In some examples, the pusher 340 may be biased towards the first position 342 of the pusher 340. A biasing member, such as a spring, may bias the pusher 340 towards the first position 342.

As shown in FIG. 16B, upon application of the force on the pusher 340 in the direction D5, the pusher 340 may move to the second position 344. The second position 344 may be a position in which at least one of the plurality of articles 10 may be removable from the top opening 321. Specifically, the pusher 340 may be movable along the longitudinal axis 311 towards the top opening 321, such that the top article 10B from the plurality of articles 10 may be removable from the top opening 321. Further, the top article 10B from the plurality of articles 10 may be removable from the movable opening 331 aligned with the top opening 321.

The top article 10B may be manually removed by moving the pusher 340 to the second position 344, and subsequently removing the top article 10B through each of the top opening 321 and the movable opening 331. The respective concave ends 352, 355 and the respective maximum widths W2, W4 (shown in FIG. 15A) of the top and movable openings 321, 331 may facilitate in gripping the top article 10B to manually remove the top article 10B through each of the top opening 321 and the movable opening 331. A successive article 10 from the stack may be similarly removed. In this manner, the container 300 may allow sequential dispensing of successive top articles 10B from the stack of the articles 10. Thus, the container 300 may provide an easy to use dispensing mechanism to dispense the top article 10B from the container 300.

Figure 17A:
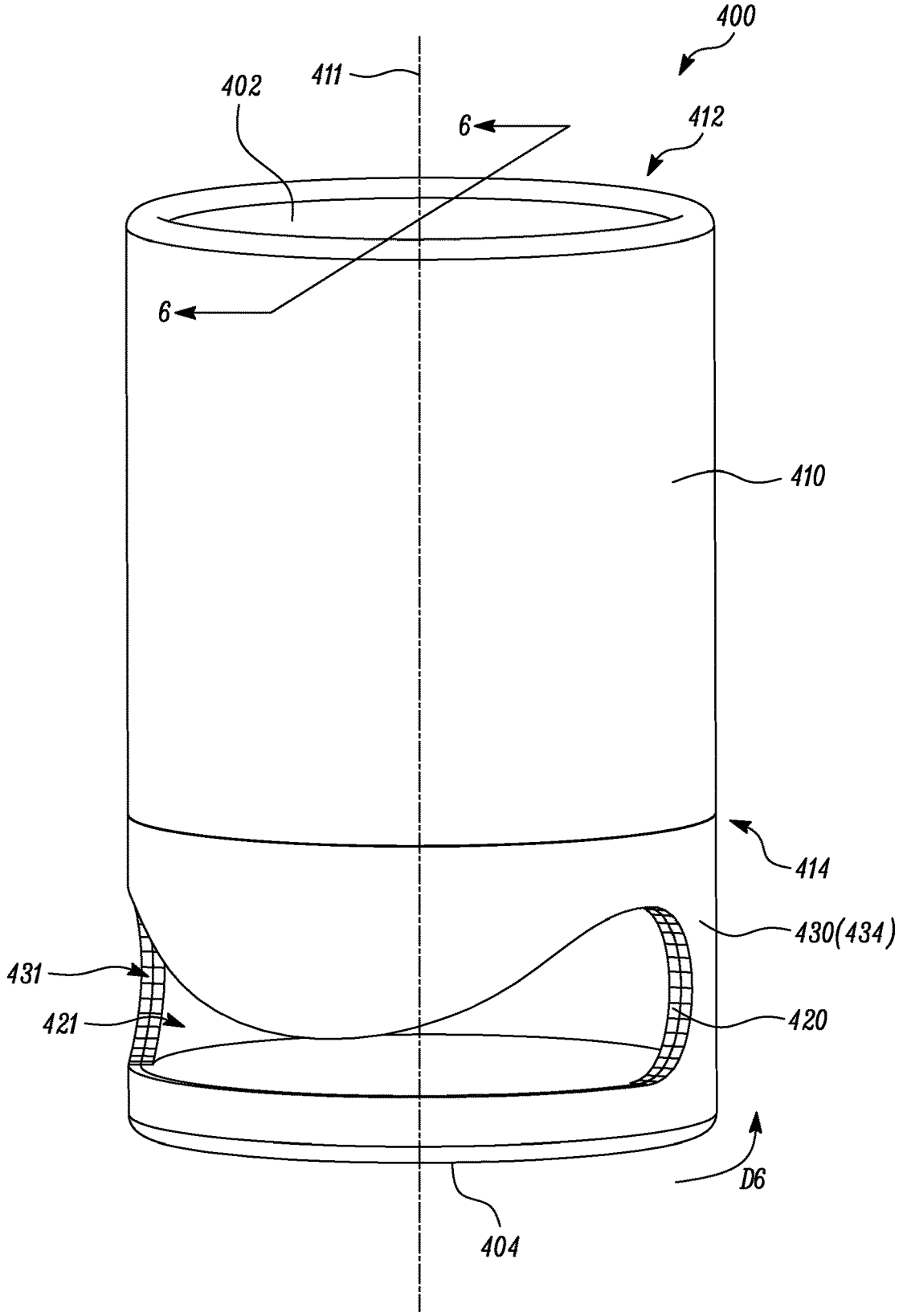
FIGS. 17A and 17B are front perspective views of a container for a plurality of articles in open and closed configurations, respectively, according to a fourth aspect of the invention.
Figure 17B:
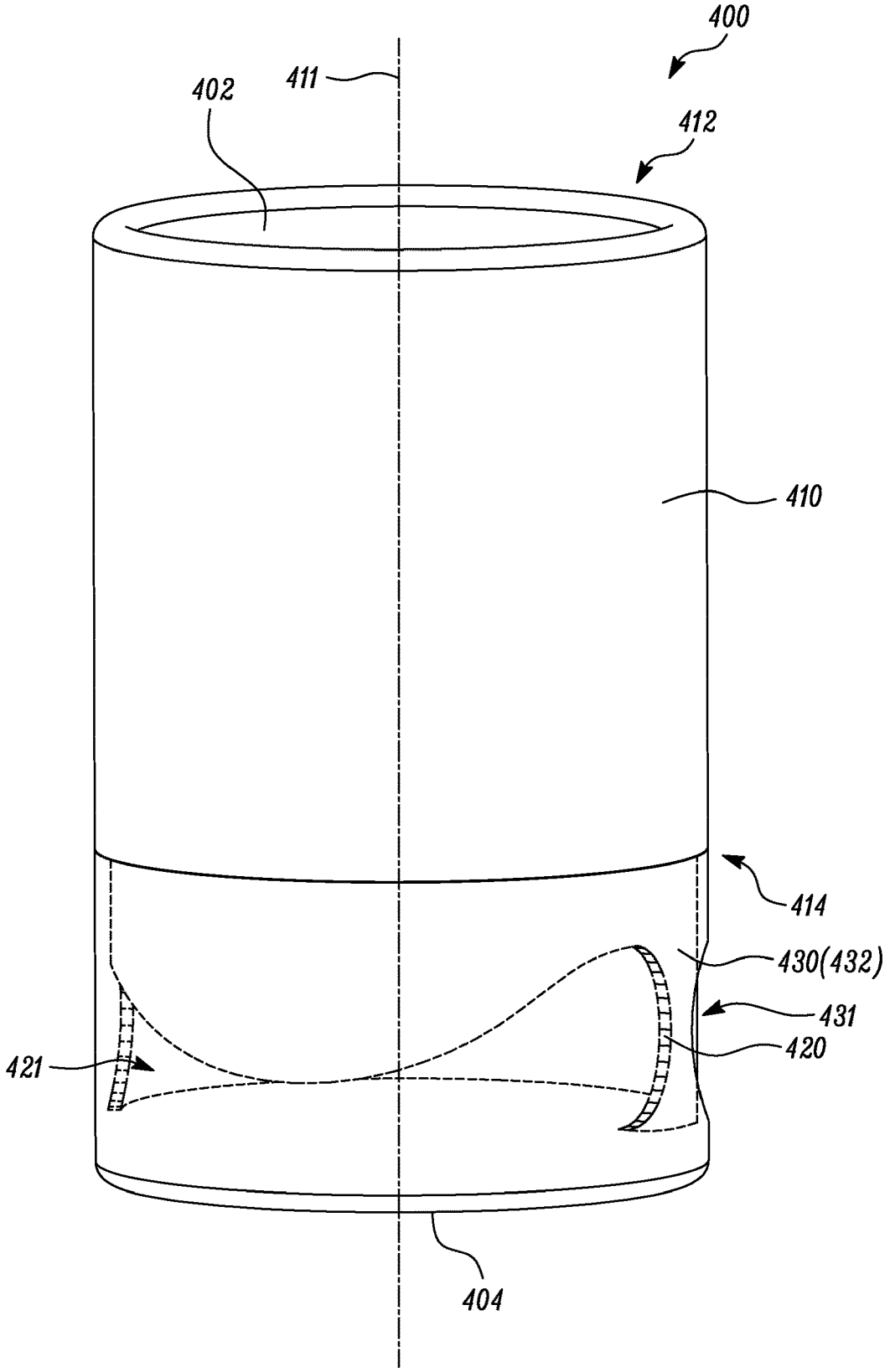

FIGS. 17A and 17B are front perspective views showing different configurations of a container 400 for the plurality of articles 10 (shown in FIG. 20) stacked on top of each other according to a fourth aspect of the invention. Further, FIG. 18 shows an exploded perspective view of the container 400.

Figure 18:
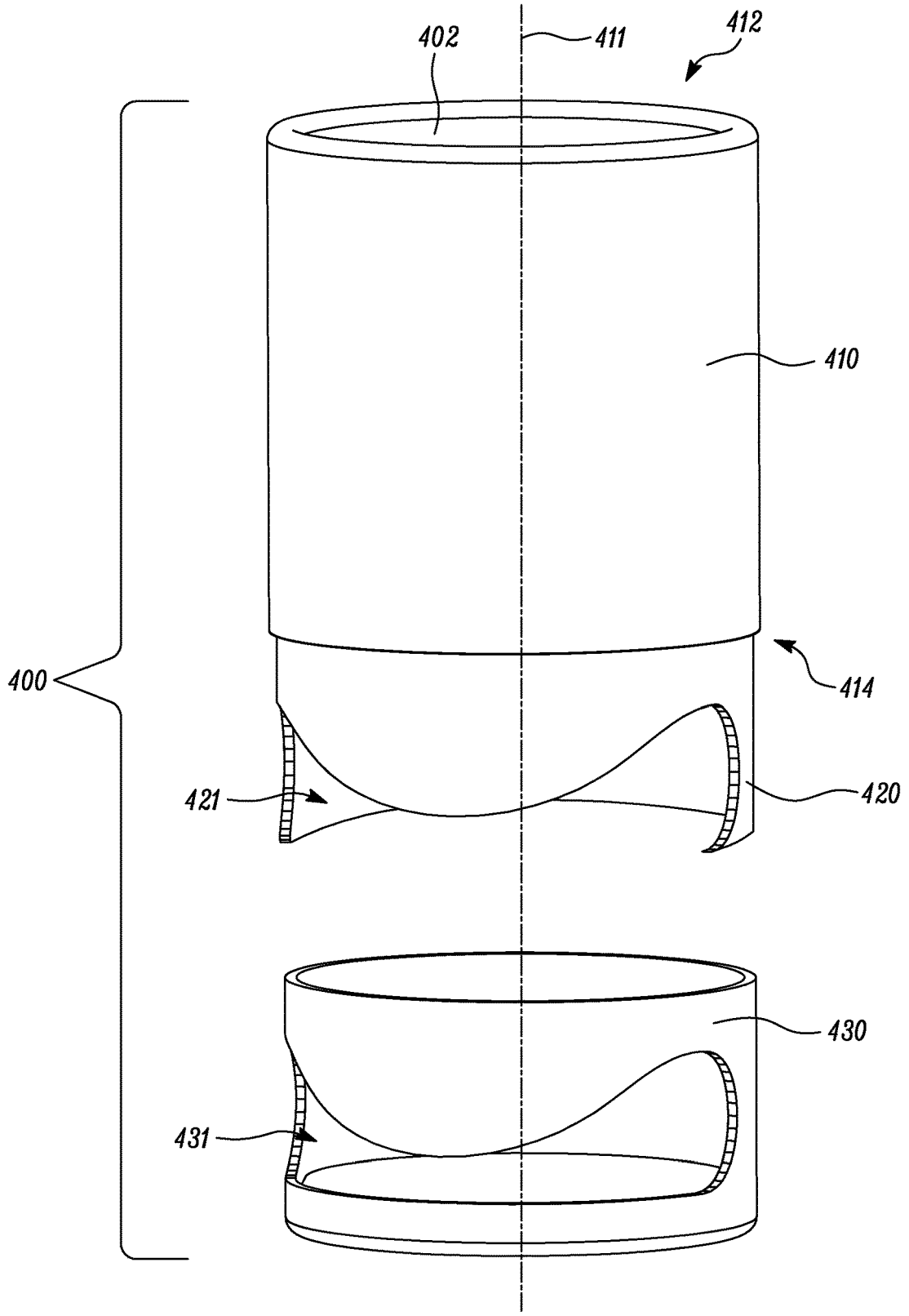
FIG. 18 is an exploded perspective view of the container of FIG. 17A.

Referring to FIGS. 17A, 17B, and 18, the container 400 comprises a main body 410 having a hollow tubular shape. The hollow tubular shape may allow the main body 410 to accommodate at least some of the plurality of articles 10 (shown in FIG. 20) therein.

The main body 410 comprises a first closed end 412 and a second open end 414 opposing the first closed end 412. In other words, the second open end 414 may be opposite to the first closed end 412. The main body 410 extends along a longitudinal axis 411. Specifically, the main body 410 may extend along the longitudinal axis 411 between the first closed end 412 and the second open end 414. The first closed end 412 may define a closed top end 402 of the container 400.

The container 400 further comprises a bottom member 420 (shown more clearly in FIG. 18). The bottom member 420 may be at least partially received in the main body 410. In other words, at least a portion of the bottom member 420 may be received within the main body 410. The bottom member 420 may be fixedly coupled to the main body 410 at the second open end 414. Further, the bottom member 420 may define a bottom opening 421 therethrough in communication with the second open end 414. The bottom opening 421 may extend angularly relative to the longitudinal axis 411.

The container 400 further comprises a movable member 430 movably coupled to the bottom member 420, such that the movable member 430 may be movable relative to the bottom member 420 between a closed position 432 (shown in FIG. 17B) and an open position 434 (shown in FIG. 17A). The movable member 430 defines a closed bottom end 404 of the container 400.

The movable member 430 may be rotated along a direction D6 about the longitudinal axis 411 to move the movable member 430 between the closed position 432 and the open position 434 (e.g., from the open position 434 to the closed position 432). The movable member 430 may also be rotated opposite to the direction D6 about the longitudinal axis 411 to move the movable member 430 between the closed position 432 and the open position 434 (e.g., from the closed position 432 to the open position 434).

In the closed position 432, the movable opening 431 may be closed. Specifically, in the closed position 432, the movable opening 431 may be misaligned from the bottom opening 421. In the open position 434, the movable opening 431 may be at least partially exposed to allow removal of the bottom article 10A (shown in FIG. 20) from the plurality of articles 10 from the container 400. Specifically, in the open position 434, the movable opening 431 may be at least partially aligned with the bottom opening 421.

The main body 410 may be configured to provide compression resistance and moisture barrier to the container 400. In other words, the main body 410 may protect the plurality of articles 10 (shown in FIG. 20) from compression (e.g., by external forces incurred by the container 400 during shipping or usage thereof), and may reduce or prevent contact between the plurality of articles 10 and moisture present in an external environment (e.g., a shower) where the container 400 is disposed. Therefore, the container 400 may reduce or prevent external moisture from being absorbed by the plurality of articles 10 stored within the container 400.

The main body 410 may be primarily made of a paper material and may be substantially free of plastic. Specifically, the main body 410 may comprise from 0% to 5% by weight of plastic. The main body 410 made of the paper material may comprise barrier materials to protect the main body 410, for example, against moisture, grease/oils, oxygen, etc. Further, the movable member 430 may be made of a formed pulp with the barrier materials applied to the formed pulp. Moreover, the bottom member 420 may be made of a plastic. Alternatively, the bottom member 420 may be made of injection molded pulp, or a combination of injection molded paper and plastic. Further, the container 400 may be substantially made of paper and/or aluminum. In some examples, the container 400 may comprise less plastic per dose than current liquid shampoo bottles. In some examples, the container 400 can contain less than 60% plastic, less than 55% plastic, or less than 50% plastic.

Figure 19A:
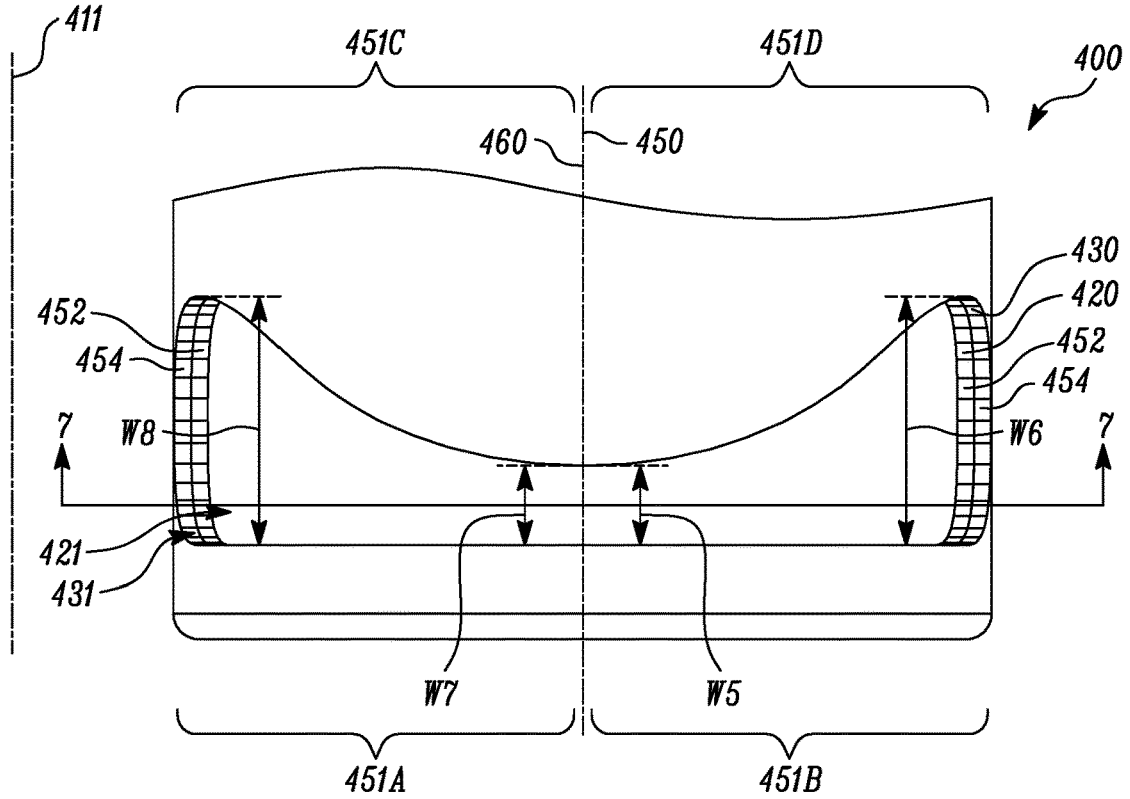
FIG. 19A is a front view of a portion of the container of FIG. 17A with some elements of the container not shown.
Figure 19B:
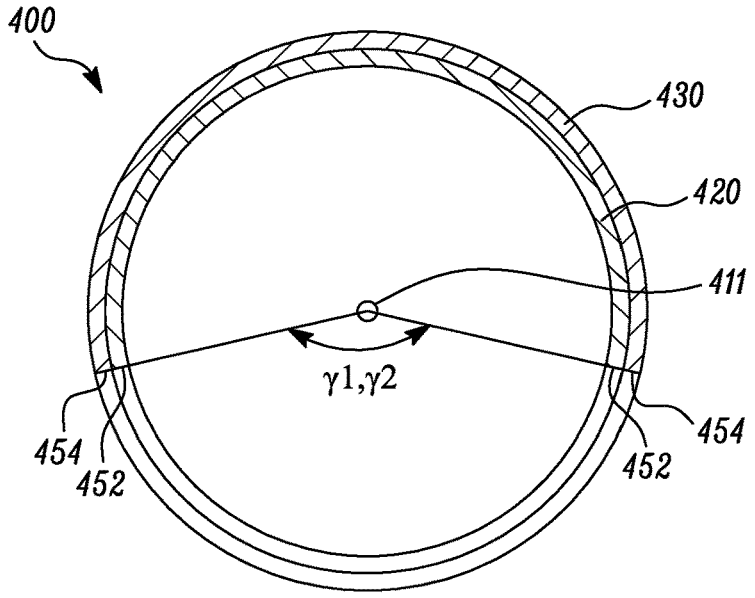
FIG. 19B is a cross-sectional view of the container taken along a line 7-7 of FIG. 19A.

FIG. 19A shows a front view of a portion of the container 400. Some elements of the container 400 are not shown in FIG. 19A for illustrative purposes. FIG. 19B shows a cross-sectional view of the container 400 taken along a line 7-7 of FIG. 19A.

Referring to FIGS. 19A and 19B, the bottom opening 421 may comprise two symmetric portions 451A, 451B about a central axis 450. Each symmetric portion 451A, 451B may extend from the central axis 450 to a concave end 452. In some examples, each symmetric portion 451A, 451B may have a minimum width W5 at the central axis 450 and a maximum width W6 defined by the concave end 452. In some examples, the maximum width W6 may be greater than two times of the minimum width W5. Further, the bottom opening 421 may subtend a total angle γ1 of at least 150 degrees about the longitudinal axis 411. In some examples, the total angle γ1 may be from about 150 degrees to about 180 degrees.

Moreover, the movable opening 431 may comprise two symmetric portions 451C, 451D about a central axis 460. As shown in FIG. 19A, the central axis 460 may coincide with the central axis 450 when the movable and bottom openings 431, 421 are aligned with each other. Each symmetric portion 451C, 451D may extend from the central axis 460 to a concave end 454. Further, each symmetric portion 451C, 451D may have a minimum width W7 at the central axis and a maximum width W8 defined by the concave end 454. In some examples, the maximum width W8 may be greater than two times of the minimum width W7. Further, the movable opening 431 may subtend a total angle γ2 of at least 150 degrees about the longitudinal axis 411. In some examples, the total angle γ2 may be from about 150 degrees to about 180 degrees. In some cases, the movable opening 431 may have a substantially similar shape as the bottom opening 421.

Figure 20:
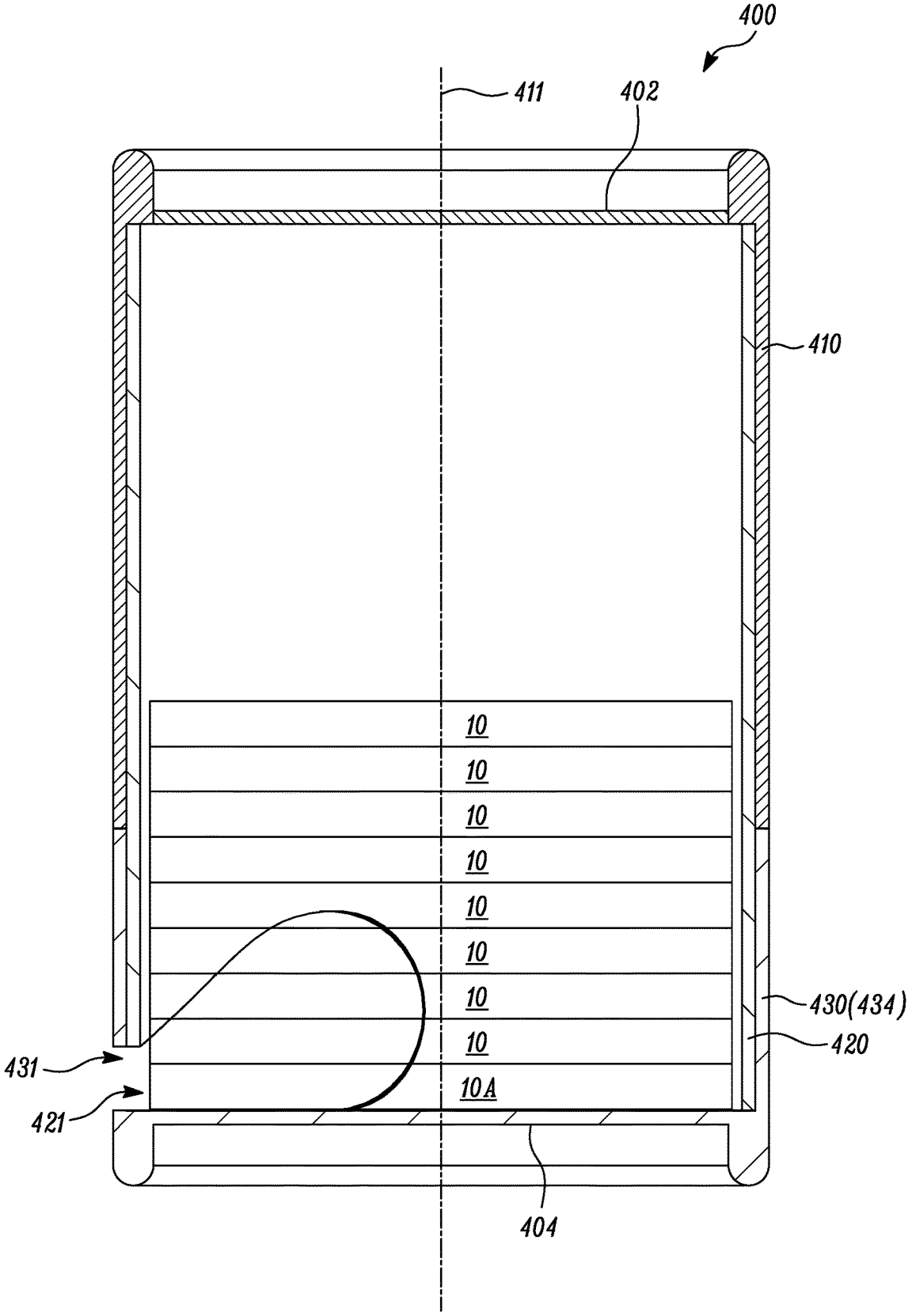
FIG. 20 is a cross-sectional view of the container taken along a line 6-6 of FIG. 17A.

FIG. 20 shows a cross-sectional view of the container 400 taken along a line 6-6 of FIG. 17A. The movable member 430 is in the open position 434 in FIG. 20, such that the bottom opening 421 may be at least partially exposed to allow removal of the bottom article 10A from the plurality of articles 10 from the container 400. The bottom article 10A may be manually removed, for example, by grabbing the bottom article 10A through the bottom opening 421 and the movable opening 431. The concave ends 452, 453 and the maximum widths W4, W6 (shown in FIG. 19A) may facilitate in gripping the bottom article 10A to manually remove the bottom article 10A through each of the bottom opening 421 and the movable opening 431. Alternatively, the bottom article 10A may be manually removed by shaking or tilting the container 400, such that at least the bottom article 10A moves through the bottom opening 421 and the movable opening 431 under the force of gravity. Thus, the container 400 may provide an easy to use dispensing mechanism to dispense the bottom article 10A from the container 400.

Figure 21A:
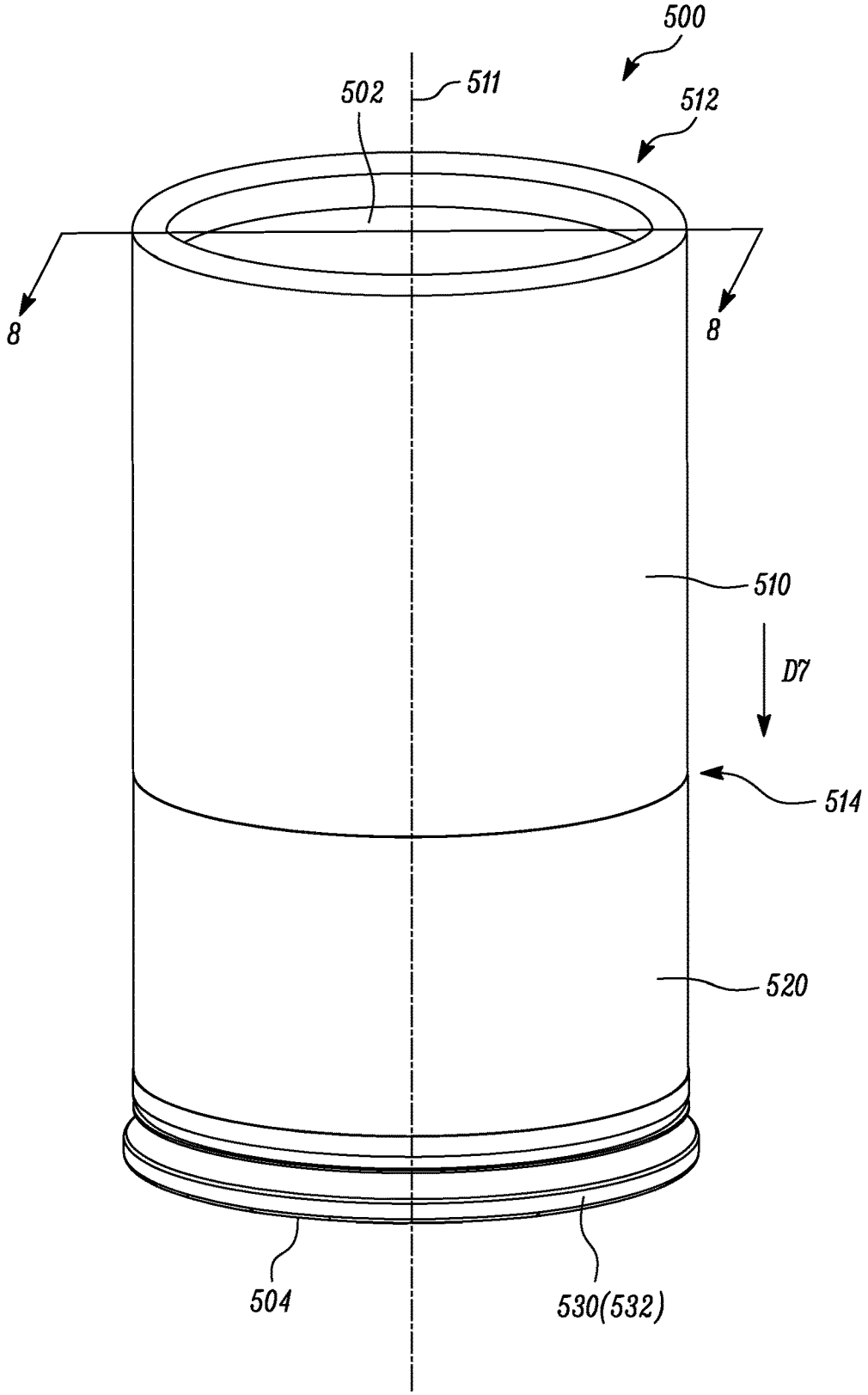
FIGS. 21A and 21B are front perspective views of a container for a plurality of articles in closed and open configurations, respectively, according to a fifth aspect of the invention.
Figure 21B:
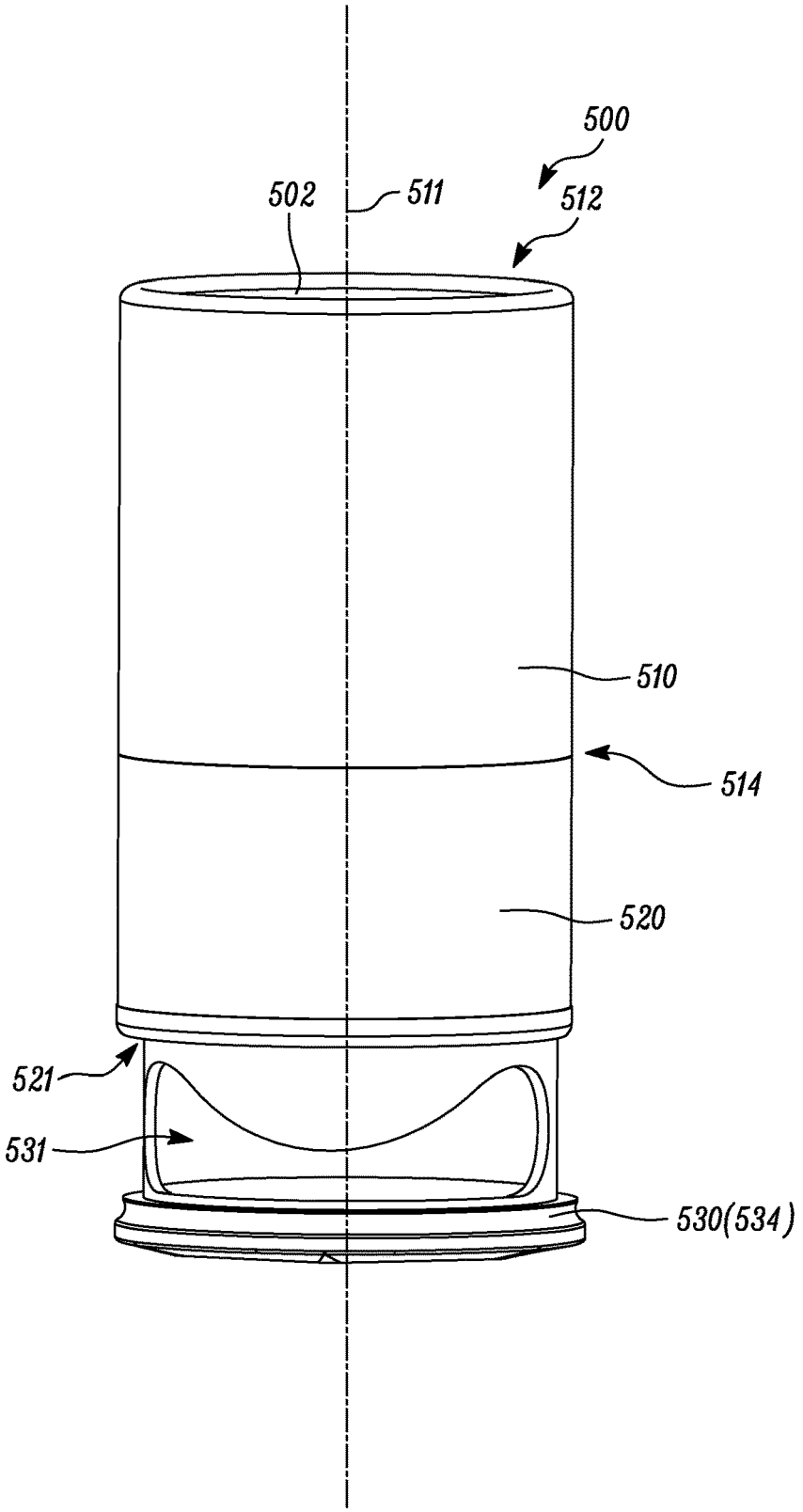

FIGS. 21A and 21B are front perspective views of different configurations of a container 500 for the plurality of articles 10 (shown in FIGS. 22A and 22B) stacked on top of each other according to a fifth aspect of the invention. Further, FIG. 21C shows an exploded perspective view of the container 500.

Figure 21C:
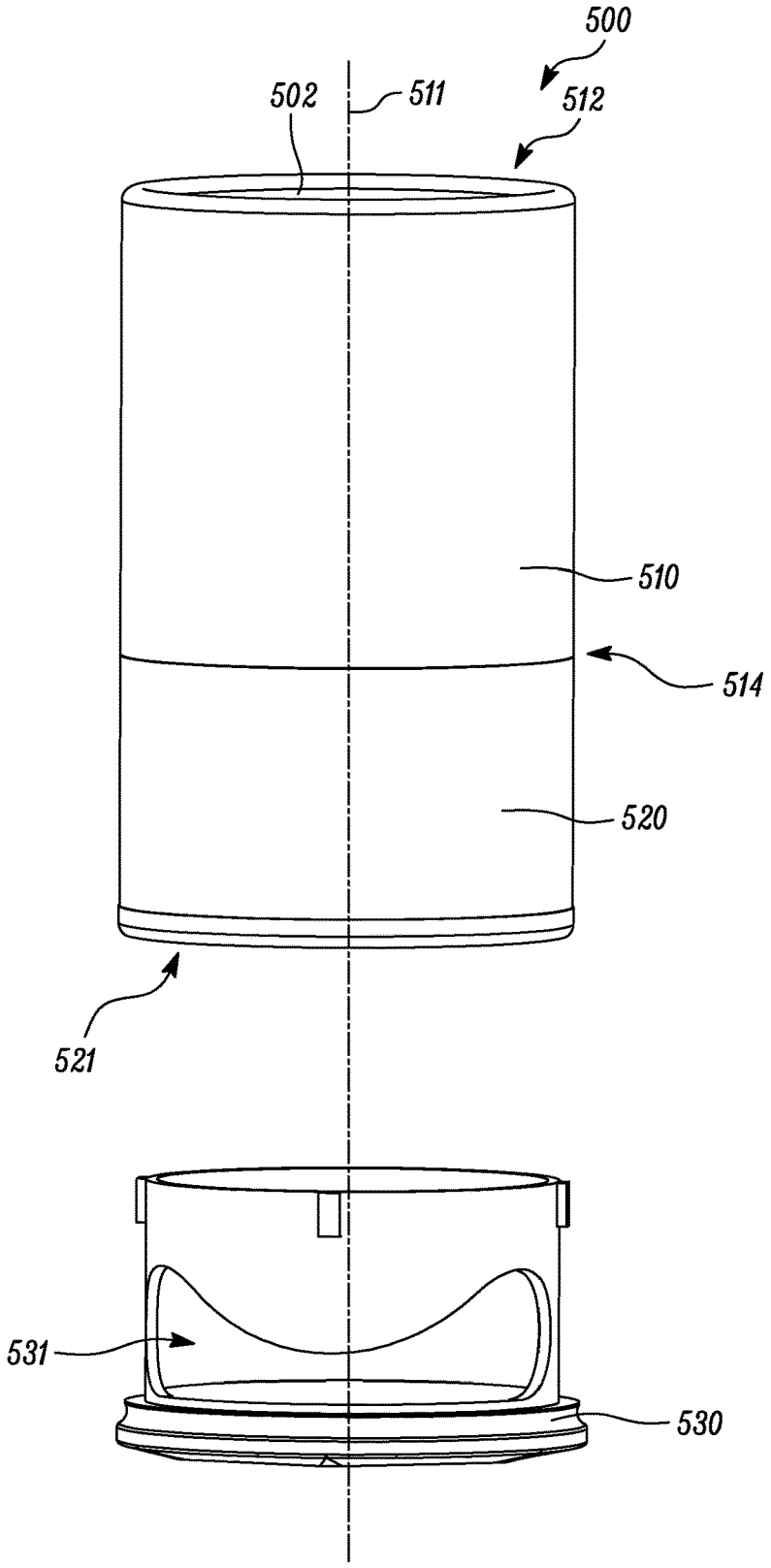
FIG. 21C is an exploded perspective view of the container of FIG. 21A.

Referring to FIGS. 21A to 21C, the container 500 comprises a main body 510 having a hollow tubular shape. The hollow tubular shape may allow the main body 510 to accommodate at least some of the plurality of articles 10 (shown in FIGS. 22A and 22B) therein.

The main body 510 comprises a first closed end 512 and a second open end 514 opposing the first closed end 512. In other words, the second open end 514 may be opposite to the first closed end 512. The main body 510 extends along a longitudinal axis 511. Specifically, the main body 510 may extend along the longitudinal axis 511 between the first closed end 512 and the second open end 514. The first closed end 512 may define a closed top end 502 of the container 500.

The container 500 further comprises a bottom member 520. The bottom member 520 may be at least partially received in the main body 510. In other words, at least a portion of the bottom member 520 may be received within the main body 510. The bottom member 520 may be fixedly coupled to the main body 510 at the second open end 514. Further, the bottom member 520 may define a bottom opening 521 (shown in FIGS. 21B and 21C) therethrough in communication with the second open end 514. The bottom opening 521 may be aligned with the second open end 514 and offset from the second open end 514. The bottom member 520 may have a hollow tubular shape with the bottom opening 521 distal to the second open end 514.

The container 500 further comprises a movable member 530 movably coupled to the bottom member 520, such that the movable member 530 may be movable relative to the bottom member 520 between a closed position 532 (shown in FIG. 21A) and an open position 534 (shown in FIG. 21B). The movable member 530 defines a closed bottom end 504 of the container 500.

The movable member 530 further defines a movable opening 531 (shown in FIG. 21B) therethrough in communication with the second open end 514. The movable opening 531 extends angularly relative to the longitudinal axis 511. The movable opening 531 may be similar in shape to the movable opening 431 of the container 400 of FIG. 19A. Therefore, the movable opening 531 may subtend a total angle of at least 150 degrees about the longitudinal axis 511. Further, the movable opening 531 may comprise two symmetric portions (not shown) about a central axis (not shown). Each symmetric portion may extend from the central axis to a concave end (not shown). Each symmetric portion may have a minimum width at the central axis and a maximum width defined by the concave end.

The movable member 530 may be slidable relative to the bottom member 520 along the longitudinal axis 511 between the closed position 532 and the open position 534. The movable member 530 may be slid along the longitudinal axis 611 in a direction D7 to move the movable member 530 to the open position 534 from the closed position 532. The movable member 530 may be slid along the longitudinal axis 611 opposite to the direction D7 to move the movable member 530 to the closed position 532 from the open position 534.

In the closed position 532, the movable opening 531 may be closed. Specifically, in the closed position 532, the bottom member 520 may cover the movable opening 531. In the open position 534, the movable opening 531 may be at least partially exposed to allow removal of the bottom article 10A (shown in FIGS. 22A and 22B) from the plurality of articles 10 from the container 500. Specifically, in the open position 534, the movable opening 531 may be at least partially offset from the bottom member 520 relative to the longitudinal axis 511. In other words, in the open position 534, at least a portion of the movable opening 531 may be axially offset from the bottom member 520 relative to the longitudinal axis 511.

The main body 510 may be configured to provide compression resistance and moisture barrier to the container 500. In other words, the main body 510 may protect the plurality of articles 10 (shown in FIG. 20) from compression (e.g., by external forces incurred by the container 500 during shipping or usage thereof), and may reduce or prevent contact between the plurality of articles 10 stored in the container 500 and moisture from an external environment (e.g., a shower) in which the container 500 is disposed. Therefore, the container 500 may reduce or prevent external moisture from being absorbed by the plurality of articles 10 stored within the container 500.

The main body 510 may be primarily made of a paper material and may be substantially free of plastic. Specifically, the main body 510 may comprise from 0% to 5% by weight of plastic. The main body 510 made of the paper material may comprise barrier materials to protect the main body 510, for example, against moisture, grease/oils, oxygen, etc. Moreover, the bottom member 520 and the movable member 530 may be made of a plastic. Alternatively, the bottom member 520 and the movable member 530 may be made of injection molded pulp, or a combination of injection molded paper and plastic. Further, the container 500 may be substantially made of paper and/or aluminum. In some examples, the container 500 may comprise less plastic per dose than current liquid shampoo bottles. In some examples, the container 500 can contain less than 60% plastic, less than 55% plastic, or less than 50% plastic.

Figure 22A:
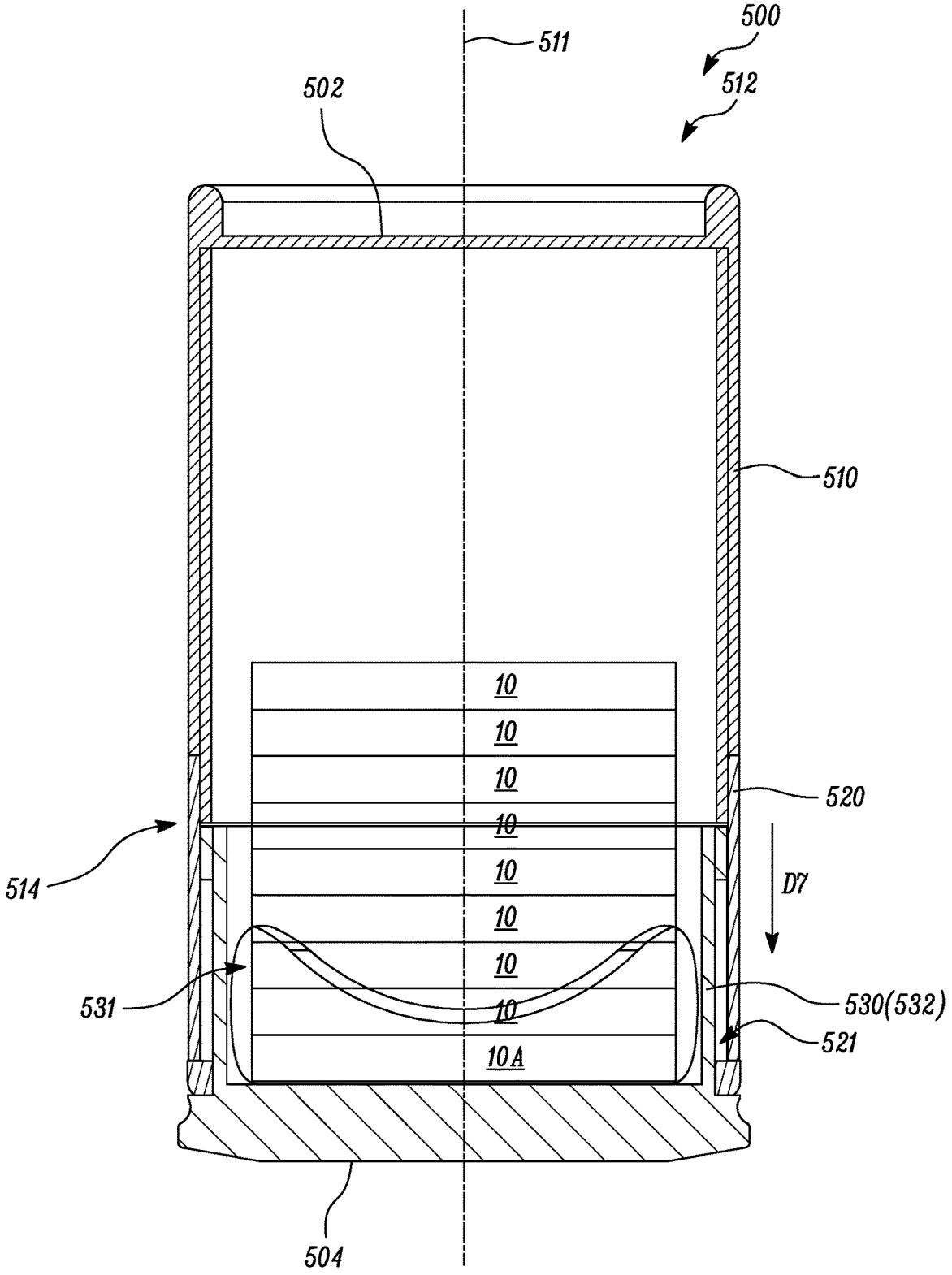
FIGS. 22A and 22B are cross-sectional views of the container in closed and open configurations, respectively, taken along a line 8-8 of FIG. 21A.
Figure 22B:
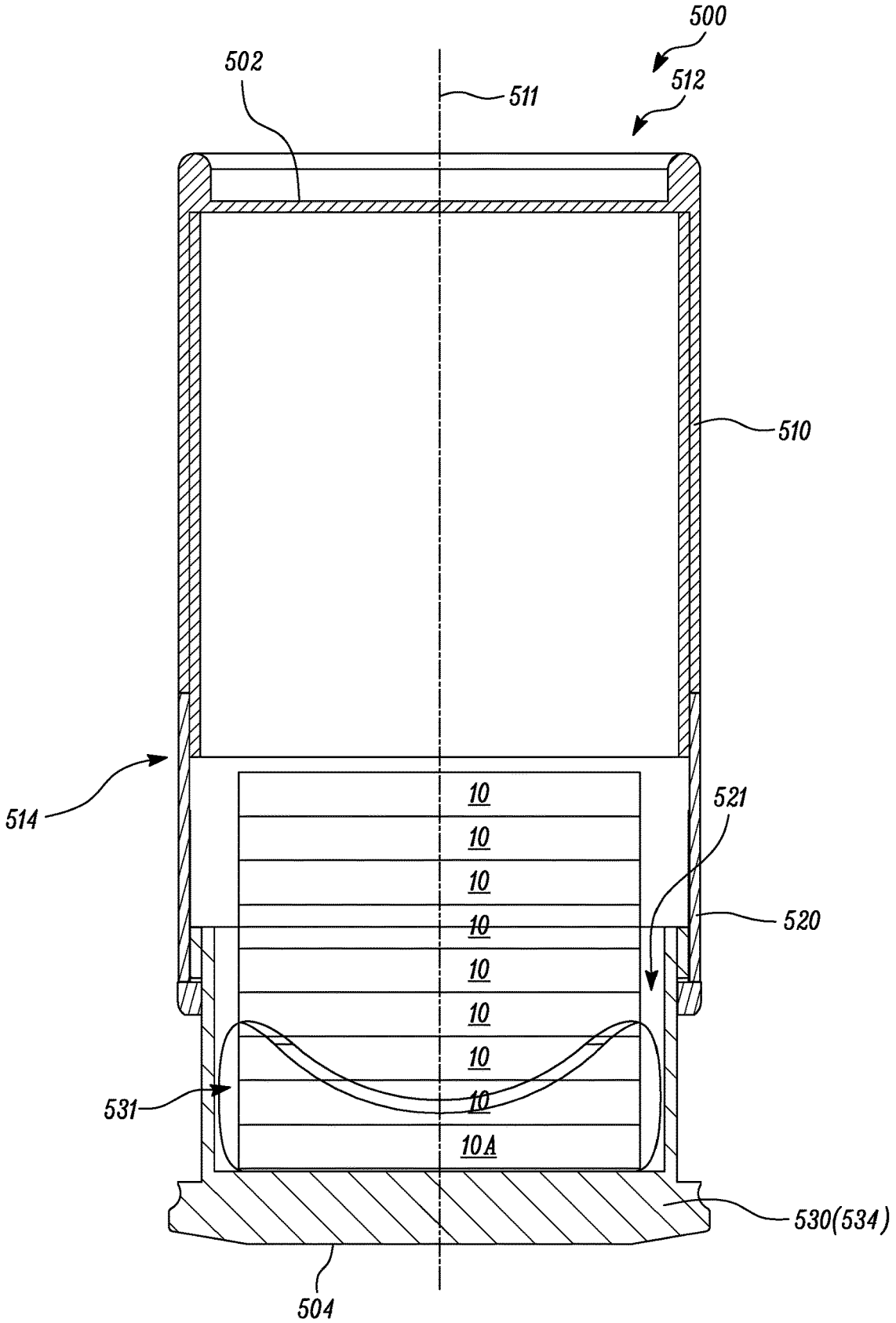

FIGS. 22A and 22B show cross-sectional views of the container 500 taken along a line 8-8 of FIG. 21A. The movable member 530 may be in the closed position 532 in FIG. 22A, and the movable member 530 may be in the open position 534 in FIG. 22B.

The movable member 530 may be slid relative to the bottom member 520 along the longitudinal axis 511 to the open position 534 from the closed position 532, such that the movable opening 531 may be at least partially offset from the bottom member 520 relative to the longitudinal axis 511 to allow removal of the bottom article 10A from the plurality of articles 10 from the container 500. The bottom article 10A may be manually removed, for example, by grabbing the bottom article 10A through the movable opening 531. Alternatively, the bottom article 10A may be manually removed by shaking or tilting the container 500 with the movable member 530 in the open position 534, such that at least the bottom article 10A moves through the movable opening 531 under the force of gravity. Thus, the container 500 may provide an easy to use dispensing mechanism to dispense the bottom article 10A from the container 500.

Figure 23A:
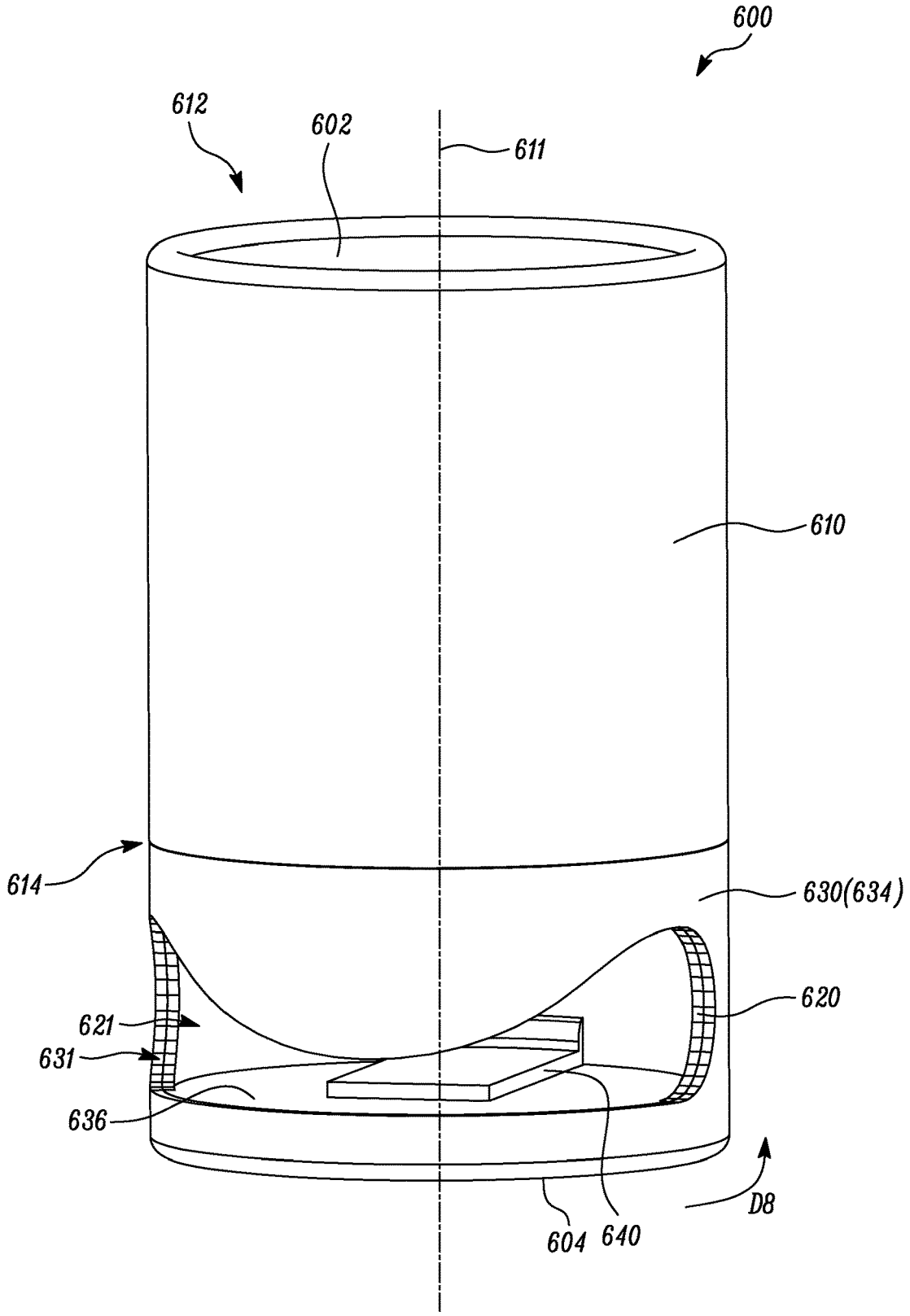
FIGS. 23A and 23B are front perspective views of a container for a plurality of articles in open and closed configurations, respectively, according to a sixth aspect of the invention.
Figure 23B:
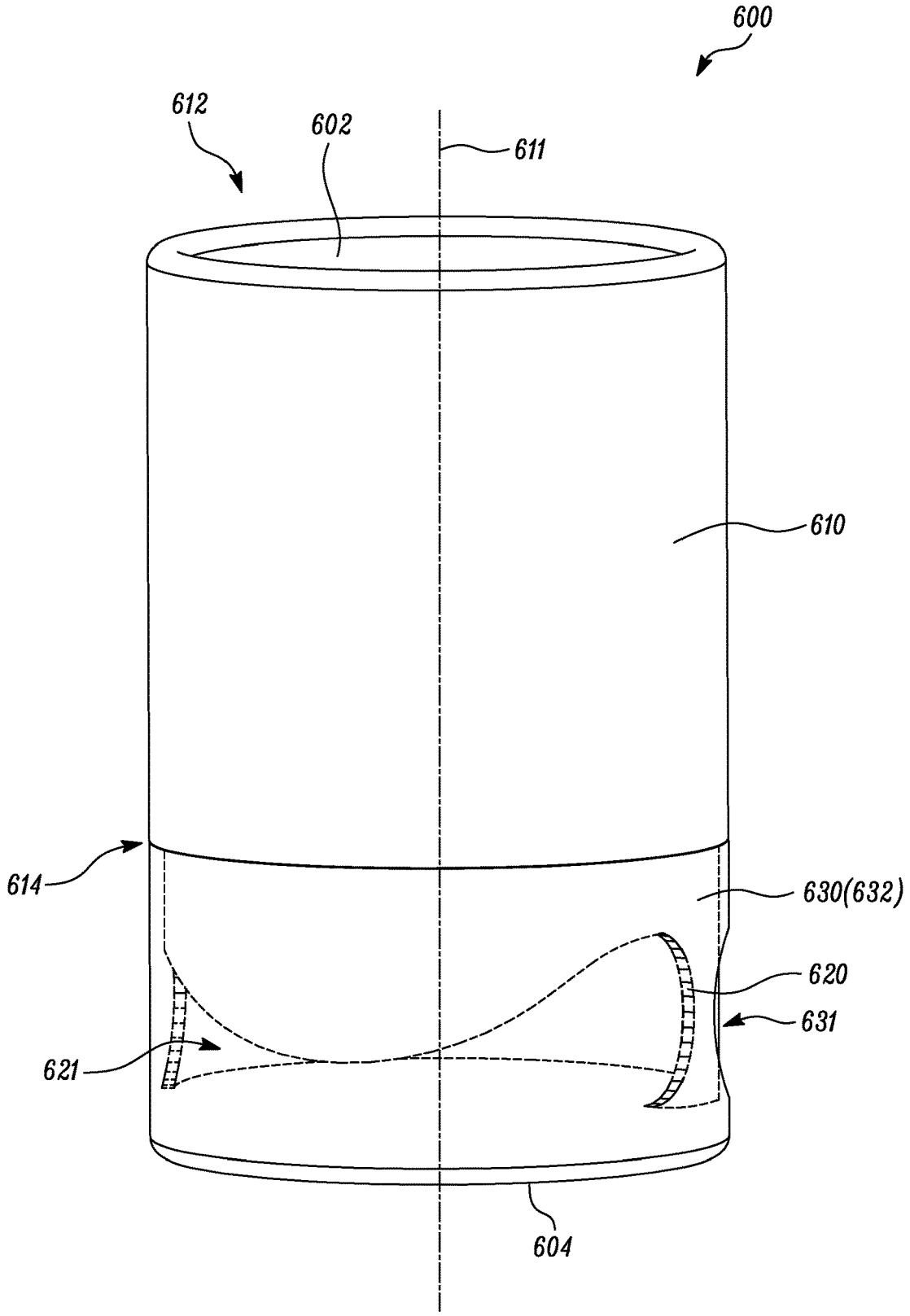

FIGS. 23A and 23B are front perspective views of different configurations of a container 600 for the plurality of articles 10 (shown in FIGS. 26A to 27B) stacked on top of each other according to a sixth aspect of the invention. Further, FIG. 24 shows an exploded perspective view of the container 600.

Figure 24:
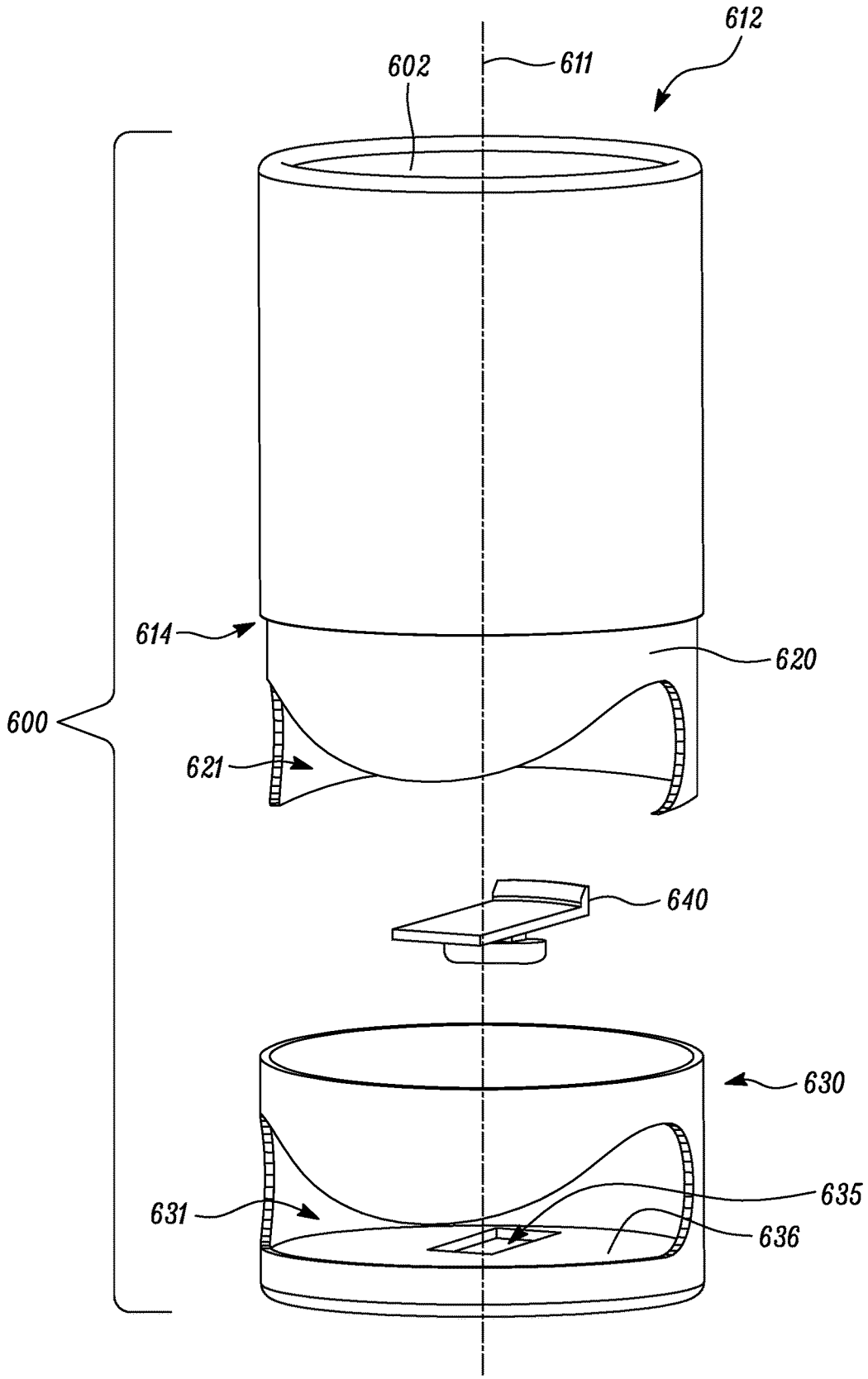
FIG. 24 is an exploded perspective view of the container of FIG. 23A.

Referring to FIGS. 23A, 23B, and 24, the container 600 comprises a main body 610 having a hollow tubular shape. The hollow tubular shape may allow the main body 610 to accommodate at least some of the plurality of articles 10 (shown in FIGS. 26A to 27B) therein.

The main body 610 comprises a first closed end 612 and a second open end 614 opposing the first closed end 612. In other words, the second open end 614 may be opposite to the first closed end 612. The main body 610 extends along a longitudinal axis 611. Specifically, the main body 610 may extend along the longitudinal axis 611 between the first closed end 612 and the second open end 614. The first closed end 612 may define a closed top end 602 of the container 600.

The container 600 further comprises a bottom member 620. The bottom member 620 may be fixedly coupled to the main body 610 at the second open end 614. Further, the bottom member 620 may define a bottom opening 621 therethrough in communication with the second open end 614. The bottom opening 621 may extend angularly relative to the longitudinal axis 611. The bottom opening 621 may be similar to the bottom opening 421 of the container 400 of FIG. 19A. Therefore, the bottom opening 621 may subtend a total angle of at least 150 degrees about the longitudinal axis 611. Further, the bottom opening 621 may comprise two symmetric portions (not shown) about a central axis (not shown). Each symmetric portion may extend from the central axis to a concave end (not shown). Each symmetric portion may have a minimum width at the central axis and a maximum width defined by the concave end.

The container 600 further comprises a movable member 630 movably coupled to the bottom member 620, such that the movable member 630 may be movable relative to the bottom member 620 between a closed position 632 (see FIG. 23B) and an open position 634 (see FIG. 23A). The movable member 630 defines a closed bottom end 604 of the container 600.

The movable member 630 further defines a movable opening 631 therethrough in communication with the second open end 614. The movable opening 631 extends angularly relative to the longitudinal axis 611. The movable opening 631 may be similar to the movable opening 431 of the container 400 of FIG. 19A. Therefore, the movable opening 631 may subtend a total angle of at least 150 degrees about the longitudinal axis 611. Further, the movable opening 631 may comprise two symmetric portions (not shown) about a central axis (not shown). Each symmetric portion may extend from the central axis to a concave end (not shown). Each symmetric portion may have a minimum width at the central axis and a maximum width defined by the concave end.

The movable member 630 may be rotated along a direction D8 about the longitudinal axis 611 to move the movable member 630 between the closed position 632 and the open position 634 (e.g., from the open position 634 to the closed position 632). The movable member 630 may also be rotated opposite to the direction D8 about the longitudinal axis 611 to move the movable member 630 between the closed position 632 and the open position 634 (e.g., from the closed position 632 to the open position 634).

In the closed position 632, the movable opening 631 may be closed. Specifically, in the closed position 632, the movable opening 631 may be misaligned from the bottom opening 621. In the open position 634, the movable opening 631 may be at least partially exposed to allow removal of the bottom article 10A (shown in FIG. 27B) from the plurality of articles 10 from the container 600. Specifically, in the open position 634, the movable opening 631 may be at least partially aligned with the bottom opening 621.

The movable member 630 may further comprise a bottom portion 636 defining the closed bottom end 604 of the container 600. The bottom portion 636 may define a slot 635 therethrough. The container 600 may further comprise a slider 640. The slider 640 may be at least partially received through the slot 635.

The main body 610 may be configured to provide compression resistance and moisture barrier to the container 600. In other words, the main body 610 may protect the plurality of articles 10 (shown in FIGS. 27A to 28B) from compression (e.g., by external forces incurred by the container 600 during shipping or usage thereof), and may reduce or prevent contact between the plurality of articles 10 stored in the container 600 and moisture from an external environment (e.g., a shower) in which the container 600 is disposed. Therefore, the container 600 may reduce or prevent external moisture from being absorbed by the plurality of articles 10 stored within the container 600.

The main body 610 may be primarily made of a paper material and may be substantially free of plastic. Specifically, the main body 610 may comprise from 0% to 5% by weight of plastic. The main body 610 made of the paper material may comprise barrier materials to protect the main body 610, for example, against moisture, grease/oils, oxygen, etc. Further, the movable member 630 may be made of a formed pulp with the barrier materials applied to the formed pulp. Moreover, the bottom member 620 and the slider 640 may be made of a plastic. Alternatively, the bottom member 620 and the slider 640 may be made of injection molded pulp, or a combination of injection molded paper and plastic. Further, the container 600 may be substantially made of paper and/or aluminum. In some examples, the container 600 may comprise less plastic per dose than current liquid shampoo bottles. In some examples, the container 600 can contain less than 60% plastic, less than 55% plastic, or less than 50% plastic.

Figure 25A:
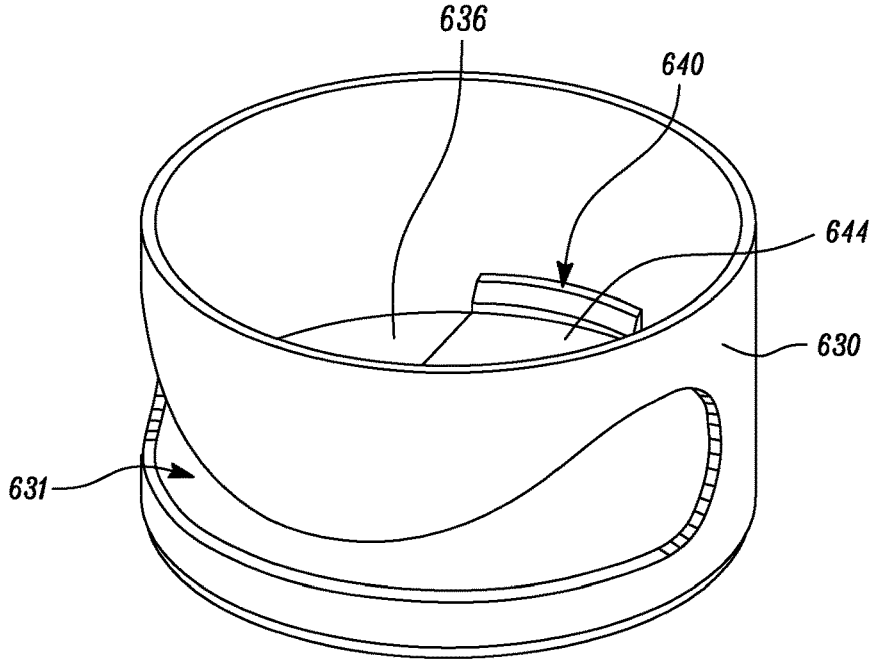
FIG. 25A is a top perspective view of a movable member and a slider of the container of FIG. 23A.
Figure 25B:
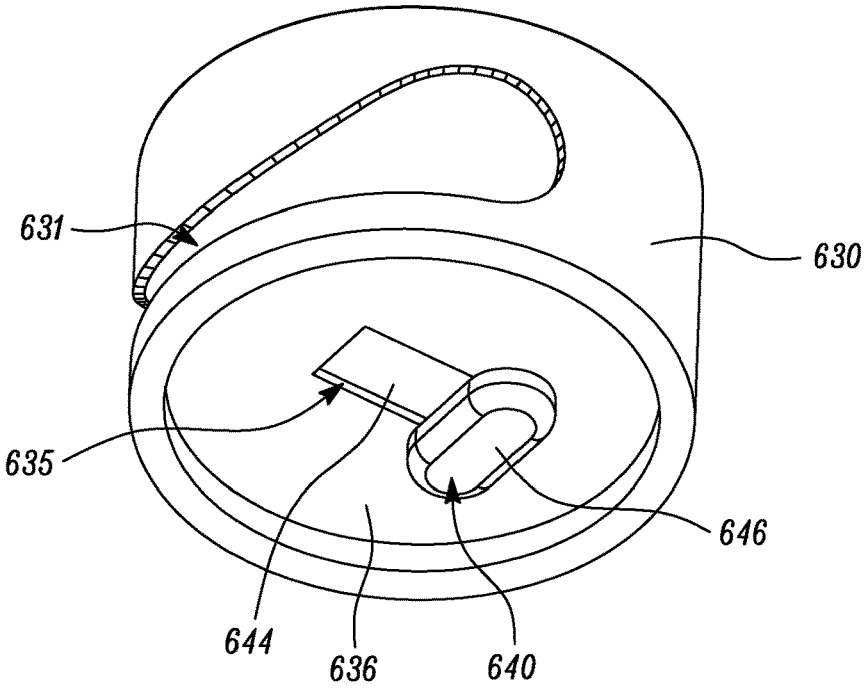
FIG. 25B is a bottom perspective view of the movable member and the slider of FIG. 25A.
Figure 26A:
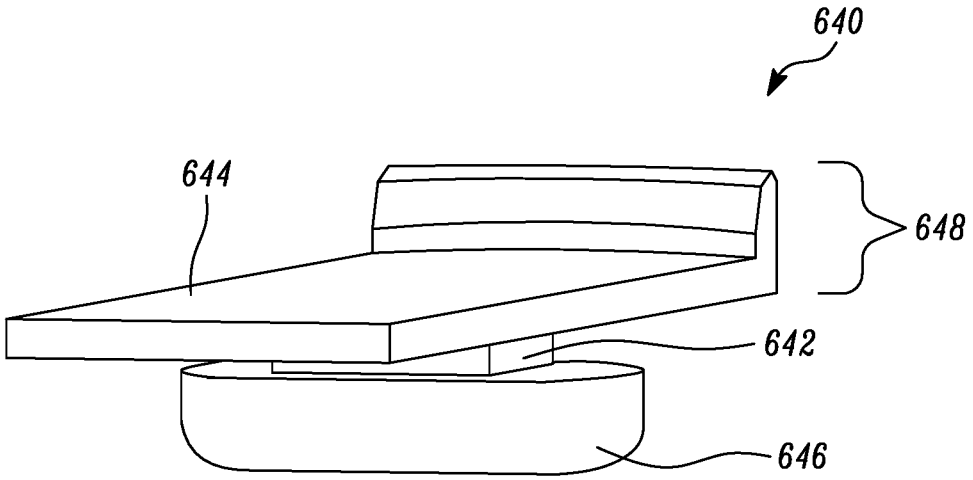
FIGS. 26A and 26B are a front perspective view and a bottom perspective view, respectively, of a slider of the container of FIG. 23A.
Figure 26B:
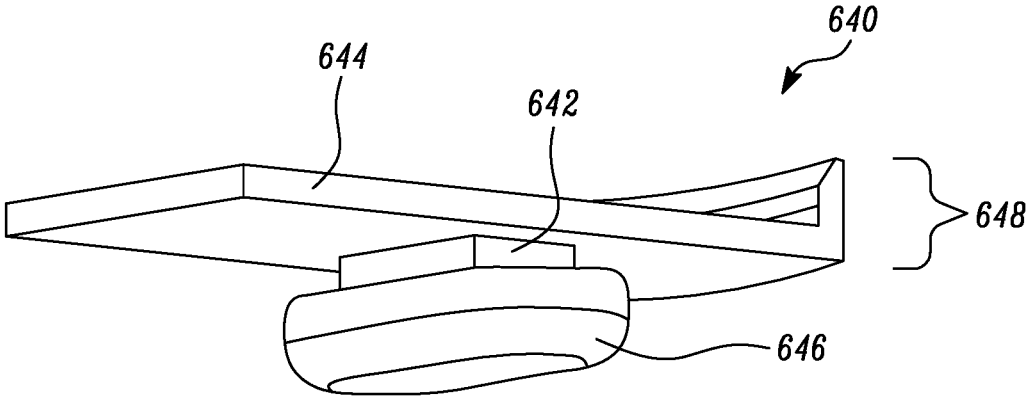

FIGS. 25A and 25B respectively show a top perspective view and a bottom perspective view of the movable member 630 and the slider 640. Further, FIGS. 26A and 26B respectively show a front perspective view and a bottom perspective view of the slider 640.

Referring to FIGS. 25A to 26B, the slider 640 may comprise a sliding portion 642 (shown in FIGS. 26A and 26B) slidably received through the slot 635. The slider 640 may further comprise an engaging portion 644 connected to the sliding portion 642. The engaging portion 644 may be disposed within the movable member 630. The engaging portion 644 may be configured to engage the bottom article 10A (shown in FIG. 27A) from the plurality of articles 10. The slider 640 may further comprise a gripping portion 646 connected to the sliding portion 642 opposite to the engaging portion 644. The gripping portion 646 may be disposed externally to the movable member 630. Each of the engaging portion 644 and the gripping portion 646 may be wider than the slot 635 in order to secure the sliding portion 642 within the slot 635. The sliding portion 642 may be narrower than the slot 635, or may have a substantially similar width as the slot 635.

The engaging portion 644 may have a substantially planar shape. The slider 640 further comprises an end portion 648 extending from an end of the engaging portion 644 that may be distal to the movable opening 631. The end portion 648 may be inclined to a plane defined by the engaging portion 644. In some examples, the end portion 648 may be substantially perpendicular to the plane defined by the engaging portion 644.

Figure 27A:
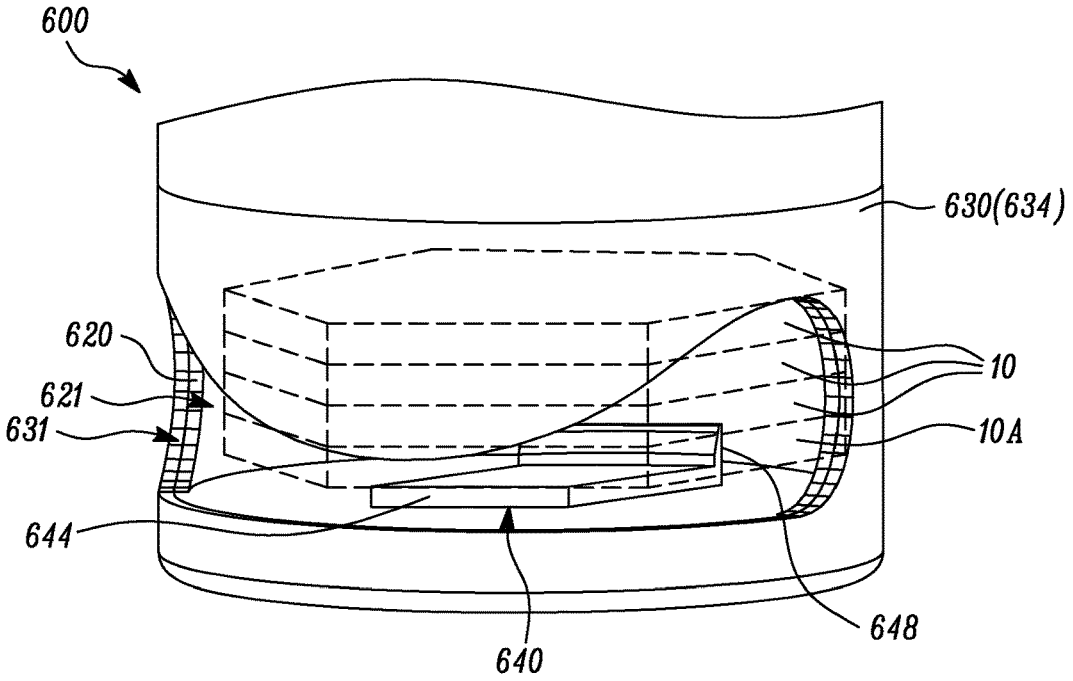
FIGS. 27A and 27B are a front perspective view and a top view, respectively, of a portion of the container of FIG. 23A with some elements of the container not shown.
Figure 27B:
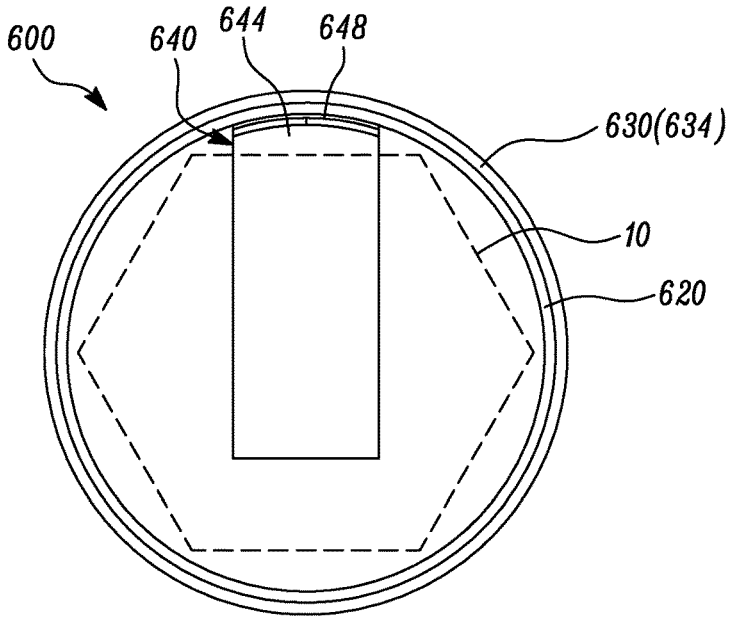
Figure 28A:
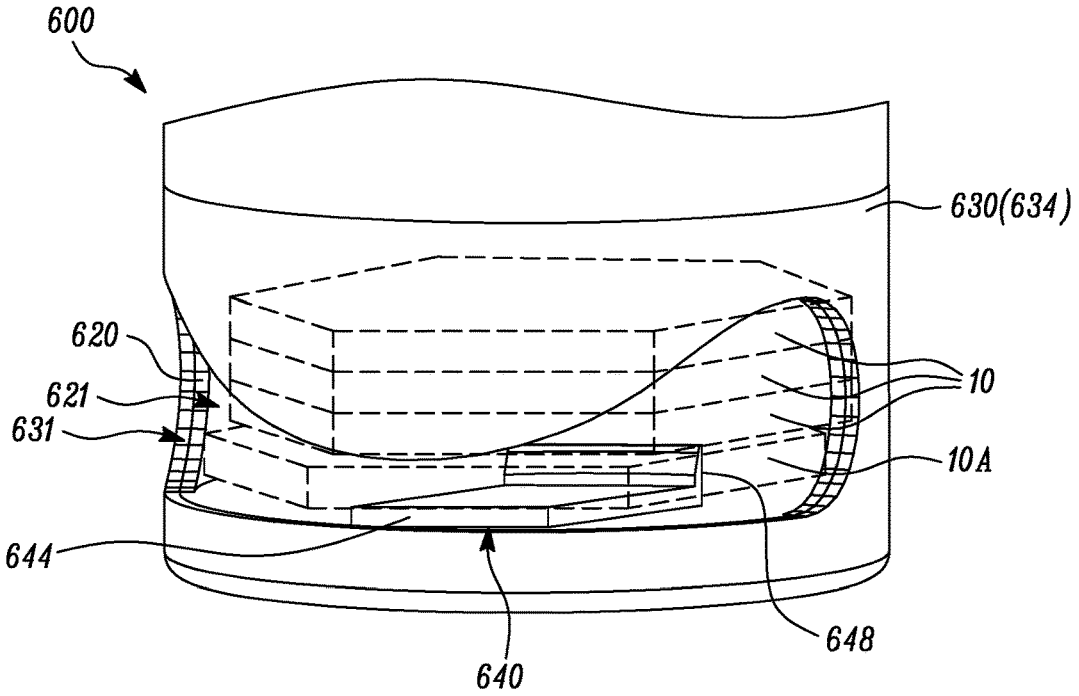
FIGS. 28A and 28B are a front perspective view and a top view, respectively, of a portion of the container of FIG. 23A in a different configuration from FIGS. 27A and 27B with some elements of the container not shown.
Figure 28B:
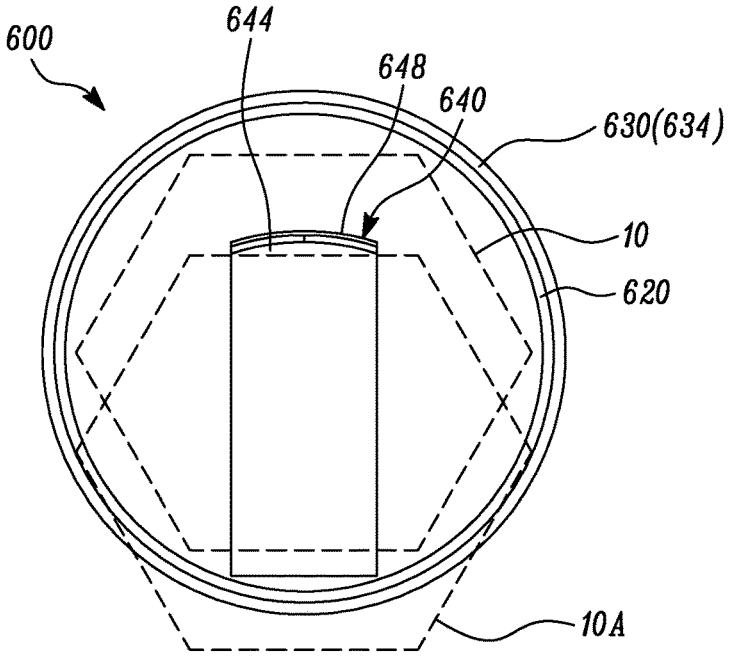

FIGS. 27A and 27B respectively show a front perspective view and a top view of a portion of the container 600. Further, FIGS. 28A and 28B respectively show a front perspective view and a top view a portion of the container 600 in a different configuration from that shown in FIGS. 27A and 27B. Some elements of the container 600 are not shown in FIGS. 27A to 28B for illustrative purposes. Further, the plurality of articles 10 are shown by dashed lines in FIGS. 27A to 28B.

The movable member 630 may be in the open position 634 in FIGS. 27A to 28B. In other words, the movable opening 631 may be at least partially aligned with the bottom opening 621 to allow removal of the bottom article 10A in FIGS. 27A to 28B.

Referring to FIGS. 26A to 28B, in the open position 634 of the movable member 630, the gripping portion 646 may be configured to be moved towards the bottom opening 621 causing the sliding portion 642 (shown in FIGS. 26A and 26B) to slide along the slot 635 (shown in FIG. 25B) and the engaging portion 644 to move the bottom article 10A towards the bottom opening 621, such that the bottom article 10A at least partially extends through the bottom opening 621 for removal from the container 600. In some examples, the slider 640 may be biased away from the bottom opening 621. Specifically, the slider 640 may be biased towards an end of the slot 635 (shown in FIG. 25B) that may be distal to the bottom opening 621. The end portion 648 may engage and push the bottom article 10A towards the bottom opening 621.

Further, after removal of the bottom article 10A from the container 600, the gripping portion 646 may be configured to be moved away from the bottom opening 621, such that the engaging portion 644 engages a successive bottom article 10 from the plurality of articles 10. The successive bottom article 10 may be an article stacked on top of the bottom article 10A. As discussed above, the slider 640 may be biased away from the bottom opening 621. Therefore, in some examples, after removal of the bottom article 10A from the container 600, the slider 640 may automatically move away from the bottom opening 621. Further, the container 600 may allow sequential dispensing of successive bottom articles 10A from the stack of the plurality of articles 10. Thus, the container 600 may provide an easy to use dispensing mechanism to dispense the bottom article 10A from the container 600.

Combinations

A. A container for a plurality of articles, the container comprising:

a main body having a hollow tubular shape and extending along a longitudinal axis, the main body comprising a first end and a second end opposing the first end, wherein at least the second end is open;

a hollow member fixedly coupled to the main body at the second end and defining a first opening therethrough extending angularly about the longitudinal axis;

a cup member rotatably coupled to the hollow member, such that the cup member is rotatable relative to the hollow member about the longitudinal axis, the cup member defining a second opening therethrough extending angularly about the longitudinal axis, wherein the cup member comprises a base portion defining a closed bottom end of the container and defining a grooved track facing the second end of the main body; and a cam arm received within the hollow member and the cup member, wherein the cam arm is movably coupled to the hollow member and comprises a protrusion movably engaged with the grooved track, such that the cam arm moves relative to the hollow member due to a relative rotation between the hollow member and the cup member;

wherein the main body, the hollow member, and the cup member together receive the plurality of articles therein;

wherein the hollow member and the cup member are rotatable relative to each other between an open configuration and a closed configuration, wherein, in the open configuration, the first and second openings are at least partially aligned with each other to define a dispensing opening, and wherein, in the closed configuration, the first and second openings are misaligned from each other to close the dispensing opening; and wherein the cam arm moves between an engaged position corresponding to the closed configuration and a dispensing position corresponding to the open configuration due to the relative rotation between the hollow member and the cup member, wherein, in the engaged position, the cam arm is configured to engage a bottom article from the plurality of articles, and wherein the cam arm is further configured to move the bottom article due to the relative rotation between the hollow member and the cup member, such that, in the dispensing position of the cam arm, the bottom article at least partially extends through the dispensing opening and is removable from the container.

B. The container according to Paragraph A, wherein a relative rotation between the hollow member and the cup member from the closed configuration to the open configuration in a first direction about the longitudinal axis causes the cam arm to move from the engaged position to the dispensing position, and wherein, after removal of the bottom article from the container, a relative rotation between the hollow member and the cup member from the open configuration to the closed configuration in a second direction opposite to the first direction causes the cam arm to move from the dispensing position to the engaged position and engage a successive bottom article from the plurality of articles.

C. The container according to Paragraph A or B, further comprising a cap coupled to the main body at the first end, wherein the cap is configured to close the first end of the main body to define a closed top end of the container.

D. The container according to any one of Paragraphs A-C, further comprising a follower slidably received within the main body and configured to engage the plurality of articles, such that the plurality of articles is received at least partially between the follower and the cam arm relative to the longitudinal axis.

E The container according to any one of Paragraphs A-D, wherein the hollow member comprises:

a first coupling portion fixedly coupled to the main body;

a second coupling portion rotatably coupled to the cup member, the second coupling portion defining the first opening as an angular cut-out; and a projection disposed between the first and second coupling portions, the projection engaging with each of the main body and the cup member, such that the projection is disposed between the main body and the cup member along the longitudinal axis.

F The container according to Paragraph E, wherein the hollow member further comprises a plurality of shaped portions disposed on an outer surface of the first coupling portion, and wherein the shaped portions engage the main body to rotationally and/or axially fix the main body and the hollow member relative to each other.

G The container according to any one of Paragraphs A-F, wherein the hollow member further comprises an angular projection disposed at an end of the hollow member, wherein the cup member further defines an angular slot movably engaging with the angular projection of the hollow member to allow the relative rotation between the hollow member and the cup member.

H The container according to Paragraph G, wherein the cup member further comprises:

a portion defining the second opening as an angular cut-out; and a connecting portion connecting a circumferential edge of the base portion with the portion;

wherein the angular slot is defined between the circumferential edge of the base portion, the portion, and the connecting portion.

I The container according to any one of Paragraphs A-H, wherein the cup member further comprises a lip disposed at an end distal to the base portion, wherein the hollow member further comprises a groove at least partially receiving the lip of the cup member therein, such that the lip is rotatable relative to the groove.

J The container according to any one of Paragraphs A-I, wherein the hollow member further comprises a coupling feature extending from an inner surface of the hollow member, and wherein the cam arm further comprises a coupling element received at least partially through the coupling feature to pivotally couple the cam arm to the coupling feature.

K The container according to Paragraph J, wherein the coupling feature comprises a narrow aperture, a shoulder disposed adjacent to the narrow aperture, and a wide aperture disposed adjacent to the shoulder and opposite to the narrow aperture, and wherein the coupling element of the cam arm comprises a narrow portion pivotally received at least partially within the narrow aperture and a wide portion pivotally received at least partially within the wide aperture and engaging with the shoulder.

L The container according to any one of Paragraphs A-K, wherein the cam arm further comprises a receiving portion configured to receive the bottom article thereon and an engaging portion extending from and inclined to the receiving portion, the engaging portion configured to engage with and move the bottom article towards the dispensing opening, wherein the protrusion extends from the receiving portion.

M The container according to Paragraph L, wherein the cam arm further comprises a curved portion extending from the engaging portion and distal to the receiving portion, and wherein, in the engaged position, the curved portion engages an inner surface of the hollow member.

N The container according to Paragraph L or M, wherein the receiving portion of the cam arm further defines a V-shaped notch spaced apart from the engaging portion.

O The container according to any one of Paragraphs A-N, wherein the grooved track extends from a first groove end to a second groove end, wherein, in the engaged position, the protrusion of the cam arm engages with the first groove end of the grooved track, and wherein, in the dispensing position, the protrusion of the cam arm engages with the second groove end of the grooved track.

P The container according to any one of Paragraphs A-O, wherein the base portion comprises a first major surface and a second major surface opposite to the first major surface, wherein the grooved track extends from the first major surface, and wherein the cam arm is at least partially disposed on the first major surface and moves along the first major surface between the engaged position and the dispensing position.

Q The container according to Paragraph P, wherein the base portion further comprises a continuous side wall extending from the first major surface beyond the second major surface and a bottom wall connected to the continuous side wall and distal to the first major surface, wherein the continuous side wall and the bottom wall define the grooved track therebetween.

R The container according to Paragraph Q, wherein the base portion further comprises a plurality of interconnected ribs extending from the second major surface and a rib extending from the second major surface and surrounding the plurality of interconnected ribs, wherein the rib is connected to at least some of the plurality of interconnected ribs, wherein at least some of the plurality of interconnected ribs define a plurality of hexagonal shapes, and wherein at least some of the plurality of interconnected ribs are connected to the continuous side wall.

S The container according to any one of Paragraphs A-R, wherein the main body comprises from 0% to 5% by weight of plastic.

T A container for a plurality of articles, the container comprising:

a main body having a hollow tubular shape and extending along a longitudinal axis, the main body comprising a first open end and a second open end opposing the first open end;

a top member fixedly coupled to the main body at the first open end, the top member defining a top opening therethrough in communication with the first open end, wherein the top opening is configured to be selectively open or closed; and a pusher slidably received within the main body and movable along the longitudinal axis, the pusher defining a movable closed bottom end of the container;

wherein the plurality of articles is received within the main body and stacked on top of the pusher, and wherein the pusher is movable along the longitudinal axis towards the top opening, such that a top article from the plurality of articles is removable from the top opening.

U The container according to Paragraph T, further comprising a cap removably coupled to the main body and configured to selectively close the first open end and the top opening of the top member.

V The container according to Paragraph T or U, wherein the top member comprises:

a portion fixedly coupled to the first open end of the main body and defining the top opening aligned with the first open end;

an engaging portion coupled to the portion and extending at least partially into the top opening, the engaging portion comprising an inclined planar surface inclined obliquely to the longitudinal axis, wherein the inclined planar surface is configured to engage with the top article and separate the top article from a rest of the plurality of articles.

W The container according to Paragraph T, further comprising a movable member rotatably coupled to the top member, such that the movable member is rotatable relative to the top member about the longitudinal axis, wherein the movable member defines a movable opening therethrough that is selectively and at least partially aligned with the top opening of the top member to allow removal of the top article from the container, and wherein the movable member closes the top opening when the movable opening is misaligned from the top opening.

X The container according to Paragraph W, wherein each of the top opening and the movable opening extends angularly relative to the longitudinal axis and subtends a total angle of at least 150 degrees about the longitudinal axis, wherein each of the top opening and the movable opening comprises two symmetric portions about a central axis, each symmetric portion extending from the central axis to a concave end, wherein each symmetric portion has a minimum width at the central axis and a maximum width defined by the concave end.

Y A container for a plurality of articles, the container comprising:

a main body having a hollow tubular shape and extending along a longitudinal axis, the main body comprising a first closed end and a second open end opposing the first closed end;

a bottom member fixedly coupled to the main body at the second open end;

a movable member movably coupled to the bottom member, such that the movable member is movable relative to the bottom member between a closed position and an open position, wherein the movable member defines a movable opening therethrough in communication with the second open end, the movable opening extending angularly relative to the longitudinal axis;

wherein, in the closed position, the movable opening is closed, wherein, in the open position, the movable opening is at least partially exposed to allow removal of a bottom article from the plurality of articles from the container, and wherein the movable member defines a closed bottom end of the container.

Z The container according to Paragraph Y, wherein the bottom member defines a bottom opening therethrough in communication with the second open end, the bottom opening extending angularly relative to the longitudinal axis, wherein the movable member is rotatable relative to the bottom member about the longitudinal axis between the closed position and the open position, wherein, in the closed position, the movable opening is misaligned from the bottom opening, and wherein, in the open position, the movable opening is at least partially aligned with the bottom opening.

AA The container according to Paragraph Z, wherein the bottom opening subtends a total angle of at least 150 degrees about the longitudinal axis and comprises two symmetric portions about a central axis, each symmetric portion extending from the central axis to a concave end, wherein each symmetric portion has a minimum width at the central axis and a maximum width defined by the concave end.

AB The container according to Paragraph Z, wherein the movable member comprises a bottom portion defining the closed bottom end of the container, the bottom portion defining a slot therethrough, and wherein the container further comprises a slider comprising:

a sliding portion slidably received through the slot;

an engaging portion connected to the sliding portion and disposed within the movable member, wherein the engaging portion is configured to engage the bottom article from the plurality of articles; and a gripping portion connected to the sliding portion opposite to the engaging portion and disposed externally to the movable member;

wherein each of the engaging portion and the gripping portion is wider than the slot in order to secure the sliding portion within the slot;

wherein, in the open position of the movable member, the gripping portion is configured to be moved towards the bottom opening causing the sliding portion to slide along the slot and the engaging portion to move the bottom article towards the bottom opening, such that the bottom article at least partially extends through the bottom opening for removal from the container; and wherein, after removal of the bottom article from the container, the gripping portion is configured to be moved away from the bottom opening, such that the engaging portion engages a successive bottom article from the plurality of articles.

AC The container according to Paragraph Y, wherein the movable member is slidable relative to the bottom member along the longitudinal axis between the closed position and the open position, wherein, in the closed position, the bottom member covers the movable opening, and wherein, in the open position, the movable opening is at least partially offset from the bottom member relative to the longitudinal axis.

AD The container according to any one of Paragraphs Y, Z, AA, and AB, wherein the movable opening subtends a total angle of at least 150 degrees about the longitudinal axis and comprises two symmetric portions about a central axis, each symmetric portion extending from the central axis to a concave end, wherein each symmetric portion has a minimum width at the central axis and a maximum width defined by the concave end.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container for a plurality of articles, the container comprising:

a main body having a hollow tubular shape and extending along a longitudinal axis, the main body comprising a first end and a second end opposing the first end, wherein at least the second end comprises an opening;

a hollow member fixedly coupled to the main body at the second end and defining a first opening therethrough extending angularly about the longitudinal axis;

a cup member rotatably coupled to the hollow member, such that the cup member is rotatable relative to the hollow member about the longitudinal axis, the cup member defining a second opening therethrough extending angularly about the longitudinal axis, wherein the cup member comprises a base portion defining a closed bottom end of the container and defining a grooved track facing the second end of the main body; and a cam arm received within the hollow member and the cup member, wherein the cam arm is movably coupled to the hollow member and comprises a protrusion movably engaged with the grooved track, such that the cam arm moves relative to the hollow member due to a relative rotation between the hollow member and the cup member;

wherein the main body, the hollow member, and the cup member together receive the plurality of articles therein;

wherein the hollow member and the cup member are rotatable relative to each other between an open configuration and a closed configuration, wherein, in the open configuration, the first and second openings are at least partially aligned with each other to define a dispensing opening, and wherein, in the closed configuration, the first and second openings are misaligned from each other to close the dispensing opening; and wherein the cam arm moves between an engaged position corresponding to the closed configuration and a dispensing position corresponding to the open configuration due to the relative rotation between the hollow member and the cup member, wherein, in the engaged position, the cam arm is configured to engage a bottom article from the plurality of articles, and wherein the cam arm is further configured to move the bottom article due to the relative rotation between the hollow member and the cup member, such that, in the dispensing position of the cam arm, the bottom article at least partially extends through the dispensing opening and is removable from the container.

2. The container according to claim 1, wherein a relative rotation between the hollow member and the cup member from the closed configuration to the open configuration in a first direction about the longitudinal axis causes the cam arm to move from the engaged position to the dispensing position, and wherein, after removal of the bottom article from the container, a relative rotation between the hollow member and the cup member from the open configuration to the closed configuration in a second direction opposite to the first direction causes the cam arm to move from the dispensing position to the engaged position and engage a successive bottom article from the plurality of articles.

3. The container according to claim 1, further comprising a cap coupled to the main body at the first end, wherein the cap is configured to close the first end of the main body to define a closed top end of the container.

4. The container according to claim 1, further comprising a follower slidably received within the main body and configured to engage the plurality of articles, such that the plurality of articles is received at least partially between the follower and the cam arm relative to the longitudinal axis.

5. The container according to claim 1, wherein the hollow member comprises:

a first coupling portion fixedly coupled to the main body;

a second coupling portion rotatably coupled to the cup member, the second coupling portion defining the first opening as an angular cut-out; and a projection disposed between the first and second coupling portions, the projection engaging with each of the main body and the cup member, such that the projection is disposed between the main body and the cup member along the longitudinal axis.

6. The container according to claim 5, wherein the hollow member further comprises a plurality of shaped portions disposed on an outer surface of the first coupling portion, and wherein the shaped portions engage the main body to rotationally and/or axially fix the main body and the hollow member relative to each other.

7. The container according to claim 1, wherein the hollow member further comprises an angular projection disposed at an end of the hollow member, wherein the cup member further defines an angular slot movably engaging with the angular projection of the hollow member to allow the relative rotation between the hollow member and the cup member.

8. The container according to claim 7, wherein the cup member further comprises:

a portion defining the second opening as an angular cut-out; and a connecting portion connecting a circumferential edge of the base portion with the portion;

wherein the angular slot is defined between the circumferential edge of the base portion, the portion, and the connecting portion.

9. The container according to claim 1, wherein the cup member further comprises a lip disposed at an end distal to the base portion, wherein the hollow member further comprises a groove at least partially receiving the lip of the cup member therein, such that the lip is rotatable relative to the groove.

10. The container according to claim 1, wherein the hollow member further comprises a coupling feature extending from an inner surface of the hollow member, and wherein the cam arm further comprises a coupling element received at least partially through the coupling feature to pivotally couple the cam arm to the coupling feature.

11. The container according to claim 10, wherein the coupling feature comprises a narrow aperture, a shoulder disposed adjacent to the narrow aperture, and a wide aperture disposed adjacent to the shoulder and opposite to the narrow aperture, and wherein the coupling element of the cam arm comprises a narrow portion pivotally received at least partially within the narrow aperture and a wide portion pivotally received at least partially within the wide aperture and engaging with the shoulder.

12. The container according to claim 1, wherein the cam arm further comprises a receiving portion configured to receive the bottom article thereon and an engaging portion extending from and inclined to the receiving portion, the engaging portion configured to engage with and move the bottom article towards the dispensing opening, wherein the protrusion extends from the receiving portion.

13. The container according to claim 12, wherein the cam arm further comprises a curved portion extending from the engaging portion and distal to the receiving portion, and wherein, in the engaged position, the curved portion engages an inner surface of the hollow member.

14. The container according to claim 12, wherein the receiving portion of the cam arm further defines a V-shaped notch spaced apart from the engaging portion.

15. The container according to claim 1, wherein the grooved track extends from a first groove end to a second groove end, wherein, in the engaged position, the protrusion of the cam arm engages with the first groove end of the grooved track, and wherein, in the dispensing position, the protrusion of the cam arm engages with the second groove end of the grooved track.

16. The container according to claim 1, wherein the base portion comprises a first major surface and a second major surface opposite to the first major surface, wherein the grooved track extends from the first major surface, and wherein the cam arm is at least partially disposed on the first major surface and moves along the first major surface between the engaged position and the dispensing position.

17. The container according to claim 16, wherein the base portion further comprises a continuous side wall extending from the first major surface beyond the second major surface and a bottom wall connected to the continuous side wall and distal to the first major surface, wherein the continuous side wall and the bottom wall define the grooved track therebetween.

18. The container according to claim 17, wherein the base portion further comprises a plurality of interconnected ribs extending from the second major surface and a rib extending from the second major surface and surrounding the plurality of interconnected ribs, wherein the rib is connected to at least some of the plurality of interconnected ribs, wherein at least some of the plurality of interconnected ribs define a plurality of hexagonal shapes, and wherein at least some of the plurality of interconnected ribs are connected to the continuous side wall.

19. The container according to claim 1, wherein the main body comprises from 0% to 5% by weight of plastic.

* * * * *